US010340599B2

(12) United States Patent
Tayfeh Aligodarz et al.

(10) Patent No.: US 10,340,599 B2
(45) Date of Patent: Jul. 2, 2019

(54) META-MATERIAL RESONATOR ANTENNAS

(71) Applicant: University of Saskatchewan, Saskatoon (CA)

(72) Inventors: Mohammadreza Tayfeh Aligodarz, Saskatoon (CA); Atabak Rashidian, Winnipeg (CA); David Klymyshyn, Saskatoon (CA)

(73) Assignee: University of Saskatchewan, Saskatoon (CA)

( * ) Notice: Subject to any disclaimer, the term of this patent is extended or adjusted under 35 U.S.C. 154(b) by 447 days.

(21) Appl. No.: 14/764,764

(22) PCT Filed: Jan. 31, 2014

(86) PCT No.: PCT/CA2014/000074

§ 371 (c)(1),
(2) Date: Jul. 30, 2015

(87) PCT Pub. No.: WO2014/117259

PCT Pub. Date: Aug. 7, 2014

(65) Prior Publication Data

US 2015/0380824 A1 Dec. 31, 2015

Related U.S. Application Data

(60) Provisional application No. 61/759,155, filed on Jan. 31, 2013.

(51) Int. Cl.
*H01Q 9/04* (2006.01)
*H01Q 15/00* (2006.01)

(52) U.S. Cl.
CPC ..... *H01Q 9/0485* (2013.01); *H01Q 15/0066* (2013.01); *H01Q 15/0086* (2013.01)

(58) Field of Classification Search
CPC ..... H01Q 9/0485; H01Q 15/0086; H01Q 15/0066
See application file for complete search history.

(56) References Cited

U.S. PATENT DOCUMENTS 4,907,012 A * 3/1990 Trumble ..... H01Q 21/0031 343/772
5,940,036 A 8/1999 Oliver et al.
(Continued)

FOREIGN PATENT DOCUMENTS

CN 1653647 A 8/2005
CN 101593866 A 12/2009
(Continued)

OTHER PUBLICATIONS

Njoku et al.; Effective Permittivity of Heterogeneous Substrates With Cubes in a 3-D Lattice; IEEE Antennas and Wireless Propagation Letters; vol. 10; 2011.*
(Continued)

*Primary Examiner* — Dameon E Levi
*Assistant Examiner* — Ab Salam Alkassim, Jr
(74) *Attorney, Agent, or Firm* — Bereskin & Parr LLP/S.E.N.C.R.L., s.r.l.; Stephen Beney; Paul R. Horbal

(57) ABSTRACT

Antennas suitable for use in compact radio frequency (RF) applications and devices, and methods of fabrication thereof. Described are resonator antennas, for example dielectric resonator antennas fabricated using polymer-based materials, such as those commonly used in lithographic fabrication of integrated circuits and microsystems. Accordingly, lithographic fabrication techniques can be employed in fabrication. The antennas have metal inclusions embedded in the resonator body which can be configured to control electromagnetic field patterns, which serves to enhance the effective permittivity of the resonator body, while creating an anisotropic material with different effective permittivity and polarizations in different orientations.

46 Claims, 50 Drawing Sheets

(56) References Cited

U.S. PATENT DOCUMENTS 5,952,972 A 9/1999 Ittipiboon et al.
6,198,450 B1 * 3/2001 Adachi ..... H01Q 9/0485 343/753
6,323,818 B1 * 11/2001 Koh ..... H01Q 1/38 343/772
6,323,824 B1 11/2001 Heinrichs et al.
6,452,565 B1 9/2002 Kingsley et al.
6,512,494 B1 * 1/2003 Diaz ..... H01Q 7/00 343/842
6,556,169 B1 4/2003 Fukuura et al.
6,833,816 B2 12/2004 Hilgers
6,952,190 B2 * 10/2005 Lynch ..... H01Q 1/28 343/700 MS
7,196,663 B2 3/2007 Bolzer
7,292,204 B1 11/2007 Chang et al.
7,443,363 B2 10/2008 Ying
7,541,998 B1 6/2009 Chang et al.
7,570,219 B1 * 8/2009 Paulsen ..... H01Q 1/28 343/708
7,667,666 B2 2/2010 Chang et al.
7,940,228 B1 * 5/2011 Buckley ..... H01Q 15/0086 343/700 MS
8,259,032 B1 * 9/2012 Buckley ..... H01Q 1/40 343/873
9,374,887 B1 * 6/2016 Warne ..... H05K 1/024
9,810,823 B2 * 11/2017 Girard Desprolet ... G02B 5/204
2002/0024466 A1 2/2002 Masuda
2002/0181646 A1 12/2002 Mehldau
2003/0011518 A1 * 1/2003 Sievenpiper ..... H01P 1/2005 343/700 MS
2003/0052834 A1 * 3/2003 Sievenpiper ..... H01Q 21/245 343/909
2004/0119646 A1 6/2004 Ohno et al.
2004/0130489 A1 7/2004 Le Bolzer et al.
2005/0030137 A1 * 2/2005 McKinzie, III ..... H01Q 15/008 335/306
2005/0057402 A1 3/2005 Ohno et al.
2005/0062673 A1 * 3/2005 Wu ..... H01Q 1/246 343/872
2005/0074961 A1 * 4/2005 Beyer ..... H01L 21/764 438/619
2005/0200540 A1 * 9/2005 Isaacs ..... B82Y 20/00 343/754
2006/0092079 A1 5/2006 de Rochemont
2006/0199380 A1 9/2006 Liu et al.
2006/0232474 A1 10/2006 Fox
2006/0267029 A1 * 11/2006 Li ..... H01L 33/22 257/79
2007/0064760 A1 3/2007 Kragh
2007/0152884 A1 7/2007 Bouche et al.
2007/0182640 A1 * 8/2007 Oohira ..... C08L 101/12 343/700 MS
2007/0222699 A1 9/2007 Modro
2007/0236406 A1 * 10/2007 Wen ..... H01Q 1/36 343/909
2008/0001843 A1 * 1/2008 Wu ..... H01Q 1/38 343/873
2008/0018391 A1 1/2008 Bates
2008/0042903 A1 * 2/2008 Cheng ..... H01Q 9/0485 343/700 MS
2008/0048915 A1 2/2008 Chang et al.
2008/0129616 A1 6/2008 Li et al.
2008/0129617 A1 6/2008 Li et al.
2008/0129626 A1 * 6/2008 Wu ..... H01Q 1/38 343/767
2008/0272963 A1 * 11/2008 Chang ..... H01Q 1/2291 343/700 MS
2008/0286554 A1 * 11/2008 Schwanke ..... C03C 15/00 428/312.6
2009/0028910 A1 * 1/2009 DeSimone ..... A61K 9/0097 424/401
2009/0073332 A1 * 3/2009 Irie ..... C09K 19/02 349/20
2009/0102739 A1 4/2009 Chang et al.
2009/0174609 A1 * 7/2009 Sanada ..... H01P 1/20381 343/700 MS
2009/0184875 A1 7/2009 Chang et al.
2009/0278754 A1 * 11/2009 Tanielian ..... H01Q 1/28 343/705
2010/0053013 A1 * 3/2010 Konishi ..... H01F 10/20 343/772
2010/0073232 A1 * 3/2010 Sajuyigbe ..... H01Q 19/025 342/372
2010/0103052 A1 4/2010 Ying
2010/0127596 A1 * 5/2010 Ayazi ..... H03H 3/0077 310/300
2010/0127798 A1 * 5/2010 Ayazi ..... H03H 9/02275 333/186
2010/0147365 A1 * 6/2010 DeSimone ..... B82Y 10/00 136/255
2010/0156754 A1 6/2010 Kondou
2011/0057853 A1 * 3/2011 Kim ..... H01Q 1/48 343/843
2011/0133991 A1 9/2011 Lee et al.
2011/0248890 A1 * 10/2011 Lee ..... H01Q 1/2283 343/700 MS
2011/0248891 A1 * 10/2011 Han ..... H01Q 1/40 343/700 MS
2012/0026054 A1 * 2/2012 Liu ..... H01Q 21/065 343/824
2012/0242556 A1 * 9/2012 Ando ..... H01Q 9/0407 343/834
2012/0245016 A1 9/2012 Curry et al.
2013/0002520 A1 * 1/2013 Choi ..... H01Q 15/0086 343/909
2013/0088396 A1 * 4/2013 Han ..... H01Q 9/04 343/700 MS
2013/0127669 A1 * 5/2013 Han ..... H01Q 9/0485 343/700 MS
2014/0043124 A1 * 2/2014 Liu ..... H01Q 15/08 335/296
2014/0062824 A1 * 3/2014 Yamaguchi ..... H01Q 9/0428 343/835
2014/0111400 A1 * 4/2014 Latrach ..... H01Q 15/0086 343/878
2014/0118217 A1 * 5/2014 Cannon ..... H01Q 1/425 343/872
2014/0118218 A1 * 5/2014 Jordan ..... H01Q 1/425 343/872
2014/0327597 A1 11/2014 Rashidian et al.
2016/0111769 A1 * 4/2016 Pance ..... H01Q 9/0492 333/202
2016/0218437 A1 * 7/2016 Guntupalli ..... H01Q 19/062
2016/0294068 A1 * 10/2016 Djerafi ..... H01Q 1/38
2016/0322708 A1 11/2016 Tayfeh Aligodarz et al.
2017/0365920 A1 * 12/2017 Mukai ..... H01Q 1/42

FOREIGN PATENT DOCUMENTS

CN 101710650 A 5/2010
CN 103337714 A 10/2013
EP 0 801 436 A2 10/1997
EP 1 767 582 B1 3/2007
GB 2396747 A 6/2004
WO 0131746 A1 5/2001
WO 2003/098737 A1 11/2003
WO 2007147446 A1 12/2007
WO 2009/004361 A1 1/2009
WO 2013/016815 A1 2/2013
WO 2014117259 A1 8/2014
WO 2015/000057 A1 1/2015
WO 2015/089643 A1 6/2015

OTHER PUBLICATIONS

Sabah; Multiband Metamaterials Based on Multiple Cocentric Open-Ring Resonators Topology; IEEE Journal of Selected Topics in Quantum Electronics; vol. 19; May 3, 2012.*

(56) References Cited

OTHER PUBLICATIONS

Document relating to PCT/CA2014/000074, dated Jan. 31, 2013 (International Preliminary Report and Written Opinion).
Document relating to PCT/CA2014/000074, dated Jan. 31, 2013 (International Search Report).
Kabiri, A. et al. "A Super-miniaturized Low Profile Antenna on a Substrate of Rose Curve Resonators", PIERS Proceedings, Marrakesh, Morocco, Mar. 20-23, 2011, pp. 106-109.
Klymshyn, D.M., Aligodarz, M.T., Rashidian, A., Börner, M., Mohr, J. (2011). Photoresist-based Resonator Antenna Array, Proc. 6th German Microwave Conf., Darmstadt, Germany.
Njoku, C. et al. "Effective Permittivity of Heterogeneous Substrates With Cubes in a 3-D Lattice", Antennas and Wireless Propagation Letters, IEEE, vol. 10, Issue No. 1536-1225, pp. 1480-1483, Jan. 2, 2012.
Petosa et al., "Dielectric Resonator Antennas: A Historical Review and the Current State of the Art", IEEE Antennas and Propagation Magazine, vol. 52, No. 5, Oct. 2010.
Petosa et al., Design and Analysis of Multisegment Dielectric Resonator Antennas, IEEE Transactiona on Antennas and Propagation, vol. 48, No. 5, May 2000.
Rashidian et al., "Photodefinable Microcomposites for Antenna Applications", Proc. IEEE Int. Symp. on Antennas and Propagation (APS 2010), Toronto, Canada, 2010.
Rashidian et al., "SU-8 Resonator Antenna", Proc. IEEE Int. Symp. Antennas & Prop, Toronto, Canada, 2010.
Rashidian et al., "Deep X-ray Lithography Processing for Batch Fabrication of Thick Polymer-based Antenna Structures," Journal of Micromechanics and Microengineering, vol. 20, No. 2, Feb. 2010.
Rashidian et al., "Microwave Performance of Photoresist-Alumina Microcomposites for Batch Fabrication of Thick Polymer-Based Dielectric Structures," Journal of Micromechanics and Microengineering, vol. 22, 2012.
Rashidian et al., "Photoresist-based polymer resonator antennas: lithography fabrication, strip-fed excitation, and multimode operation," IEEE Antennas and Propagation Magazine, vol. 53, No. 4, pp. 16-27, Aug. 2011.
Rashidian, A., Klymyshyn, D. M. (2008). Strip-fed Excitation of Very Low Permittivity Dielectric Resonator Antennas, Proc. 20th Asia-Pacific Microwave Conference (APMC 2008), Hongkong/Macau, pp. 1-4.
Rashidian, A., Klymyshyn, D. M. (2009). A Novel Approach to Enhance the Bandwidth of Miniaturized Microstrip-fed Dielectric Resonator Antennas, Proc. 3rd European Conference on Antennas and Propagation (Eucap 2009), Berlin, Germany, pp. 397-399.
Rashidian, A., Klymyshyn, D. M. (2009). Very Low Permittivity Slot-fed Dielectric Resonator Antennas with Improved Bandwidth for Millimetre-wave Applications, Proc. 3rd European Conference on Antennas and Propagation (Eucap 2009), Berlin, Germany, pp. 3554-3557.
Rashidian, A., Klymyshyn, D.M., Aligodarz, M.T., Boerner, M. and Mohr, J. (2010). Development of Polymer-based Dielectric Resonator Antennas for Millimeter-wave Applications, Progress In Electromag. Research (PIER C), 13, 203-216.
Sabah, C., "Multiband Metamaterials based on Multiple Concentric Open-Ring Resonators Topology", Quatum Electronics, Vo. 19, No. 1, Jan. 2013.
Sahbani, F. et al., "New Tunable Coplanar Microwave Phase Shifter With Nematic Crystal Liquid," 3rd International Design and Test Workshop, Dec. 2008.
Smith et al., Microstrip-Fed Circular Substrate Integrated Waveguide (SIW) Cavity Resonator and Antenna, Antennas and Propagation Society International Symposium, Jul. 11-17, 2010.
Weil, C. et al., "Highly-anisotropic liquid-crystal mixtures for tunable microwave devices," Electronics Letters, vol. 39, No. 24, pp. 1732-1734, Nov. 2003.
Extended European Search Report dated Aug. 19, 2016 in corresponding EP Patent Application No. 14746755.9.
First Office Action dated Jan. 13, 2015 in related CN Patent Application No. 2012800476924.
Second Office Action dated Aug. 20, 2015 in related CN Patent Application No. 2012800476924.
"Photolithography", Wikipedia, 8 pages, 2016.
International Search Report and Written Opinion dated Oct. 2, 2014 in related International Patent Application No. PCT/CA2014/000535.
Chaudhary, et al., "Wideband Two-layer Rectangular Dielectric Resonator Antenna with (Zr0.8Sn0.2)TiO4-Epoxy Composite System", 2011 Indian Antenna Week (IAW), Kolkata, India, 4 pages.
International Search Report and Written Opinion dated Mar. 12, 2015 in corresponding International Patent Application No. PCT/CA2014/000905.
International Preliminary Report on Patentability dated Jun. 21, 2016 in corresponding International Patent Application No. PCT/CA2014/000905.
Mohd, et al., "Dual-segment corporate feed four elements array antenna for broadband application", In IEEE Asia-Pacific Conference on Antennas and Propagation (APCAP), 2012, Singapore, 4 pages.
Haneishi, et al., "Array Antenna Composed of Circularly Polarized Dielectric Resonator Antennas", In IEEE Antennas & Propagation Society International Symposium, 1999, Orlando, FL, pp. 252-255.
International Preliminary Report on Patentability dated Aug. 13, 2015 in corresponding International Patent Application No. PCT/CA2014/000074.
Weil, et al., "Highly-anisotropic liquid-crystal mixtures for tunable microwave devices", Electronics Letters, 2003, 39 (24): 1732-1734.
"Photolithography", Wikipedia, 2016, 8 pages.
Rashidian, et al., "A New Low-Loss and Efficient Excitation Method for Low-Permittivity Dielectric Resonator Antennas", IEEE Antennas and Propagation Society International Symposium (APSURSI), Chicago, Illinois, 2012, 2 pages.
Non-final Office Action and Notice of References Cited dated May 26, 2016 in related U.S. Appl. No. 14/235,595.
Final Office Action and Notice of References Cited dated Jan. 4, 2017 in related U.S. Appl. No. 14/235,595.
Sabah, "Multiband Metamaterials Based on Multiple Concentric Open-Ring Resonators Topology", IEEE Journal of Selected Topics in Quantum Electronics, 2013, 19(1): 8500808 (16 pages).
Rashidian, "Photoresist-based polymer resonator antennas (PRAs) with lithographic fabrication and dielectric resonator antennas (DRAs) with improved performance", Ph.D. Thesis, University of Saskatchewan, Saskatoon, Canada, 2011, 188 pages.
Rashidian, et al., "Compact Wideband Multimode Dielectric Resonator Antennas Fed with Parallel Standing Strips", IEEE Transactions on Antennas and Propagation, 2012, 60(11): 5021-5031.
Rashidian, et al., "A Modified Microstrip Line for Excitation of Wide-Band Dielectric Resonator Antennas", 15th International Symposium on Antenna Technology and Applied Electromagnetics (ANTEM), Toulouse, France, 2012, 2 pages.
Rashidian, et al., "Low-Profile Dielectric Resonator Antennas for Millimeter-Wave Applications", 15th International Symposium on Antenna Technology and Applied Electromagnetics (ANTEM), Toulouse, France, 2012, 2 pages.
Rashidian, et al., "Dielectric Characterization of Materials using a Modified Microstrip Ring Resonator Technique", IEEE Transactions on Dielectrics and Electrical Insulation, 2012, 19(4): 1392-1399.
Tayfeh Aligodarz, "Air-Gap Standing Parallel Strips Waveguide for X-Ray Lithography Fabrication: Characteristics and Antenna Application", Proceedings of the 5th European Conference on Antennas and Propagation (EUCAP), Rome, Italy, 2011, pp. 1440-1443.
Hanemann, et al., "Development of new polymer-BaTiO3-composites with improved permittivity for embedded capacitors", Microsyst Technol., 2011, 17(2): 195-201.
Schumacher, et al., "Temperature treatment of nano-scaled barium titanate filler to improve the dielectric properties of high-k polymer based composites", Microelectronic Engineering, 2009, 87: 1978-1983.
Müller, et al., "Fabrication of ceramic microcomponents using deep X-ray lithography", Microsystem Technologies, 2005, 11(4-5): 271-277.

(56) References Cited

OTHER PUBLICATIONS

Non-final Office Action and Notice of References Cited dated Nov. 15, 2017 in related U.S. Appl. No. 14/235,595.
Examiner's Report dated Nov. 13, 2018 in related CA Patent Application No. 2,843,415.
Notice of Allowance and Notice of References Cited dated Apr. 1, 2019 in related U.S. Appl. No. 14/235,595.

* cited by examiner

E field pattern, 1st mode

E field pattern, 2nd mode

H field pattern, 1st mode

H field pattern, 2nd mode

META-MATERIAL RESONATOR ANTENNAS

FIELD

The embodiments described herein relate to microwave and radio frequency (RF) dielectric materials and devices, including antennas, and methods for fabricating the same. In particular, the described embodiments relate to dielectric materials containing metal inclusions and the use of these materials as dielectric resonator antennas.

INTRODUCTION

Microwave dielectric materials find widespread use in circuits and devices in the 1 to 100 GHz range. For example, high permittivity dielectric materials are employed as dielectric resonators (DRs) for use as frequency selective elements in oscillators and filters, and as radiating elements in antennas and antenna arrays.

Recently, dielectric resonator antennas (DRAs) have attracted increased attention for miniaturized wireless and sensor applications at microwave and millimeter-wave frequencies. DRAs are three-dimensional structures with lateral dimensions that can be several times smaller than traditional planar metal "patch" antennas, and which may offer superior performance in terms of radiation efficiency and bandwidth.

DRAs are becoming increasingly important in the design of a wide variety of wireless applications from military to medical usages, from low frequency to very high frequency bands, and from on-chip to large array applications. As compared to other low gain or small metallic structure antennas, DRAs offer higher radiation efficiency (due to the lack of surface wave and conductor losses), larger impedance bandwidth, and compact size. DRAs also offer design flexibility and versatility. Different radiation patterns can be achieved using various geometries or resonance modes and excitation of DRAs can be achieved using a wide variety of feeding structures.

While planar metal patch antennas can easily be produced in various complicated shapes by lithographic processes, DRAs have been mostly limited to simple structures (such as rectangular and circular/cylindrical shapes). Indeed, fabrication difficulties have heretofore limited the wider use of DRAs, especially for high volume commercial applications Fabrication of known DRAs can be particularly challenging as they have traditionally been made of high relative permittivity ceramics. Ceramic-based DRAs can involve a complex fabrication process due in part to their three-dimensional structure. Moreover, ceramics are naturally hard and difficult to machine. Batch fabrication can require diamond cutting tools, which can wear out relatively quickly due to the abrasive nature of the ceramic materials. In addition, ceramics are generally sintered at high temperatures in the range of 900-2000° C., further complicating the fabrication process, limiting the achievable element geometries, and possibly restricting the range of available materials for other elements of the DRA. Array structures can be even more difficult to fabricate due to the requirement of individual element placement and bonding to the substrate. Accordingly, they cannot easily be made using known automated manufacturing processes.

Further problems appear at millimeter-wave frequencies, where the dimensions of the DRA are reduced to the millimeter or sub-millimeter range, and manufacturing tolerances are reduced accordingly. These fabrication difficulties have heretofore limited the wider use of DRAs, especially for high volume commercial applications.

Polymer-based dielectric materials and approaches have been proposed (see, e.g., PCT Publication No. WO2013/016815 and U.S. Provisional Patent Application No. 61/919,254) for fabricating DRAs using deep penetrating lithography methods (for instance deep X-ray lithography) and/or other known microfabrication techniques. This allows for simplified fabrication of arbitrary and complex geometric structures not possible with hard, fired ceramics. However, these materials and approaches tend to be most suitable for realizing low-permittivity DRAs, which could limit the range of potential applications.

Polymer-ceramic composite materials and related microfabrication approaches (see, e.g., U.S. Provisional Patent Application No. 61/842,587) have been developed for maintaining the polymer-based fabrication advantages, while realizing DRAs with more material flexibility, including higher permittivities. The present invention describes an alternative approach to realizing higher permittivity polymer-based DRAs by embedding metal inclusions within the bulk polymer material to enhance the effective permittivity through creation of a type of artificial dielectric material. This material also provides different properties than typical bulk-dielectrics, which can be used to realize antennas with new capabilities and performance characteristics.

SUMMARY

Described herein are microwave and radio frequency (RF) dielectric materials and devices, including antennas, and methods for fabricating the same. In general, the described embodiments relate to dielectric materials containing metal inclusions that increase the effective relative permittivity of the dielectric materials and also provide control over internal electromagnetic fields that are not readily available with traditional materials. Also described are dielectric resonator antennas that employ these dielectric materials.

In a first broad aspect, there is provided an antenna comprising: a substrate with at least a first planar surface; a resonator body having a bulk resonator body material; and an excitation structure for exciting the resonator body, wherein the resonator body comprises a plurality of metal inclusions extending at least partially, and preferably substantially, through the resonator body. In some cases, the plurality of metal inclusions are provided in a regular pattern to increase an effective electrical permittivity of the resonator body.

In some embodiments, the plurality of metal inclusions are provided in a pattern that modifies the electromagnetic fields internal to the resonator body.

In some embodiments, the plurality of metal inclusions are provided in a pattern that increases an effective electrical permittivity of the resonator body.

In some embodiments, the plurality of metal inclusions are provided in a pattern that causes different electromagnetic fields in the resonator body when excited from different directions.

In some embodiments, the plurality of metal inclusions are provided in a pattern that creates a different effective electrical permittivity in different orientations through the resonator body.

In some embodiments, the plurality of metal inclusions are provided in a pattern that causes a plurality of resonance modes in the resonator body.

In some embodiments, the excitation structure comprises at least two feedlines to excite the resonator body. In some cases, at least two of the feedlines are mutually orthogonal.

In some embodiments, the resonator body radiates different polarizations from the resonator body based on excitation orientation.

In some embodiments, the bulk resonator body material is a dielectric material. For example, the dielectric material may be a polymer (e.g., a photoresist polymer), a ceramic or a polymer-ceramic composite. In some cases, the dielectric material is air. In some cases, the polymer is a resist polymer that is sensitive to at least one of visible light, ultra-violet radiation, extreme ultra-violet radiation, X-ray radiation, electrons, and ions.

In some embodiments, each of the plurality of metal inclusions has a generally H-shaped cross-section; a generally window-shaped cross-section; a generally hexagonal cross-section; a generally square-shaped cross-section; a generally rectangular-shaped cross-section; a generally triangular-shaped cross-section; a complicated box cross-section; or a cross-section of arbitrary geometry. In some embodiments, the metal inclusions are arranged in a honeycomb pattern.

In some embodiments, the thickness of the resonator body is between 50 and 5000 microns.

In some embodiments, the resonator body is formed of a single material layer. In other embodiments, the resonator body is formed of multiple material layers.

In some embodiments, each of the plurality of metal inclusions has a height that is between 2-100% of the thickness of the resonator body.

In some embodiments, the plurality of metal inclusions are printed beneath the resonator body.

In some embodiments, each of the plurality of metal inclusions has a cross section size smaller than one-fifth of an operating signal wavelength in the bulk resonator body material.

In some embodiments, each of the plurality of metal inclusions has a pattern spacing smaller than one-fifth of the operating signal wavelength in the bulk resonator body material.

In some embodiments, the plurality of metal inclusions comprises a first plurality of metal inclusions and at least a second plurality of metal inclusions, wherein a first size of each of the first plurality of metal inclusions is different than a second size of each of the second plurality of metal inclusions. In some embodiments, the first size is larger than the second size. In some embodiments, a first pattern spacing of the first plurality of metal inclusions is different than a second pattern spacing of the second plurality of metal inclusions.

In some embodiments, the bulk resonator body material is a variable electrical permittivity material. In some embodiments, the variable electrical permittivity material is a liquid crystal polymer. In some embodiments, the antenna further comprises a biasing circuit for tuning the variable electrical permittivity material. In some embodiments, the variable electrical permittivity material layer is placed underneath the bulk resonator body material. The effective permittivity tuning range can be increased by the plurality of metal inclusions.

In some embodiments, the resonator body has a cross-section that is rectangular; elliptical; circular; or fractal shaped.

In some embodiments, the antenna comprises at least one additional resonator body, wherein the at least one additional resonator body is generally analogous to the resonator body, and wherein the at least one additional resonator body is provided in an array configuration. In some embodiments, the at least one additional resonator body is integrally formed with the resonator body as a monolithic structure.

In another broad aspect, there is provided an artificial dielectric material comprising: a substrate with at least a first planar surface; and a body having a dielectric bulk body material, wherein the resonator body comprises a plurality of metal inclusions extending at least partially, and preferably substantially, through the resonator body.

In some embodiments, the plurality of metal inclusions are provided in a pattern to modify the electromagnetic fields internal to the bulk body.

In some embodiments, the plurality of metal inclusions are provided in a pattern that increases an effective electrical permittivity of the bulk body.

In some embodiments, the plurality of metal inclusions are provided in a pattern that causes different electromagnetic fields in the bulk body when excited from different orientations.

In some embodiments, the bulk body has a different effective electrical permittivity depending on the orientation through the bulk body.

In another broad aspect, there is provided a method of fabricating an antenna, the method comprising: forming a substrate with at least a first planar surface; depositing and patterning an excitation structure on the substrate; forming a resonator body having a bulk resonator body material on the first planar surface of the substrate; forming a plurality of cavities in the bulk resonator body material, the plurality of cavities extending substantially through the resonator body; and depositing a plurality of metal inclusions in the respective plurality of cavities. In some cases, forming the plurality of cavities comprises exposing the resonator body to a lithographic source via a pattern mask, wherein the pattern mask defines the plurality of cavities to be formed in the resonator body; and developing at least one exposed portion of the resonator body and removing the at least one exposed portion to reveal the plurality of cavities. In some cases, forming the plurality of cavities comprises exposing the resonator body to a beam patterning source to define the plurality of cavities to be formed in the resonator body; and developing at least one exposed portion of the resonator body and removing the at least one exposed portion to reveal the plurality of cavities.

In some cases, the resonator body is removed following deposition of the plurality of metal inclusions.

DRAWINGS

For a better understanding of the embodiments described herein and to show more clearly how they may be carried into effect, reference will now be made, by way of example only, to the accompanying drawings which show at least one exemplary embodiment, and in which.

Figure 1B:
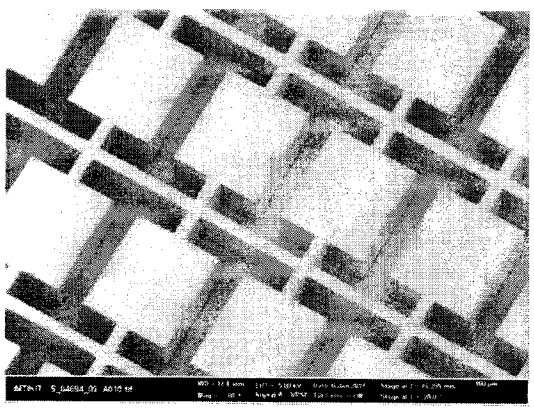
FIG. 1B is a perspective view scanning electron microscope image of the example meta-DRA of FIG. 1A, showing metal inclusions filled to a portion of the height of the resonator body.

The skilled person in the art will understand that the drawings, described below, are for illustration purposes only. It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

The use of polymer-based materials can dramatically simplify fabrication of dielectric resonator antenna elements and arrays, and may facilitate greater use of this class of antennas in commercial applications.

Described herein are compact radio frequency (RF) antennas and devices using non-traditional polymer-based materials, and methods for fabricating the same. The described compact RF antennas enable improved performance and increased functionality for various emerging wireless communication and sensor devices (e.g., miniature radios/transmitters, personal/wearable/embedded wireless devices, etc.), automotive radar systems, small satellites, RFID, sensors and sensor array networks, and bio-compatible wireless devices and biosensors). In particular, these polymer-based antenna devices may be referred to as polymer or polymer-based resonator antennas (PRAs).

Currently, one of the biggest obstacles to the continued miniaturization of RF wireless devices is antenna structure, which accounts for a large portion of total device sizes. Recently, ceramic-based dielectric resonator antennas have attracted increased attention for miniaturized wireless and sensor applications at microwave and millimeter-wave frequencies. DRAs are three-dimensional structures with lateral dimensions that can be several times smaller than traditional antennas, and which may offer superior performance. Despite the superior properties of ceramic-based DRAs, they have not been widely adopted for commercial wireless applications due to the complex fabrication processes related to their three-dimensional structure and difficulties in fabricating and shaping the hard ceramic materials.

In contrast, the polymer-based DRAs described herein facilitate easier fabrication, while retaining many of the benefits of ceramic-based DRAs. In particular, the natural softness of polymers can dramatically simplify fabrication of dielectric elements, for example by enabling the use of lithographic batch fabrication or other 3D printing or micromachining processes. However, polymer-based DRAs must be effectively excited to resonate and radiate at microwave and millimeter-wave frequencies.

The use of polymer-based materials can dramatically simplify fabrication, due to the natural softness of these materials. In some cases, pure photoresist polymers may be used for direct lithographic exposure, or other pure-polymer materials printed or micromachined to fabricate DRAs.

Although polymer-based DRAs enjoy fabrication advantages, among others, over ceramic-based DRAs, they may be limited in certain applications requiring higher permittivity material characteristics, and may be more difficult to feed effectively than higher permittivity materials.

Previous approaches to alter the material properties in polymer-based DRAs have included mixing polymer materials with various fillers to produce composite materials (as described, e.g., in U.S. Provisional Patent Application No. 61/842,587). If properly mixed, engineered composite materials may offer the desired performance. Electrical permittivity can generally be increased by mixing ceramic micro- and nano-sized particles (for instance, aluminum oxide, barium titanate oxide, zirconium oxide, etc.) with the polymer materials. Composite materials with other properties could also be used, such as self-powering composites, ferroelectric composites, and ferromagnetic composites.

Self-powering composites are materials that are able to convert solar energy to electricity and thereby provide electricity for use by the microwave circuit. Examples of materials in this class include carbon nanotubes and CdS nanorods or nanowires.

Ferroelectric composites are materials that can change antenna properties in response to an applied (e.g., DC) voltage, and thereby introduce flexibility in the design and operation of a microwave circuit. An example of such a material is BST (barium strontium titanate), which is a type of ceramic material.

Ferromagnetic composites are similar to ferroelectric materials, except that they generally change antenna properties in response to applied magnetic fields. Examples of such materials include polymer-metal (iron and nickel) nanocomposites.

Although composite polymer-based DRAs may achieve desired performance characteristics, the use of exotic materials may impose fabrication constraints.

The embodiments described herein generally provide an artificial dielectric material, or "meta-material", approach for improving the performance characteristics of low permittivity DRAs (though the technique is not limited to low permittivity materials)—such as those made of pure polymers, polymer composites, photoresist/photosensitive polymers, and photoresist/photosensitive polymer composites—by incorporating metal inclusions inside the low permittivity bulk material body. The material body can generally be formed using various lithographic, jet printing, screen printing, injection molding, or other polymer-based microfabrication techniques. The metal inclusions can generally be realized inside of cavities patterned inside of the polymer-based bulk material, using for instance known metal electroforming techniques for plating of metals (nickel, copper, gold, etc.) commonly used in lithographic and other microfabrication techniques. Such photoresist and/or photosensitive polymers can be used in combination with a lithographic fabrication process to realize antenna structures with precise features. In particular, known photolithographic techniques have evolved to enable fabrication of passive devices with small features.

Accordingly, the described embodiments retain the ease of fabrication associated with a polymer microfabrication approach. It should be noted, however, that the described embodiments may also be used in conjunction with composite polymer materials or other suitable dielectric materials if desired.

Figure 1A:
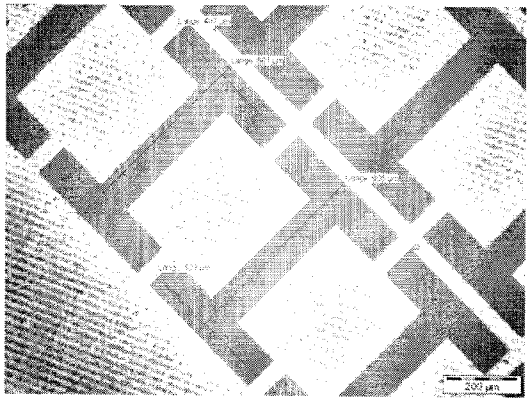
FIG. 1A is a top view optical microscope image of an example meta-material DRA (meta-DRA) showing lateral dimensional measurements of embedded metal inclusion geometries.
Figure 1C:
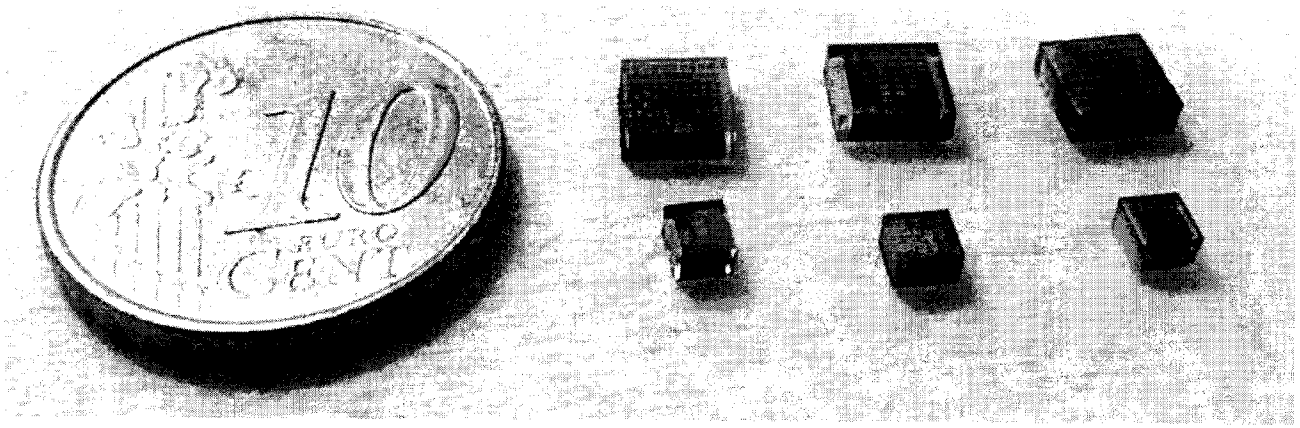
FIG. 1C is a photograph of several example meta-DRAB operating in the range of 15 GHz to 35 GHz.

Referring now to FIGS. 1A to 1C, there are illustrated example images of lithographically fabricated meta-DRAs in thick polymer material (nominal 1.5 mm, in polymethylmethacrylate (PMMA)) obtained using microscopy and photography. FIG. 1A is a top view image of a meta-DRA showing embedded metal inclusions (nickel) obtained using an optical microscope. The inclusions are accurately formed and have nominal lateral dimensions of 600×400 μm. FIG. 1B is a scanning electron micrograph of the same structure showing metal inclusions filled to a portion of the height of the resonator body (in the case, approximately two-thirds of the height).

FIG. 1C is a photograph of several fabricated meta-DRAs, which operate in the range of 15 GHz to 35 GHz, shown next to a European 10 cent coin, for size comparison purposes.

In some embodiments, X-ray lithography may be a suitable fabrication technique to enable the patterning of tall structures in thick materials with suitable precision and batch fabrication ability.

X-ray lithography is a technique that can utilize synchrotron radiation to fabricate three-dimensional structures. Structures can be fabricated with a height up to a few millimeters (e.g., typically a maximum of 3 to 4 mm with current techniques) and with minimum lateral structural features (i.e., layout patterns) in the micrometer or submicrometer range. As compared to other fabrication techniques such as UV lithography, X-ray lithography can produce much taller structures (up to several millimeters) with better sidewall verticality and finer features.

X-ray lithography may also be used to fabricate tall metallic structures (e.g., capacitors, filters, transmission lines, cavity resonators, and couplers, etc.) and therefore can allow for the fabrication of integrated PRA circuits (e.g., array structures, feeding networks, and other microwave components) and, in the present embodiments, tall metal inclusions on a common substrate.

X-ray lithography can use more energetic and higher frequency radiation than more traditional optical lithography, to produce very tall structures with minimum dimension sizes smaller than one micron. X-ray lithography fabrication comprises a step of coating a photoresist material on a substrate, exposing the synchrotron radiation through a mask, and developing the material using a suitable solvent or developer.

X-ray lithography can also be an initial phase of the so-called LIGA process, where LIGA is the German acronym for Lithographie, Galvanoformung, and Abformung (lithography, electrodeposition, and moulding). A LIGA process may further comprise electroforming of metals and moulding of plastics, which is not strictly required to produce dielectric structures. Metal electroforming can be used to realize the metal inclusions inside the polymer or polymer-composite bulk material body, which acts as an electroforming template.

X-ray lithography fabrication can be modified and optimized for different materials and structural requirements. Materials used in X-ray lithography fabrication can be selected to satisfy both lithographic properties required for the X-ray lithographic fabrication itself, and the resultant electrical properties of the fabricated antenna.

In particular, the electrical characteristics to be selected for a suitable material include relative permittivity and dielectric loss. In dielectric antenna applications, materials can be selected to have a low dielectric loss (e.g., a loss tangent up to about 0.05, or possibly lower depending on application). For example, values less than about 0.02 for the loss tangent can result in greater than 90% radiation efficiency for an antenna.

Suitable polymer-based materials for X-ray lithography microfabrication can be selected so that the deposition process is simplified, and to exhibit sensitivity to X-rays in order to facilitate patterning. Accordingly, in some embodiments, pure photoresist materials are used. In some other embodiments, photoresist composites may also be used.

Examples of photoresist materials suitable for X-ray lithography include polymethylmethacrylate (PMMA) and Epon SU-8.

PMMA is a positive one-component resist commonly used in electron beam and X-ray lithography. It may exhibit relatively poor sensitivity, thus requiring high exposure doses to be patterned. However, the selectivity (i.e., contrast) achievable with specific developers can be very high, resulting in excellent structure quality. Very thick PMMA layers are sometimes coated on a substrate by gluing. However, patterning thick layers may require very hard X-rays and special adjustments for beamline mirrors and filters.

Figure 2A:
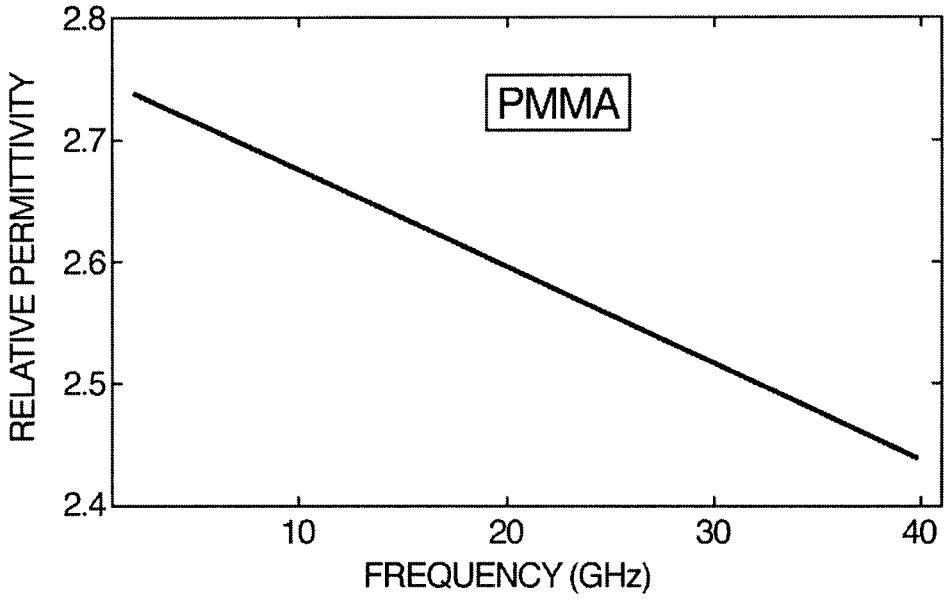
FIGS. 2A and 2B are exemplary plots of the relative permittivity and dielectric loss tangent for pure PMMA, as a function of frequency.
Figure 2B:
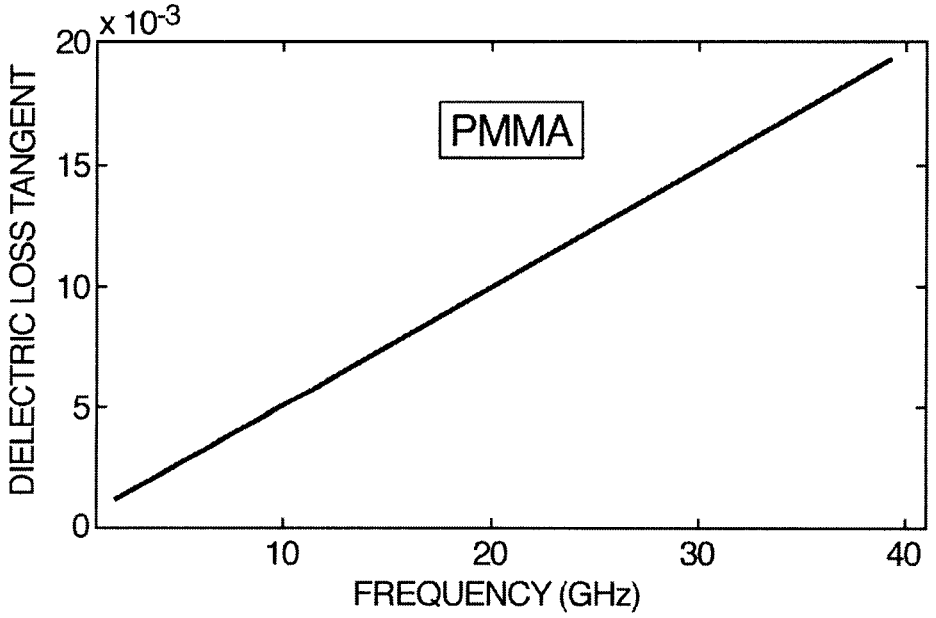

Referring now to FIGS. 2A and 2B, there are shown plots of the relative permittivity and dielectric loss tangent for pure PMMA, as a function of frequency. These electrical properties of PMMA were measured using the two-layer microstrip ring resonator technique. At 10 GHz, the relative permittivity and dielectric loss tangent were measured to be 2.65 and 0.005, respectively. The relative permittivity decreases with increased frequency, reaching 2.45 at 40 GHz. In contrast, the dielectric loss tangent increases with increased frequency, reaching 0.02 at 40 GHz.

Previously, the low relative permittivity of pure PMMA may have made it less suitable for some conventional dielectric resonator antenna applications.

Epon SU-8 is a negative three-component resist suitable for ultraviolet and X-ray lithography. SU-8 exhibits maximum sensitivity to wavelengths between 350-400 nm. However, the use of chemical amplification allows for very low exposure doses. Accordingly, SU-8 may also be used with other wavelengths, including X-ray wavelengths between 0.01-10 nm.

The high viscosity of SU-8 allows for very thick layers to be cast or spin coated in multiple steps. However, side effects such as T-topping may result in defects such as unwanted dose contributions at the resist top, stress induced by shrinking during crosslinking, and incompatibility with electroplating.

Various values for the dielectric properties of SU-8 have been reported in the known art. For example, the dielectric constant of SU-8 has been reported as between 2.8 and 4. The variation in these reported electrical properties may be due to several factors, including use of different commercial types of SU-8 (e.g. SU-8(5), SU-8(10), SU-8(100), etc.), pre-bake and post-bake conditions (e.g. time and temperature), and exposure dose. Accordingly, the use of SU-8 may require careful characterization of the electrical properties for a particular selected type of SU-8 and corresponding adjustment of fabrication steps.

Figure 2C:
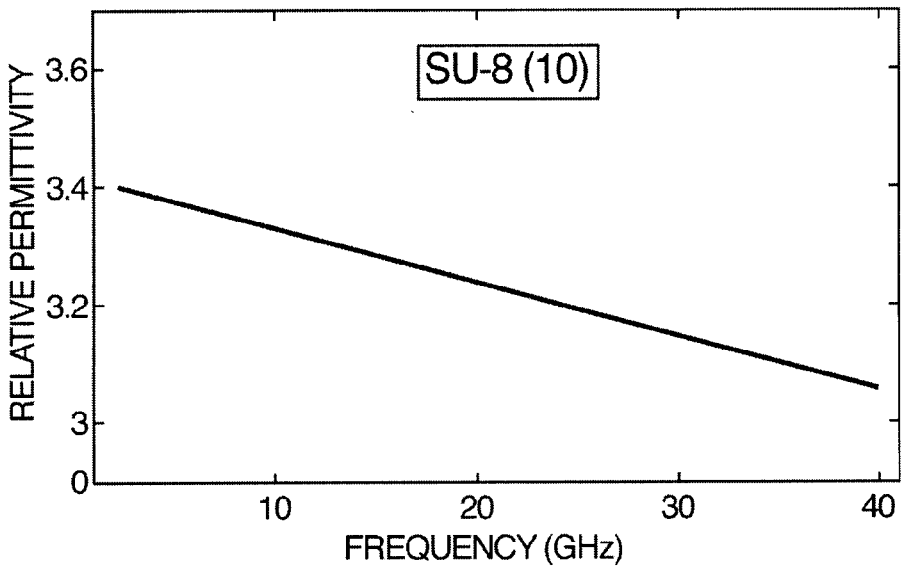
FIGS. 2C and 2D are exemplary plots of the relative permittivity and dielectric loss tangent for SU-8, as a function of frequency.
Figure 2D:
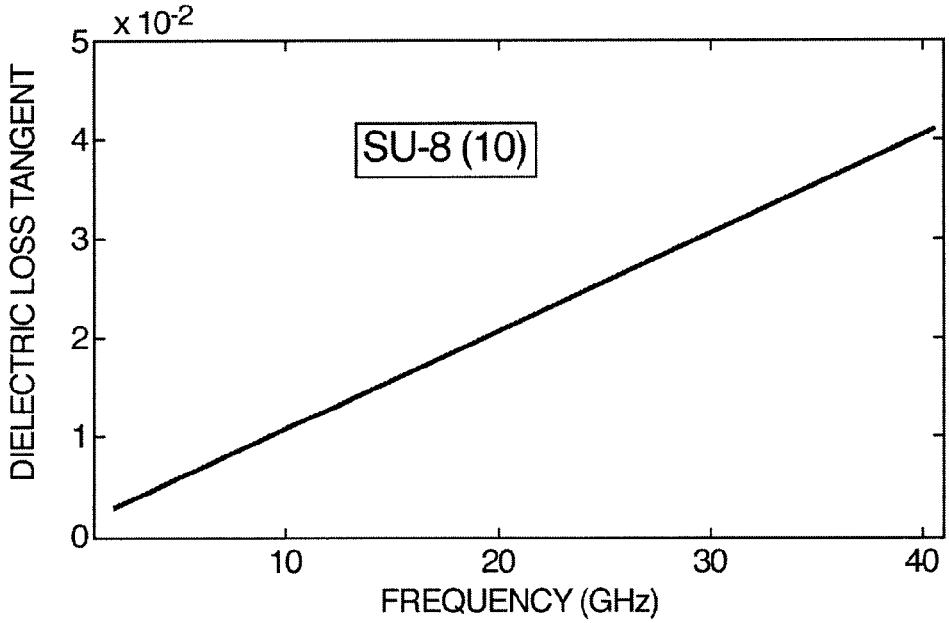

Referring now to FIGS. 2C and 2D, there are shown plots of the relative permittivity and dielectric loss tangent for SU-8, as a function of frequency. These electrical properties of SU-8 were independently measured using the two-layer microstrip ring resonator technique. At 10 GHz, the relative permittivity and dielectric loss tangent were measured to be 3.3 and 0.012, respectively. The relative permittivity decreases with increased frequency, reaching 3.1 at 40 GHz. In contrast, the dielectric loss tangent increases with increased frequency, reaching 0.04 at 40 GHz.

As described herein, pure photoresist materials were previously considered less than optimal for conventional microwave and antenna applications. Attempts to improve their electrical properties included the creation of composites, such as by adding ceramic powders and micropowders (see, e.g., U.S. Provisional Patent Application No. 61/842,587) to low viscosity photoresist materials, to enhance desired properties in millimeter-wave and microwave wavelengths. Other fillers contemplated include carbon nanotubes and CdS nanowires, active ferroelectric materials, and high relative permittivity ceramics, which can be selected to form materials with desired properties, such as enhanced tunability or self-powering ability. The resulting photoresist composite materials can provide a broader group of viable materials suitable for dielectric antenna applications. However, the use of such composites may alter photoresist properties, requiring adjustment of lithographic processing, or additional steps in the fabrication process, which may be undesirable in some cases.

Examples of such photoresist composite materials include a PMMA composite incorporating alumina micropowder, and a SU-8 composite also incorporating alumina micropowder. Various other composites can be used, which may incorporate other base photoresist materials or other electrical property enhancing fillers. The photoresist materials and electrical property enhancing fillers can be combined in various ratios, depending on the desired electrical properties and fabrication process.

Provided herein is an alternative approach to improve the antenna performance of polymer-based materials, while remaining suitable for lithographic batch fabrication (or other suitable microfabrication) of polymer-based (or other low permittivity) dielectric resonator antennas. In particular, the described approach can avoid adding ceramic powders to the polymer base. This is attractive from a fabrication perspective, since it supports lithographic fabrication in commercially-available pure photoresist materials directly, rather than requiring custom lithographic fabrication development supporting non-standard materials. In some embodiments, the described approach may also support fabrication using other pure non-resist polymers through non-direct lithographic methods such as injection and/or moulding techniques using frames and/or templates (or other polymer-based 3D jet printing, screen printing, or similar precision micromachining processes).

Generally, the described approach involves creating artificial dielectric material-based resonator antennas by incorporating within a primary resonator body material one or more inclusions made of at least a second material. For example, many of the described embodiments incorporate a distribution of "tall" metal inclusions in the polymer layers of a resonator body using this "meta-material" approach. Meta-material based PRAs, which have metallic (or other) inclusions embedded within a polymer body, are referred to herein as "meta-PRAs" or in some instances as "meta-DRAs". Meta-materials are structures engineered to exhibit controlled electromagnetic properties, which properties may be difficult to attain in nature. In some cases, the primary resonator body material may be something other than a polymer. In general, the resonator body material could be any dielectric material, which can be modified to provide cavities, and which can be filled with metal. For example, a ceramic-based resonator may also be provided with metallic or other inclusions, to create a ceramic-based meta-material, although this may require fabrication techniques other than lithography. In some cases, the primary body material may be removed after formation of the embedded metal inclusions, which effectively provides an air dielectric around free-standing metal structures (inclusions).

In common applications of electroplating with photoresist templates, a polymer template or frame is removed following the formation of the metal body. However, in at least some of the embodiments described herein, the polymer or polymer-based template (e.g., photoresist) can be retained following electroplating to act as functional dielectric material encompassing the metal inclusions.

For example, a polymer-based photoresist can be cast or formed (multiple times, if necessary) and baked at temperatures below 250° C. (e.g., 95° C.). In some alternative embodiments, photoresist may be formed by, for example, bonding or gluing a plurality of pre-cast polymer-based material sheets. Next narrow gaps or apertures can be patterned using an X-ray or ultra-deep UV exposure and developed, typically at room temperature. The entire thickness can be patterned in a single exposure, or thinner layers patterned in successive multiple exposures, depending on the lithography technique and the penetration ability. Finally, the resultant gap can subsequently be filled with metal (via electroplating or otherwise), up to a desired height, to produce the embedded metal inclusion.

Notably, these fabrication processes can typically be carried out at relatively low temperatures and without sintering.

In some cases, when using metal electroplating, a metal seed layer under the thick polymer layer is used as a plating base to initiate the electroplating process. Electroplating of microstructures has been demonstrated in the LIGA process for complicated structures with heights of several millimeters. In some cases, this metal seed layer can be removed following electroplating to electrically isolate the individual metal inclusions.

In some other cases, the resonator body, the metal structures, or both, can be formed by printing on the planar surface of the substrate.

The ability to fabricate complex shapes in PRAs allows for the resonator body and other elements to be shaped according to need. For example, the lateral cross-sectional shapes of the PRA elements can be square, rectangular, circular, elliptical or have arbitrary lateral geometries, including fractal shapes. Accordingly, the resonator body may have three dimensional structures corresponding to a cube (for a square lateral geometry), a cylinder (for a circular lateral geometry), etc.

Accordingly, PRA elements can be fabricated in thick polymer or polymer-composite layers, up to several millimeters in thickness, using deep penetrating lithographic techniques, such as thick resist UV lithography or deep X-ray lithography (XRL). In some alternate embodiments, other 3D printing or micromachining processes may be used.

Various fabrication methods may also be employed, including direct fabrication, or by injecting dielectric materials into lithographically fabricated frames or templates formed of photoresist materials. The use of such frames enables the use of complicated shapes with a wide range of dielectric materials that might otherwise be very difficult to produce using other fabrication techniques.

Existing work in meta-materials has generally focused on negative refractive index materials and their applications. Meta-materials can be found in microwave and antenna structures (e.g., close reflectors for dipoles, coating shells to enhance small monopoles, and numerous meta-material loaded patch antennas, etc.). However, meta-materials have not been used directly as dielectric resonator antennas.

Maxwell's equations demonstrate that the value of the effective permittivity of a medium, ε, can be tailored by controlling the degree of polarization, $$P\left(\varepsilon = 1 + \frac{P}{\varepsilon_0 E}\right).$$

Accordingly, the effective permittivity of a bulk base material can be significantly enhanced (by a factor of 5 times or even more) by providing a meta-material comprising a distribution of strongly coupled, small metallic inclusions. This increased effective permittivity results from the high polarity of the metallic inclusions.

The maximum lateral size of the inclusions can be selected, for example, to be on the order of $$\frac{\lambda_0}{10},$$

where $\lambda_0$ is the operating wavelength in the bulk dielectric material, so that the inclusions do not self-resonate at the operating frequency. Additional details concerning the sizing and spacing of the inclusions in example embodiments is described elsewhere herein.

The resulting meta-material DRAs typically exhibit broadband performance, low-loss and high-gain, making them excellent candidates for wireless applications. The low-loss properties of the meta-DRAs are partly due to extremely smooth sidewalls of the metallic inclusions (in the order of nanometers). In addition, low permittivity polymers with medium loss tangent characteristics result in low values for ε", making highly efficient dielectric antennas, in general. The higher gain characteristics (about 1-2 dB) are mostly because of the special new mode excitation inside the resonator body.

Several examples of bulk meta-materials with controlled permittivity and electromagnetic field characteristics are described herein, for DRA and other dielectric applications. These can be used to increase the effective permittivity of bulk polymer materials using metallization methods for embedding metal inclusions inside the polymer materials. The described approaches allow standard lithographic processes to be used to fabricate relatively high permittivity materials, thus facilitating the widespread use of polymers as radiating materials. Previous attempts to use polymers, and photoresistive/photosensitive polymers in particular, were limited somewhat by the low permittivity of the polymers.

Moreover, the cross-sectional shape, spacing, arrangement and number of embedded metal inclusions can be determined and controlled, to allow for a broad range of effective relative permittivity values for the meta-material. For example, the cross-sectional shape of the inclusions may be rectangular (including square), elliptical (including circular), triangular, hexagonal, "H"-shaped, various "cross" shapes, or any arbitrary geometry. The inclusions may be distributed with respect to each other in an arbitrary fashion, arranged in uniform or non-uniform grids or patterns, or arranged in one or several separate groupings.

Additionally, the artificial dielectric materials presented have special properties not generally found in bulk dielectric materials. For instance they can be realized using inclusions with non-symmetric shapes, and can be configured to act as anisotropic materials, having non-uniform permittivity when excited in different orientations (effectively, anisotropic permittivity materials). They can also support internal electromagnetic field patterns representing new resonant modes not generally seen in DRAs made of typical bulk materials. Some electric (E) and magnetic (H) field patterns describing two of these new modes are shown in FIGS. 3A to 3D, for typical meta-DRAs having H-shaped metal inclusion shapes and patterns similar to those shown in FIGS. 4B and 4D.

Figure 3A:
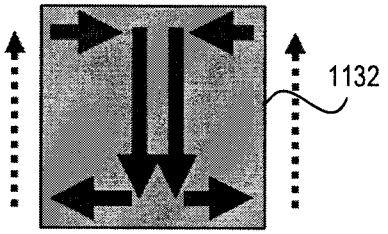
FIGS. 3A and 3B are schematic representations of first mode and second mode electric field patterns, respectively, in a typical meta-DRA with H-shaped metal inclusion profile.
Figure 3B:
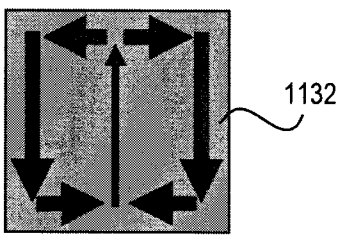
Figure 3C:
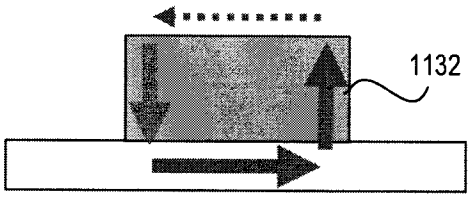
FIGS. 3C and 3D are schematic representations of first mode and second mode magnetic field patterns, respectively, in a typical meta-DRA with H-shaped metal inclusion profile.
Figure 3D:
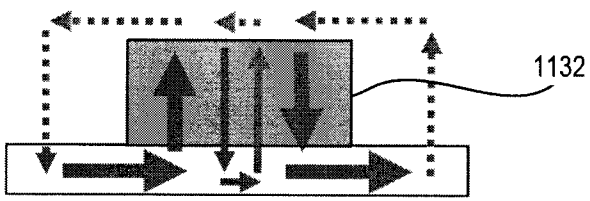
Figure 4A:
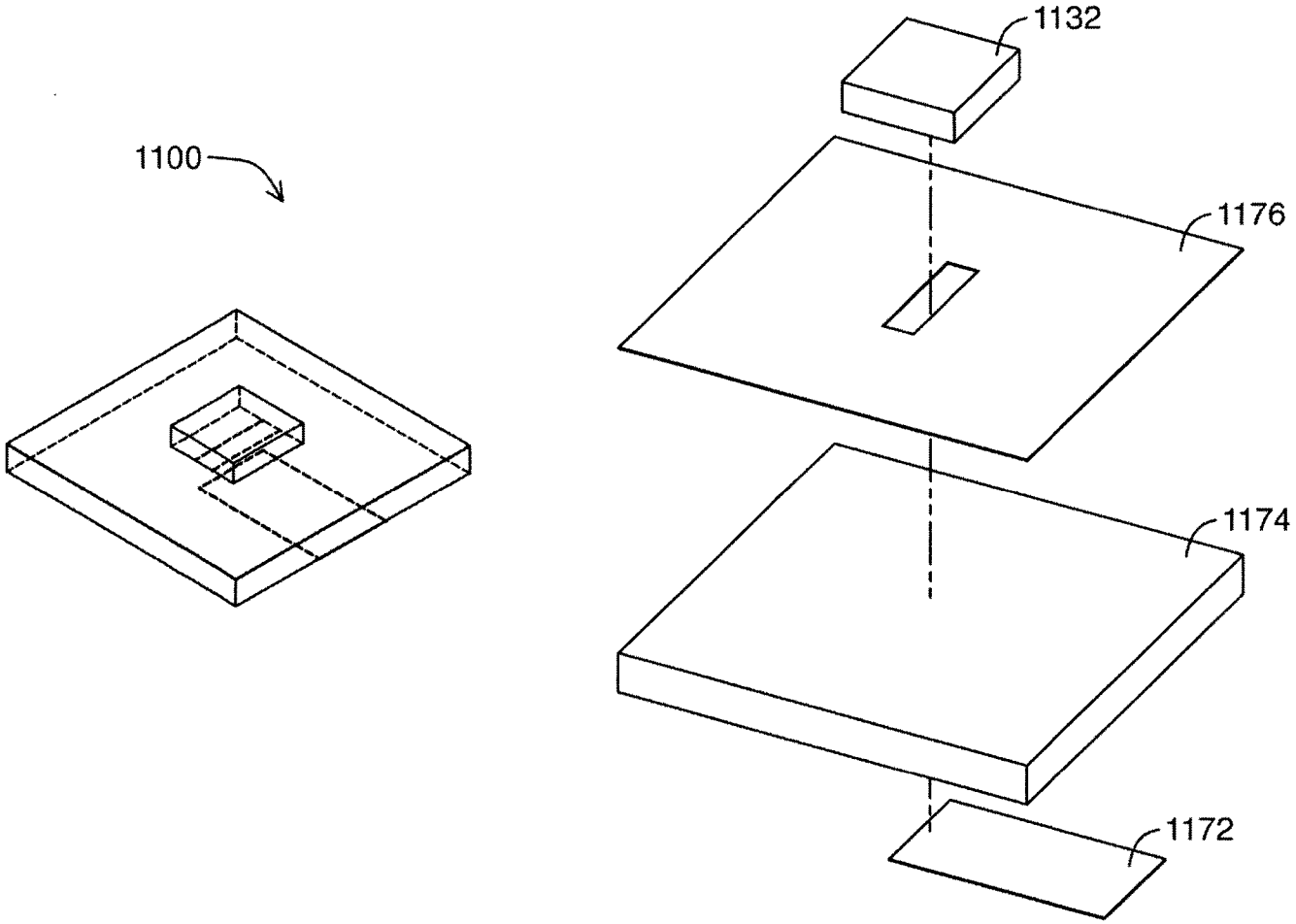
FIG. 4A is an exploded perspective view of an example resonator body containing embedded metal inclusions.
Figure 4B:
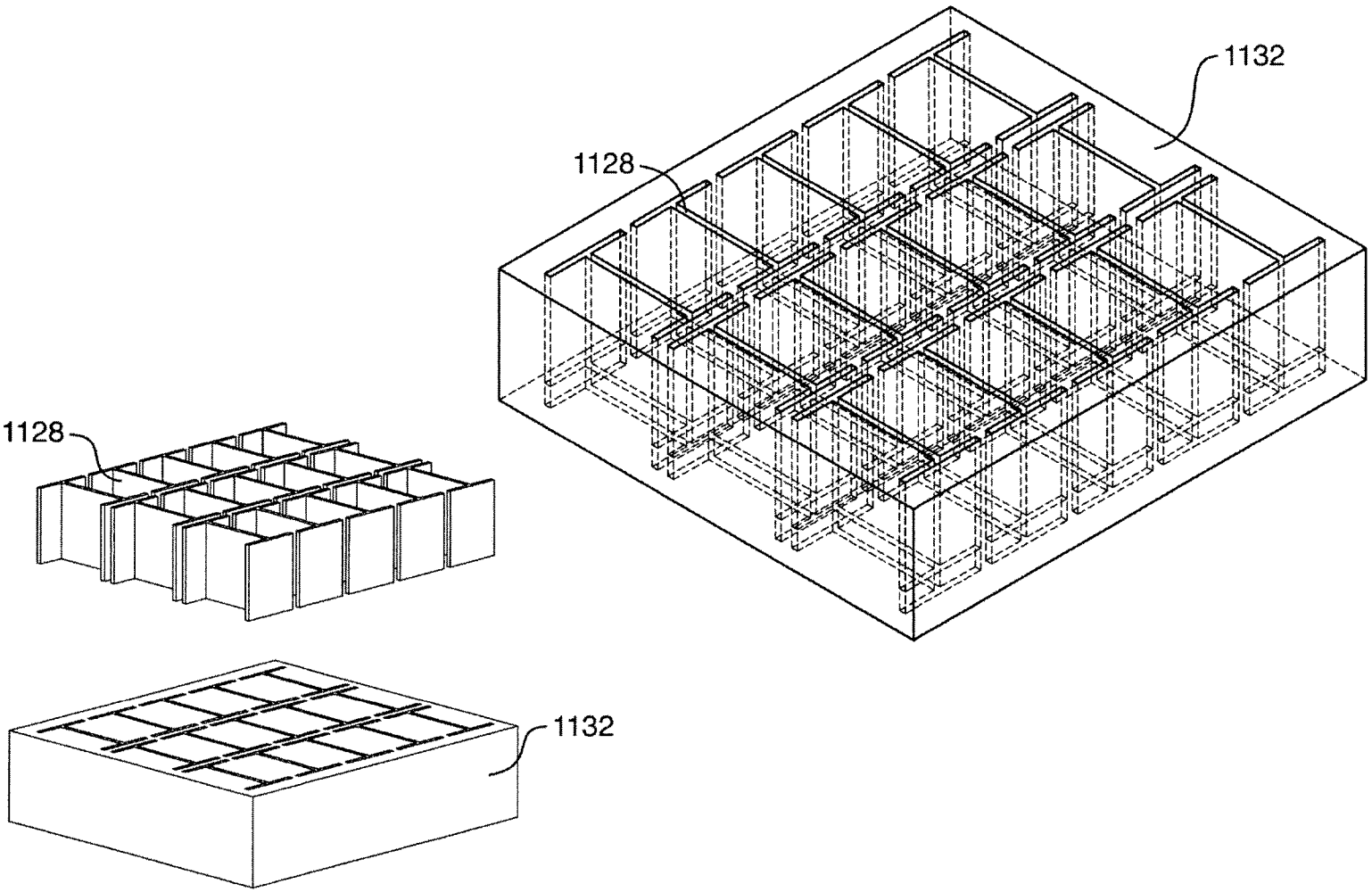
FIG. 4B is a view of another example polymer-based meta-material DRA (meta-PRA) with an embedded distribution of metal inclusions, arranged in a regular grid pattern.
Figure 4C:
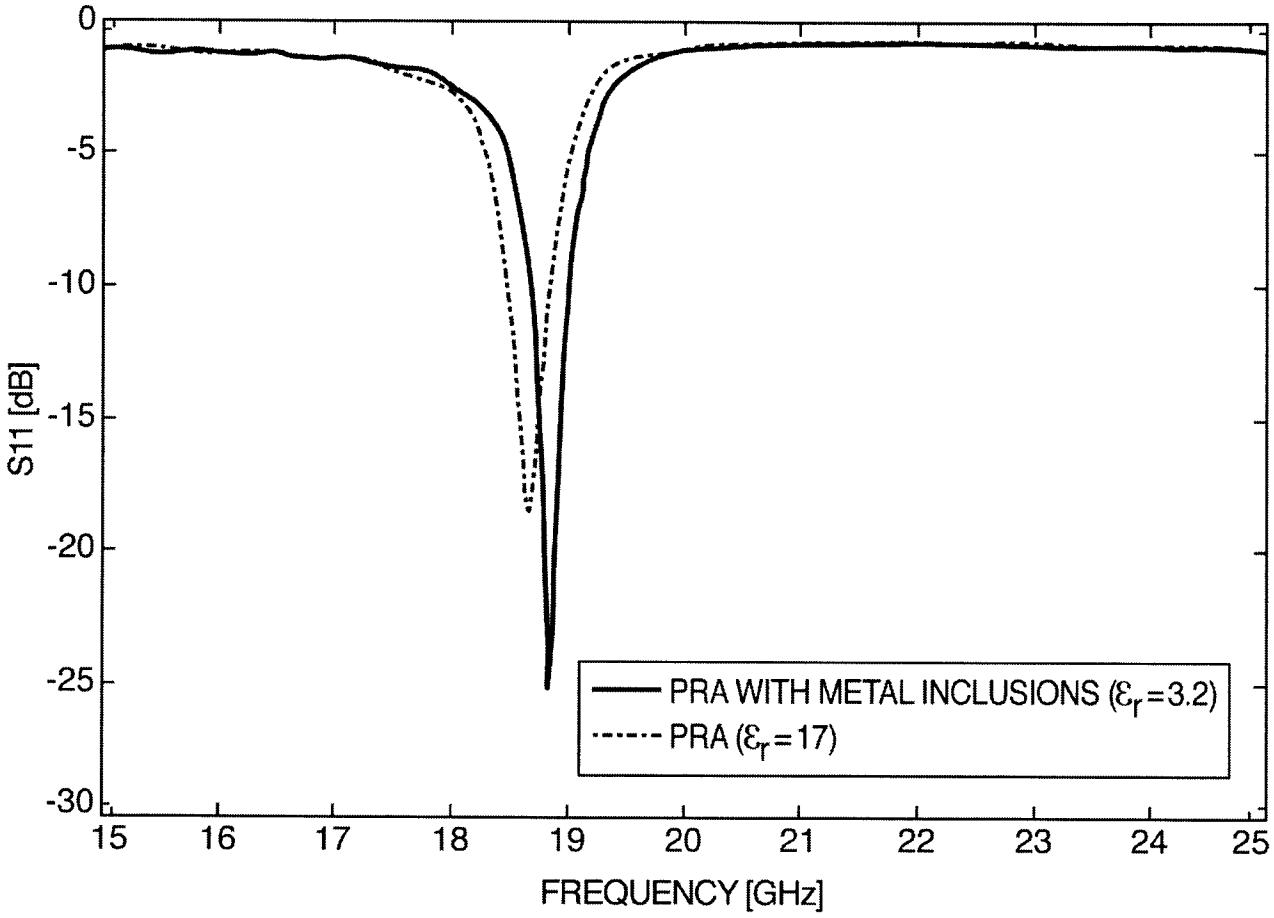
FIG. 4C is a plot of the reflection coefficient of the meta-PRA of FIG. 4B.
Figure 4D:
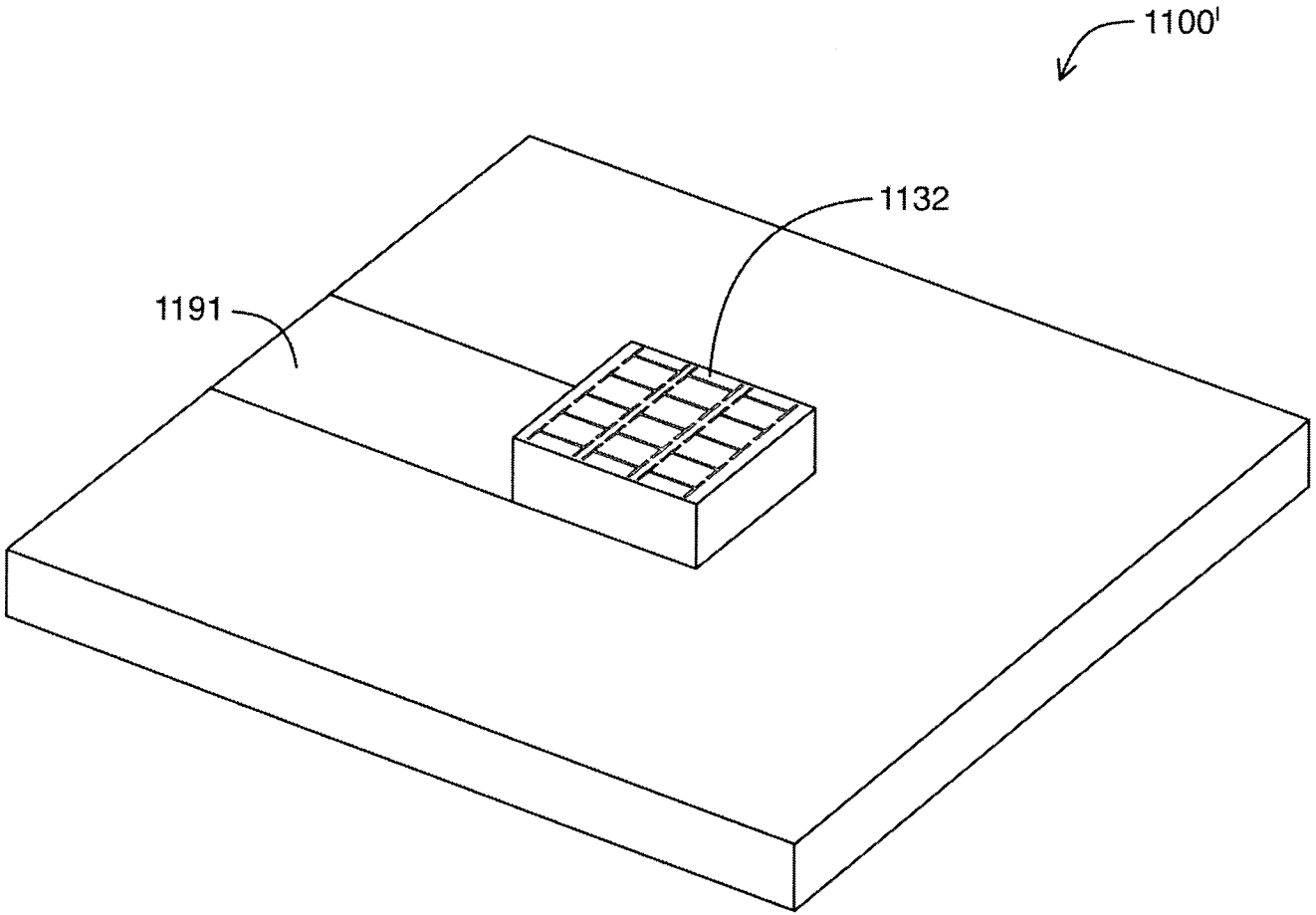
FIG. 4D is a perspective view of another example meta-PRA with a resonator body comprising a distribution of H-shaped embedded metal inclusions.

Referring now to FIGS. 3A to 3D, FIGS. 3A and 3B illustrate first mode and second mode electric field patterns, respectively, in a meta-DRA having H-shaped metal inclusion shapes in a pattern such as that illustrated in FIGS. 4B and 4D. Similarly, FIGS. 3C and 3D illustrate first mode and second mode magnetic field patterns, respectively, in a meta-DRA having H-shaped metal inclusion shapes in a pattern such as that illustrated in FIGS. 4B and 4D.

The fields can be excited in different orientations to radiate effectively with different antenna polarizations. They can also be fed simultaneously by ports in different orientations, to simultaneously realize dual (or generally multichannel) transmit and/or receive functions and perform diplexer and/or ortho-mode transducer functionality. Several of these interesting properties are demonstrated in the example embodiments described herein, and are potentially advantageous in various applications.

To validate the described meta-materials approach, various dielectric resonator antennas with a low-permittivity base material were designed and simulated. In some cases, the antennas were fabricated and physically tested. The example DRAs had resonator bodies embedded with various types, shapes, sizes, and distributions of metal inclusions.

Referring now to FIG. 4A, there is illustrated an example meta-PRA in accordance with some embodiments. Meta-PRA 1100 has a resonator body 1132, which has an excitation structure using a slot-feed configuration. Meta-PRA 1100 further comprises a substrate 1174, a metal ground plane 1176 and a microstrip feed 1172.

Resonator body 1132 is provided on metal ground plane 1176, which is itself positioned on substrate 1174. Resonator body 1132 can be formed of a dielectric bulk resonator body material, such as a polymer or polymer-based material as described herein. In the illustrated example, resonator body 1132 has a square or rectangular topology. In other embodiments, different shapes can be used, such as circular, elliptical, fractal, or other complex shapes.

Microstrip feed 1172 is provided on substrate 1174, opposite ground plane 1176 and resonator body 1132. In the illustrated example, substrate 1174 and ground plane 1176 have lateral dimensions of 8 mm×8 mm. Ground plane 1176 has a 0.6 mm×2.4 mm coupling slot provided facing resonator body 1132.

In one specific example, resonator body 1132 is formed of a SU-8 polymer material and has lateral dimensions of 2.2 mm×2.4 mm, with a height of 0.6 mm. H-shaped embedded metal inclusions 1128 have lateral dimensions of 0.6 mm×0.4 mm, and a height of 0.5 mm. The lateral thickness of and spacing between metal inclusions 1128 is 0.05 mm.

Substrate 1174 may be formed of a microwave or millimeter-wave substrate material.

Depending on the fabrication process used, substrate 1174 may be, for example, a layer of alumina, glass, or silicon that may be doped in accordance with the process requirements. It can also be the final functional substrate, or can be a sacrificial substrate whereby the meta-PRA is removed during the fabrication process sequence and attached to a separate functional substrate.

Referring now to FIG. 4B, there is shown an exploded isometric view of resonator body 1132, illustrating in further detail a distribution of embedded metal inclusions, in this case in a regular grid pattern.

Vertical metal inclusions 1128 are fabricated using lithographic fabrication techniques and positioned in a grid within resonator body 1132. In resonator 1132, embedded inclusions 1128 have an "H" (or I-beam) shape when viewed from above.

Metal inclusions 1128 can be formed of a conductive material (e.g., gold, silver, copper, nickel, etc.) and extend substantially perpendicularly from the surface of a substrate through resonator body 1132. Preferably, metal inclusions 1128 have a height corresponding to between 2-100% of the thickness of resonator body 1132.

By varying the number, size and spacing of the embedded metal inclusions in the distribution, the effective relative permittivity of the DRA resonator body can be controlled and altered. In the case of polymer-based PRAs, the controllable relative permittivity may range from that of a pure polymer or polymer-based material (e.g., about 2 or 3) up to 17 or more.

Similarly, by employing this controllability, a plurality of meta-PRAs with different characteristics can be fabricated together using a single fabrication process, and even on a single wafer or die. This may be particularly desirable for multiband applications or reflect arrays.

Referring now to FIG. 4C, there is illustrated a plot of the input reflection coefficient (S11 in dB) of meta-PRA 1100 as compared to an analogous DRA in which the resonator body 1132 has been replaced with a simple rectangular dielectric body with relative permittivity of 17, having the same dimensions, but without any metal inclusions.

It can be observed that meta-PRA 1100 has very similar input impedance characteristics (similar S11 versus frequency) to the conventional DRA. Accordingly, the embedded metal inclusions can act as a relative permittivity magnifier, and enable the synthesis of a high relative permittivity meta-material artificial dielectric without the need to incorporate ceramic powders. Accordingly, the size of the resonator body—and therefore the DRA—can be reduced while maintaining similar radiation characteristics.

Referring now to FIG. 4D, there is shown an isometric view of a variant meta-PRA 1100' with a resonator body comprising a grid of embedded vertical metal inclusions. Meta-PRA 1100' is generally analogous to meta-PRA 1100, except that the excitation structure is a microstrip feedline 1191 rather than a slot feed mechanism. The microstrip feedline 1191 typically extends underneath the meta-PRA body 1132, from 0 to 100% of the distance from the body edge to the edge of the metal inclusions, and this distance is adjusted to obtain optimum excitation of the desired mode. In certain situations, the meta-PRA can be excited if the microstrip feedline 1191 terminates at the edge of the meta-PRA body 1132, or even a short distance (typically 100-300 microns) outside the edge of the meta-PRA body 1132. In certain situations, the meta-PRA can be excited if the microstrip feedline 1191 extends underneath the metal inclusions of the meta-PRA body 1132. Different behaviors are observed by orienting the microstrip feedline 1191 at different angles relative to the metal inclusions pattern, and these effects are further described herein.

Other feeding mechanisms besides slot feeding and microstrip feeding may also be used. For instance, feeding mechanisms presented in U.S. Provisional Patent Application No. 61/919,254, including tapered microstrip lines, tall metal transmission lines, tall vertical strips, etc., can also be used to excite the meta-PRA elements.

As noted herein, deep lithographic fabrication processes, such as X-ray lithography, can be used to fabricate embedded, vertical metal inclusions. Polymer and polymer-based materials can be used both as electroplating templates and also as part of the final meta-PRA structures.

Although shown as H-shaped inclusions in resonator body 1132, the metallic inclusions provided within the resonator body can be of various shapes with possibly different antenna performance. Three additional example shapes are illustrated herein and their antenna performance described. However, many other shapes may be used, and the following shapes are presented only as examples.

Figure 5A:
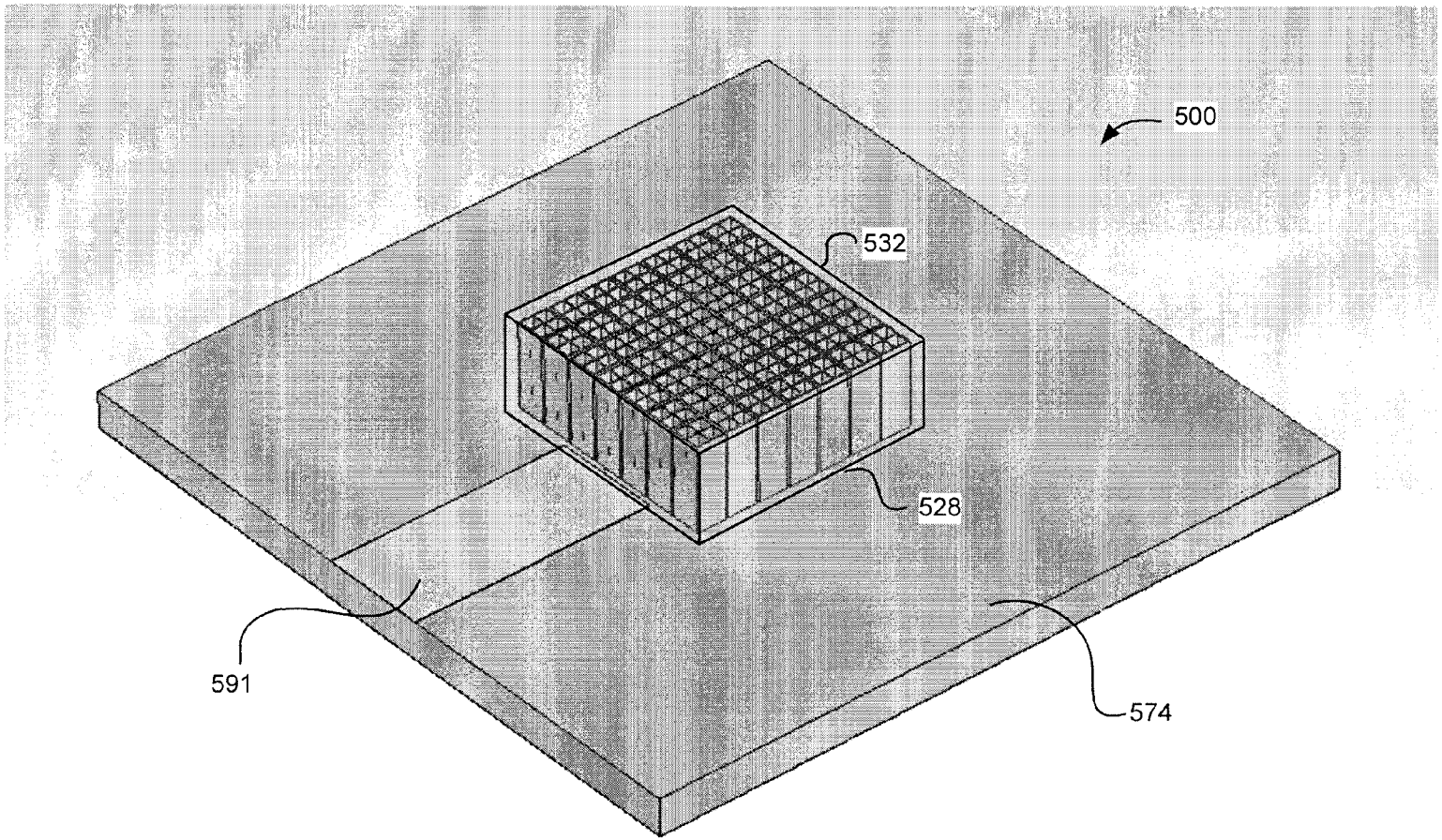
FIG. 5A is a perspective view of another example DRA with meta-material resonator body containing "window" shaped embedded metal inclusions.

Referring now to FIG. 5A, there is illustrated another example meta-PRA with meta-material resonator body.

Meta-PRA 500 is generally analogous to meta-PRA 1100' and has a resonator body 532 on a substrate 574, fed by a microstrip feedline 591. In the illustrated example, substrate 574 is a 15×15 mm Taconic TLY5 substrate ($\varepsilon_r$=2.2) with a thickness of 0.79 mm. Feedline 591 is a 50Ω microstrip line with a width of 2.25 mm.

Use of meta-materials for PRA 500 results in an effective high permittivity DRA (e.g., effective relative permittivity between 10 and 20). When optimally fed, a traditional DRA with this range of permittivity is expected to have a gain of less than 7 dB.

Resonator body 532 is a meta-material formed from a low permittivity bulk polymer body (e.g., PMMA) with embedded metal structures or inclusions 528 having a window shape.

Figure 5B:
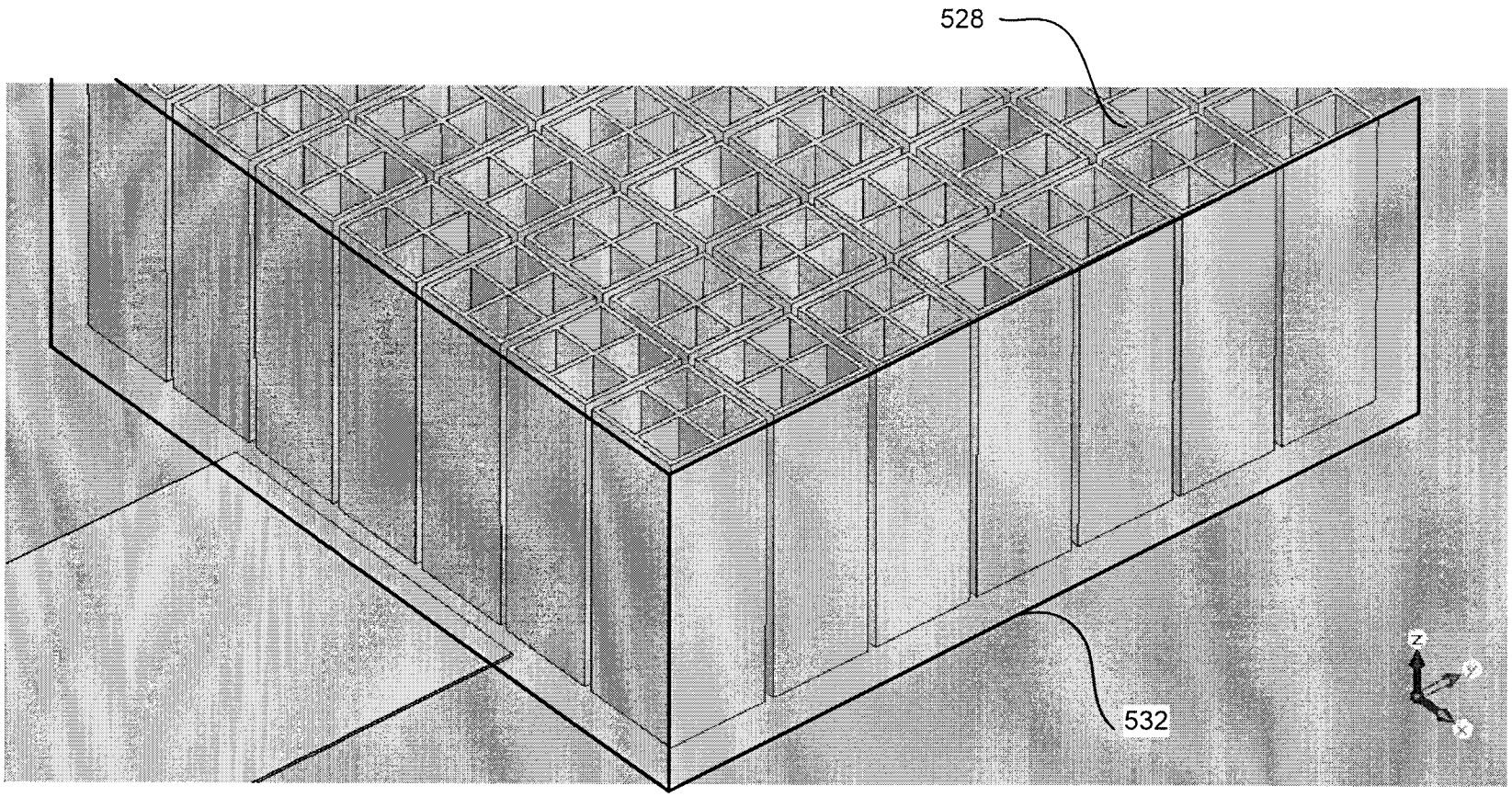
FIG. 5B is a detailed perspective view of the resonator body of FIG. 5A.
Figure 5C:
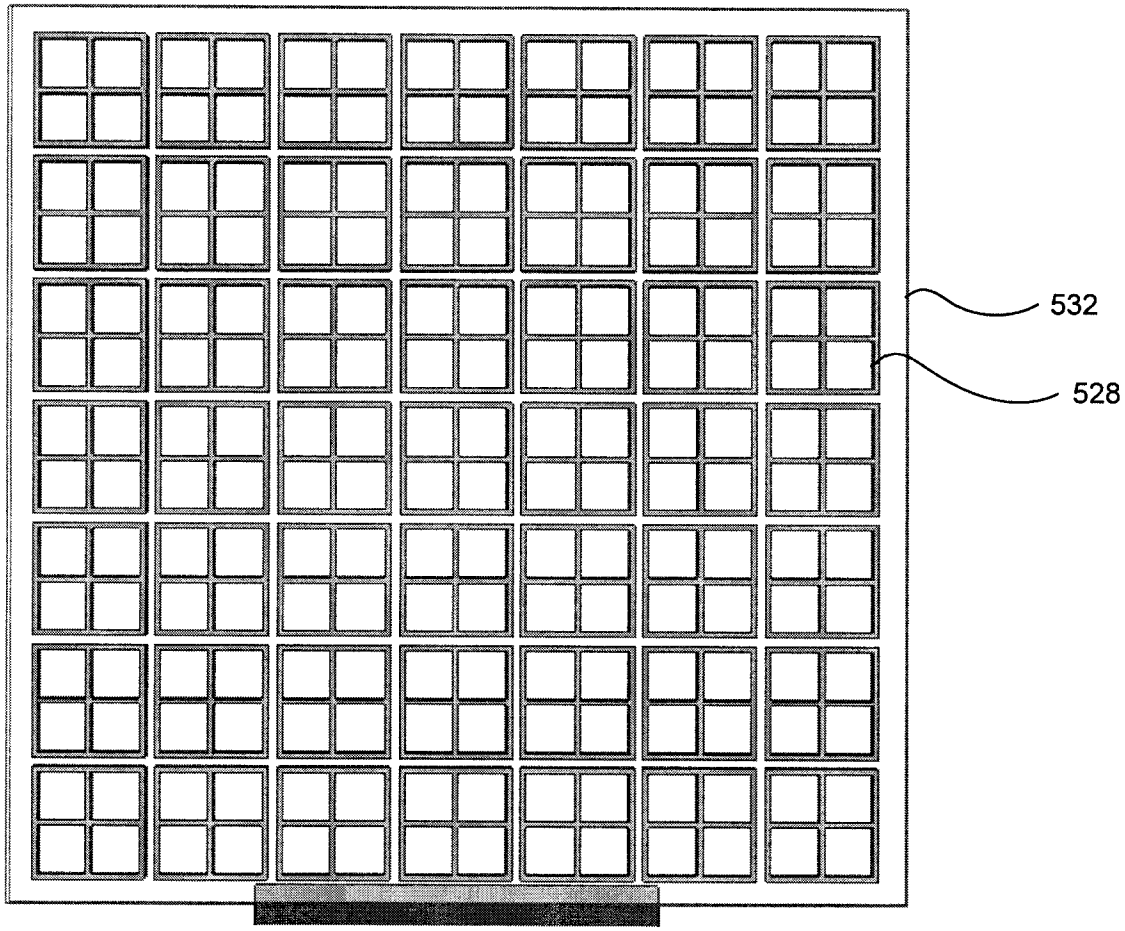
FIG. 5C is a plan view of the resonator body of FIG. 5A.

Each inclusion 528 has a cross-sectional profile resembling four squares, each connected at two sides, and forming a larger square of twice the size (and four times the area). This cross-sectional profile is shown in greater detail in FIGS. 5B and 5C, and may resemble a "four pane window" in cross-section.

The window shape of the embedded metal inclusions 528 is symmetric in both the x- and y-directions, and is therefore rotation (orientation) independent unlike the H-shaped inclusions of meta-PRA 1100 or 1100'. The rotation (orientation) independence characteristic of this geometry may be useful in certain applications. For example, it can be used to fabricate a circularly polarized antenna for which direction independence of the permittivity is desired.

In the illustrated example, each inclusion has sides with length 600 μm (i.e., each sub-square is 300 μm in length), the thickness of each metal wall is 30 μm, and the height of the metal inclusions is 1800 μm. The resonator body has a total of 49 inclusions, in a uniform 7×7 arrangement, with spacing of 50 μm between inclusions. The inclusions 528 are embedded in a 5×5×2 mm (L×W×H) low permittivity bulk polymer body (e.g., with a permittivity of $\varepsilon_r$=2.5).

Figure 5D:
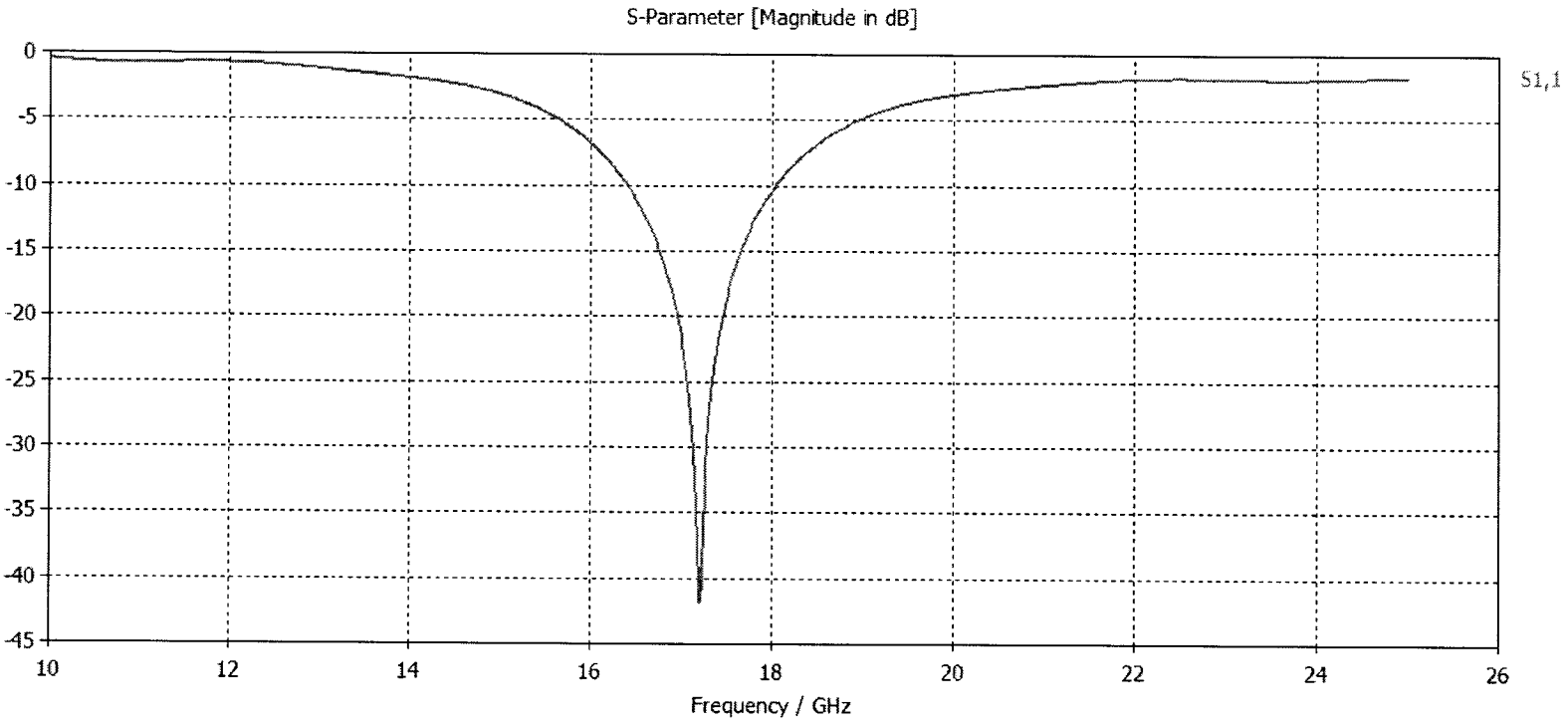
FIG. 5D is a plot of the reflection coefficient of the DRA of FIG. 5A.

FIG. 5D illustrates the reflection coefficient of the meta-PRA 500. It can be observed that the resonance frequency is at 17.2 GHz, which is similar to that of a well-fed DRA with a permittivity of around 10. Given that the bulk polymer body has a relative permittivity of 2.5, the introduction of the metal inclusions 528 results in an effective permittivity multiplication factor of 4.

Figure 5E:
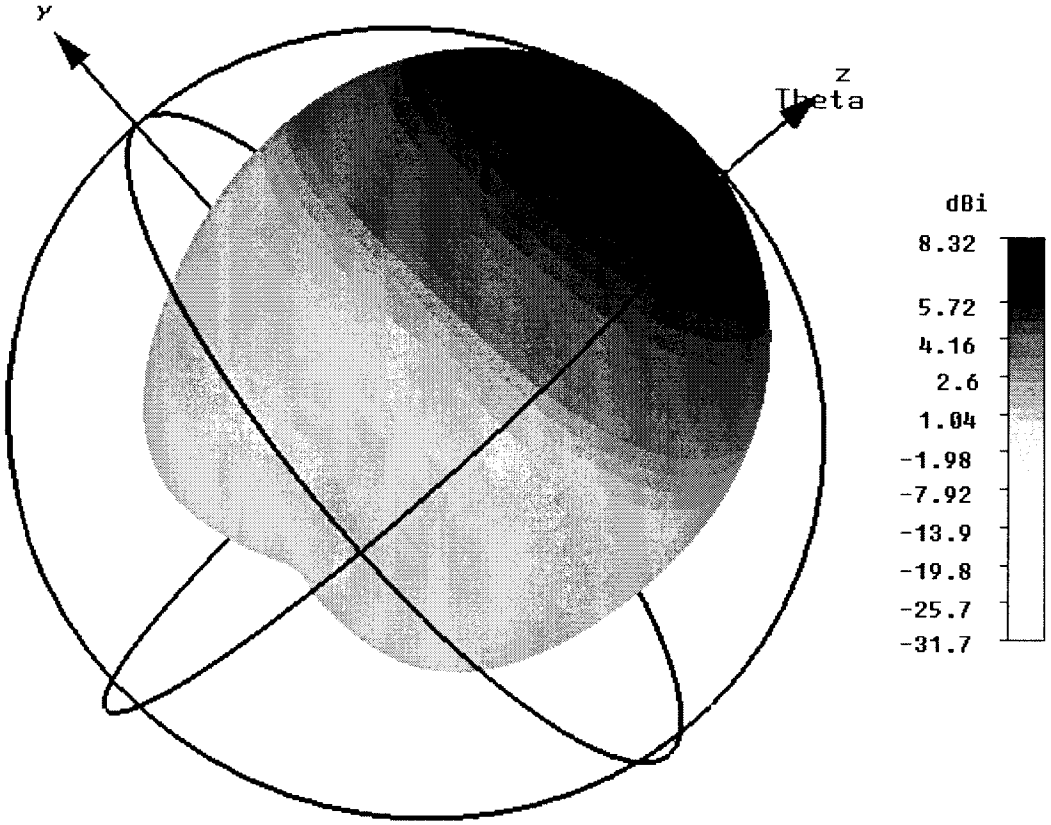
FIG. 5E illustrates the radiation pattern of the DRA of FIG. 5A.

FIG. 5E illustrates the radiation pattern of meta-PRA 500 at the resonant frequency. A broadside radiation pattern with 8.1 dB gain can be observed.

Figure 6A:
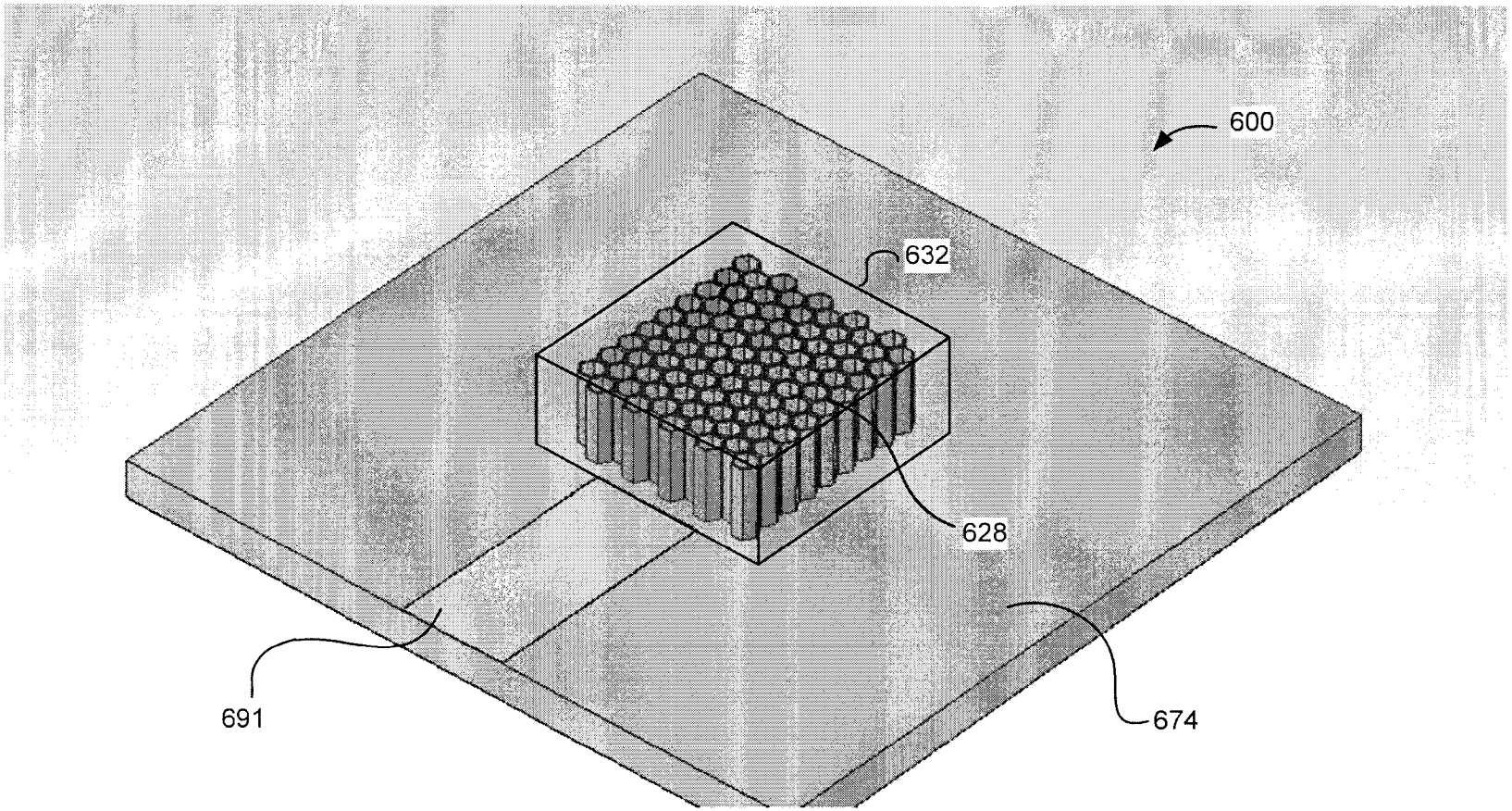
FIG. 6A is a perspective view of another example DRA with meta-material resonator body containing hexagon shaped embedded metal inclusions.

Referring now to FIG. 6A, there is illustrated another example DRA with meta-material resonator body.

Meta-PRA 600 is generally analogous to meta-PRA 500, and has a resonator body 632 on a substrate 674 fed by a microstrip feedline 691. The dimensions of meta-PRA 600 also generally correspond to those of meta-PRA 500 in this example.

Figure 6B:
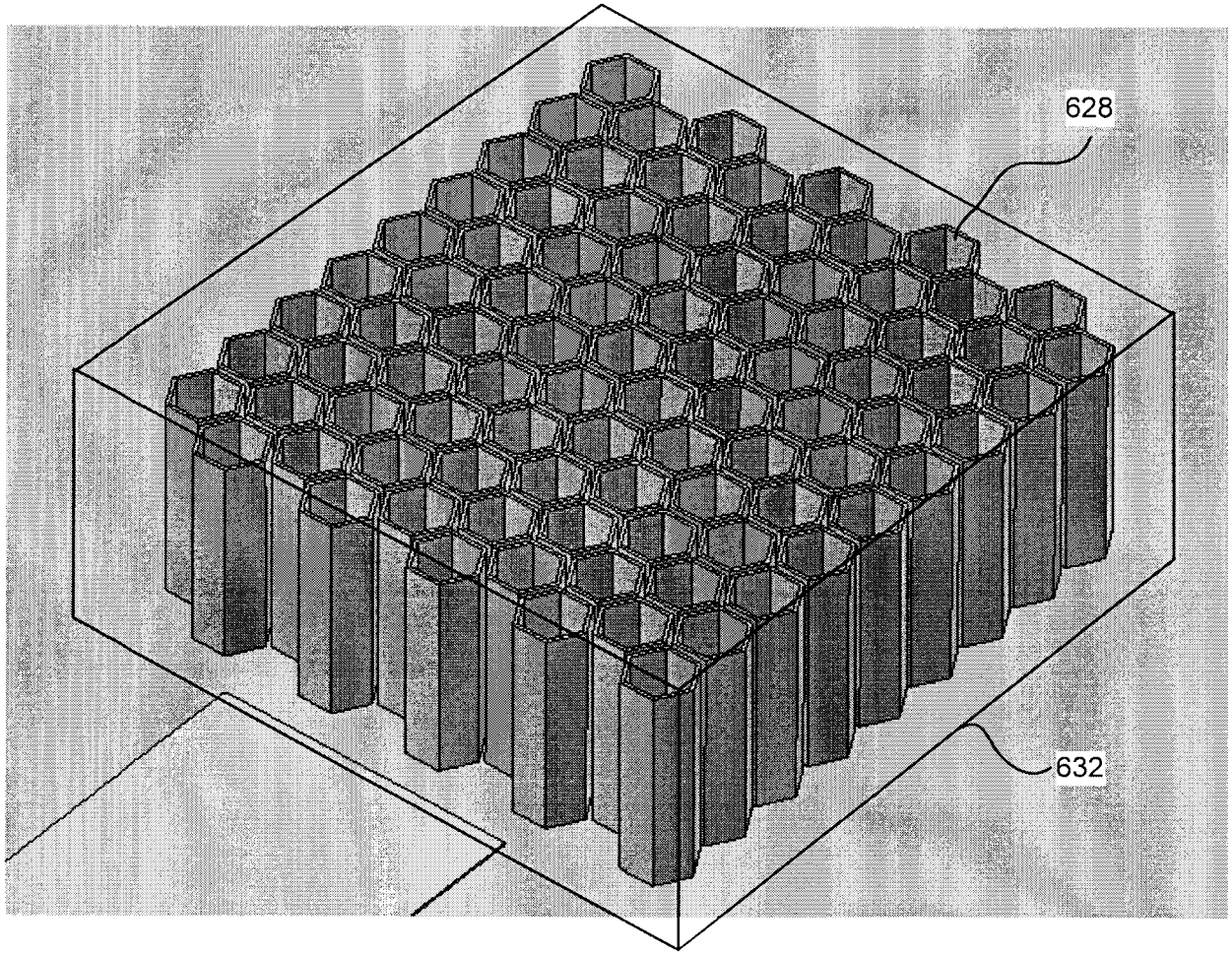
FIG. 6B is a detailed perspective view of the resonator body of FIG. 6A.
Figure 6C:
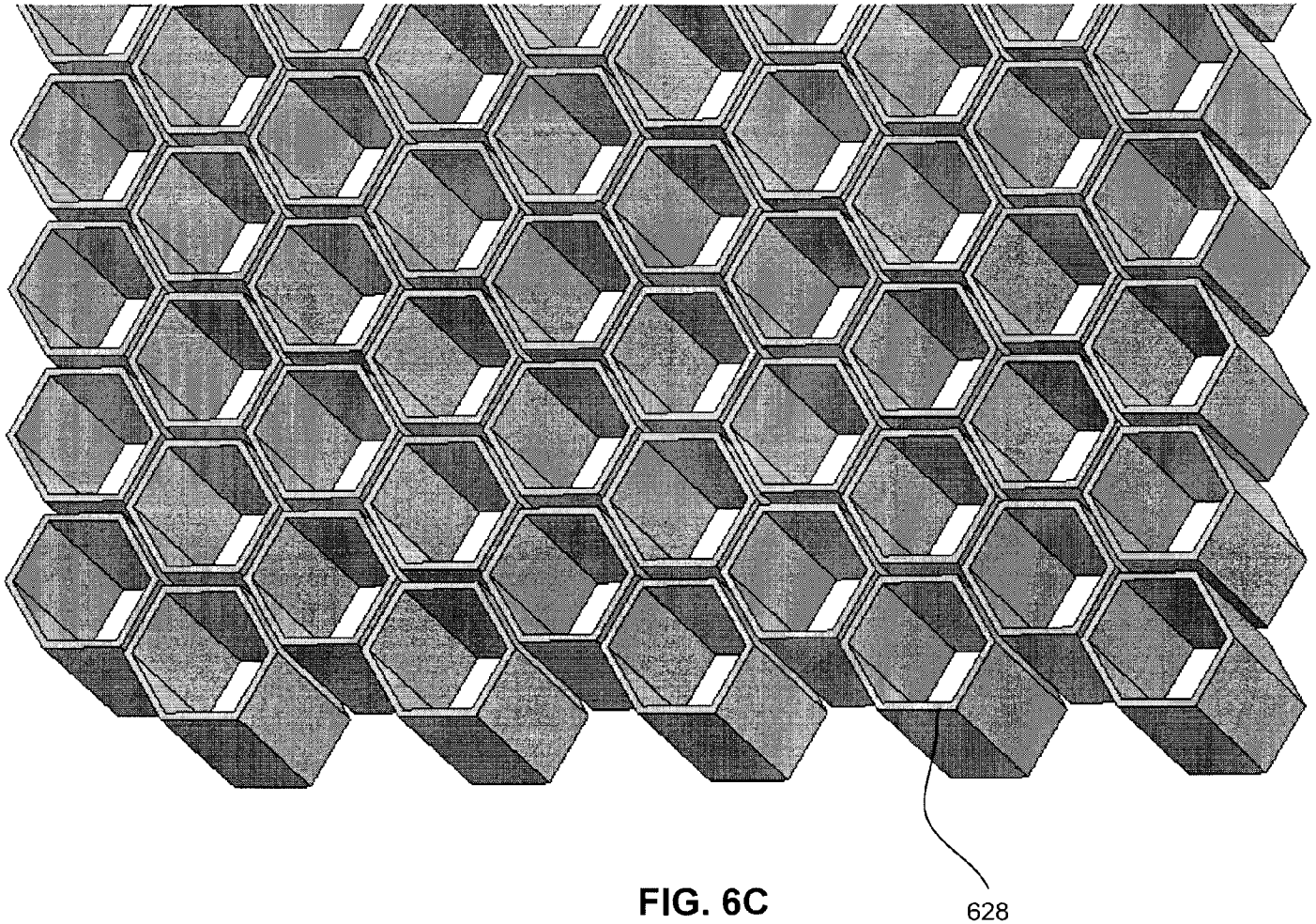
FIG. 6C is a detailed perspective view of the metallic inclusions of the resonator body of FIG. 6A.

Resonator body 632 has embedded metal inclusions 628 that may be arranged in a uniform honeycomb distribution. Each of the embedded metal inclusions 628 has a hexagonal cross-sectional profile, as shown in greater detail in FIGS. 6B and 6C.

In the illustrated example, each hexagonal inclusion 628 has a radius of 500 μm and a height of 1800 μm. A total of 100 inclusions are spaced apart by 100 μm in a 10×10 shifted arrangement to form the honeycomb distribution.

Figure 6D:
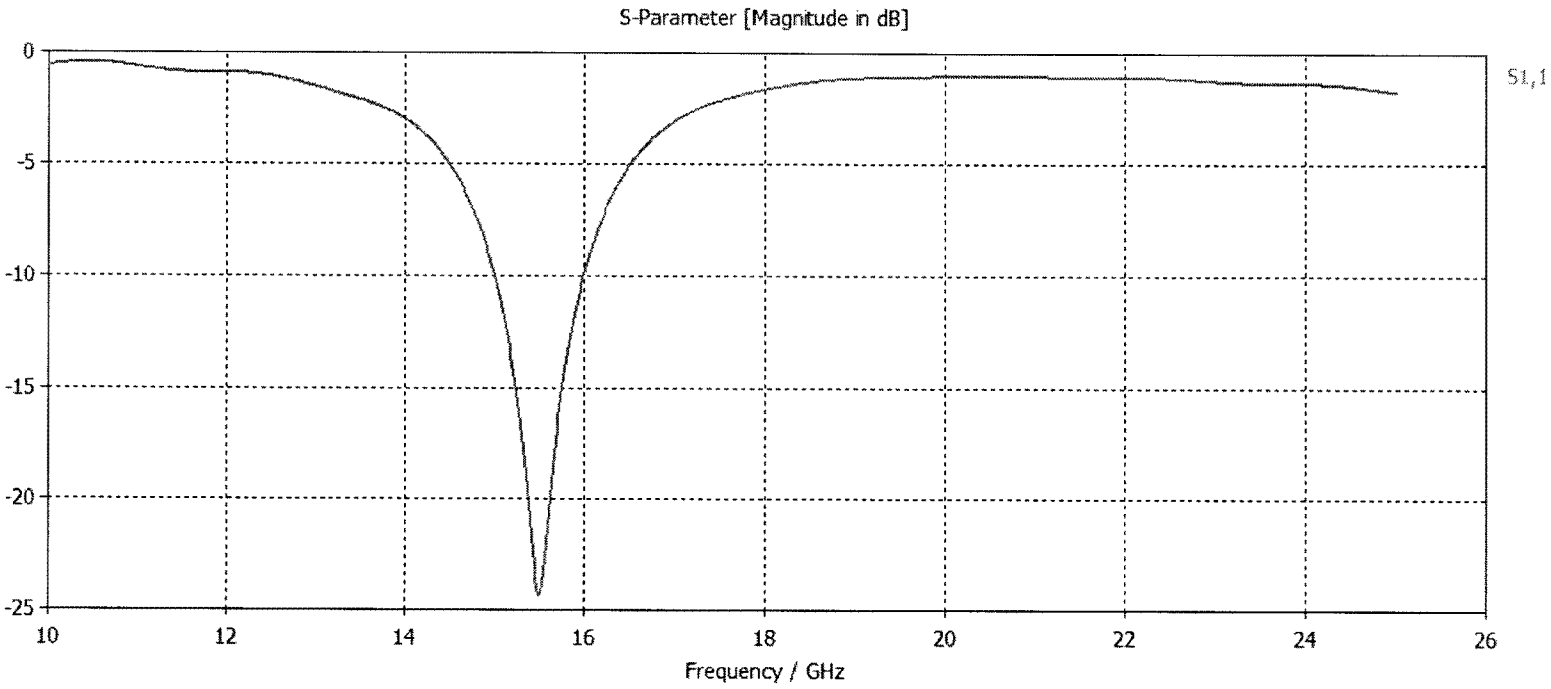
FIG. 6D is a plot of the reflection coefficient of the DRA of FIG. 6A.

FIG. 6D illustrates the reflection coefficient of meta-PRA 600. It can be observed that the resonance frequency is at 15.5 GHz, with −10 dB bandwidth of approximately 1 GHz (7%). This is roughly equivalent to a conventional high permittivity DRA with the same size (5×5×2 mm), but with a conventional resonator body having permittivity of approximately 14. Thus, the effective permittivity multiplication factor of the honeycomb distributed meta-material is 5.6.

As noted, the distance between the hexagonal inclusions is 100 μm. In a polymer block with 2 mm thickness, this results in an aspect ratio of 20, which is an easily achievable aspect ratio to fabricate with X-ray lithography in a single layer exposure.

Increasing the distance between inclusions to 250 μm does not dramatically change the resonant frequency (less than a 1 GHz change has been observed). This separation distance would require an aspect ratio of less than 10, which is suitable for other methods of fabrication, namely UV lithography. This may be especially useful for higher frequency antennas, for which the maximum thickness of the polymer resonator body could shrink to less than 1 millimeter, or for fabrication of a thicker layer by stacking and bonding of several exposed thinner layers, or through multiple application of a thinner resist layer followed by subsequent exposure, re-application, and exposure steps, or through building up the final thickness using multiple layer jet printing or screen printing approaches. In some embodiments, the resonator body may have a thickness between 50 and 5000 microns. However, thicknesses outside this range are generally valid and primarily depend on available micro-fabrication technologies. Accordingly, in some other embodiments, the resonator body may have thicknesses less than 50 microns or greater than 5000 microns.

Figure 6E:
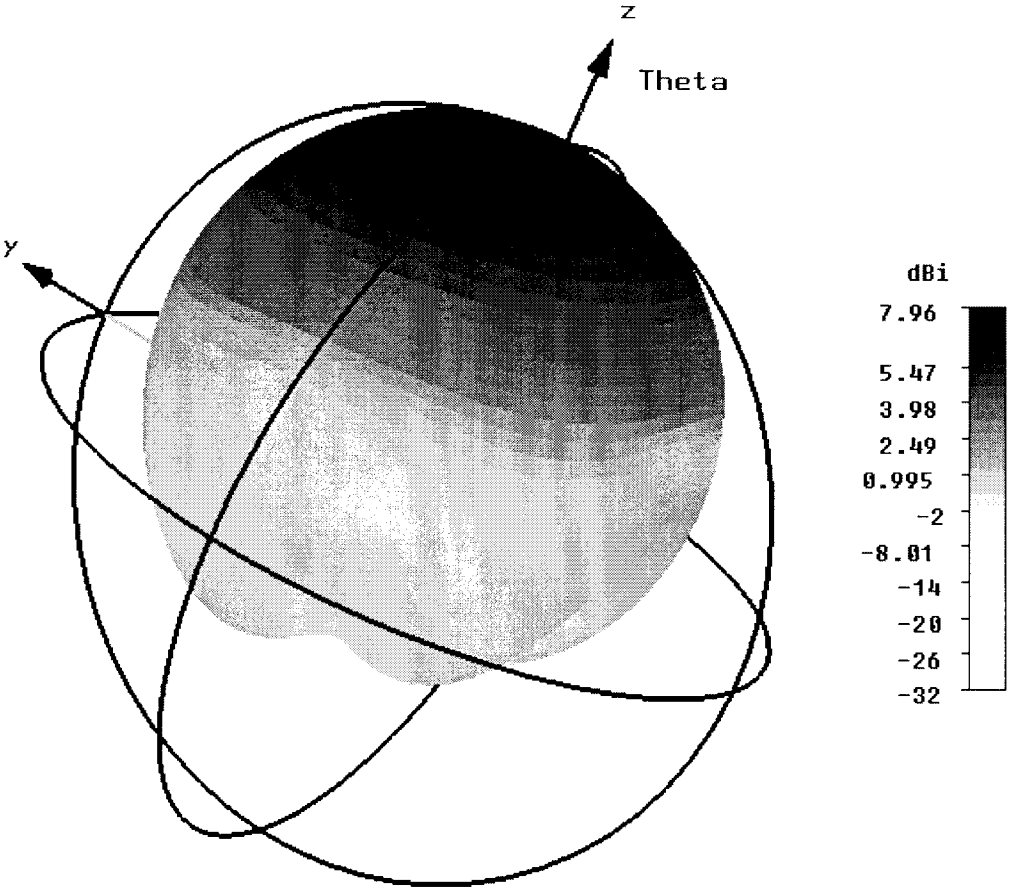
FIG. 6E illustrates the radiation pattern of the DRA of FIG. 6A.

FIG. 6E illustrates the radiation pattern of meta-PRA 600 at a resonant frequency of 15.5 GHz. A broadside pattern typical of a high permittivity DRA can be observed, with a gain of 7.73 dB.

Figure 7A:
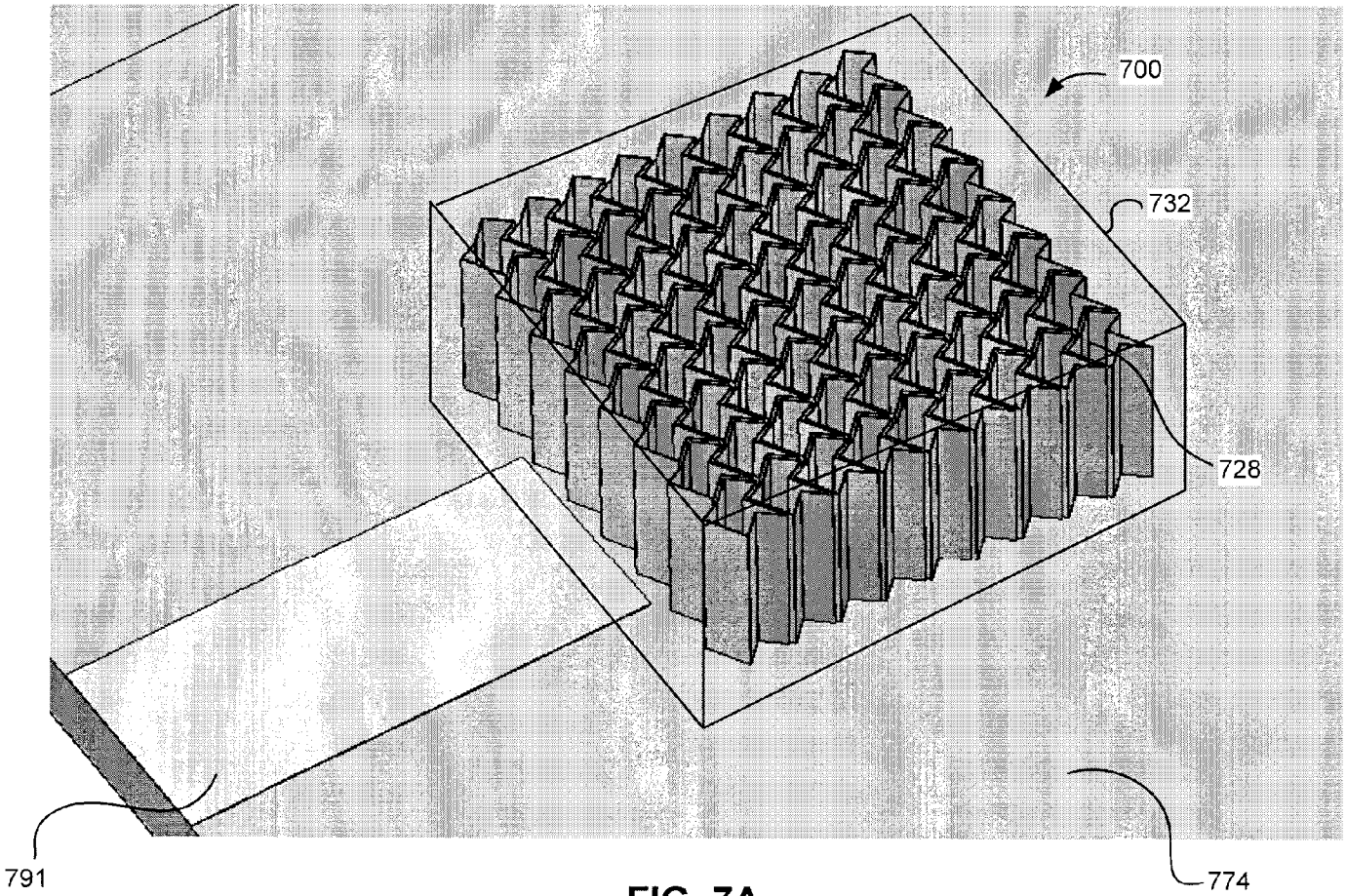
FIG. 7A is a perspective view of another example DRA with meta-material resonator body.

Referring now to FIG. 7A, there is illustrated yet another example DRA with meta-material resonator body.

Meta-PRA 700 is generally analogous to meta-PRA 500 and meta-PRA 600, and has a resonator body 732 on a substrate 774 fed by a microstrip feedline 791. The dimensions of meta-PRA 700 generally correspond to those of meta-PRAs 500 and 600 in this example.

Figure 7B:
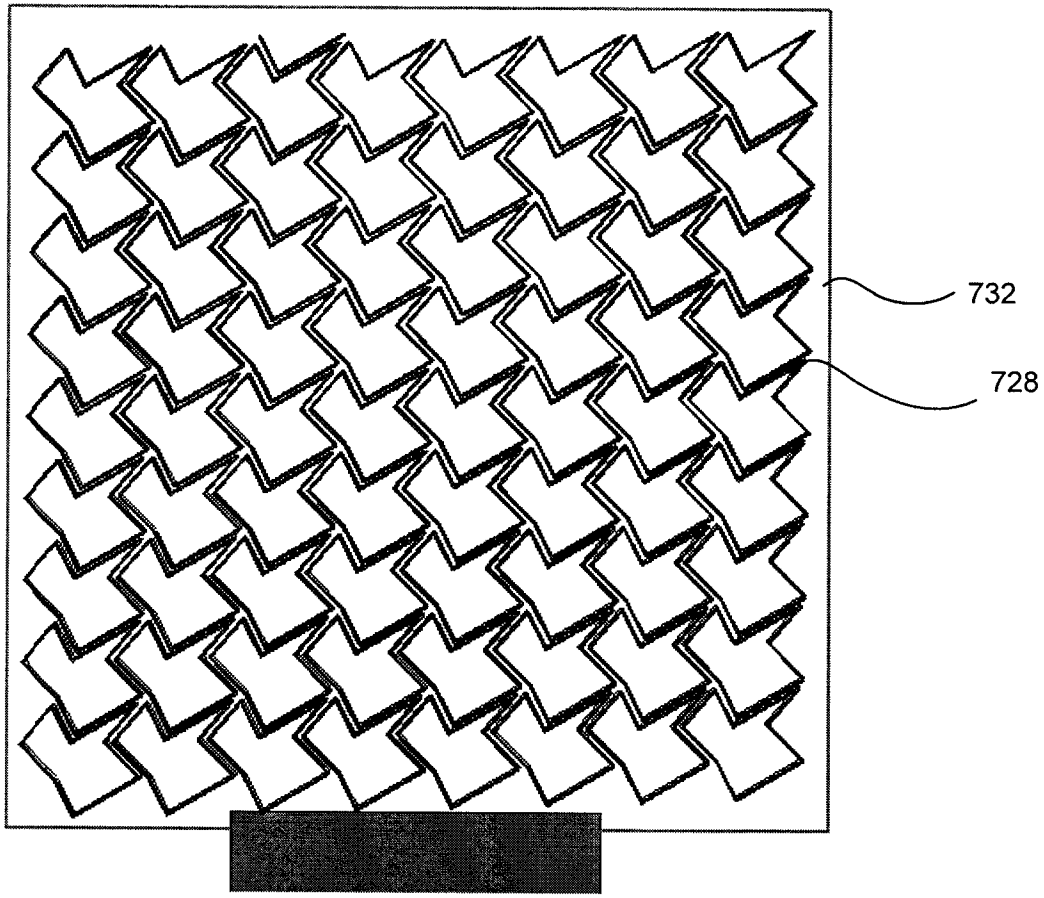
FIG. 7B is a plan view of the resonator body of FIG. 7A.
Figure 7C:
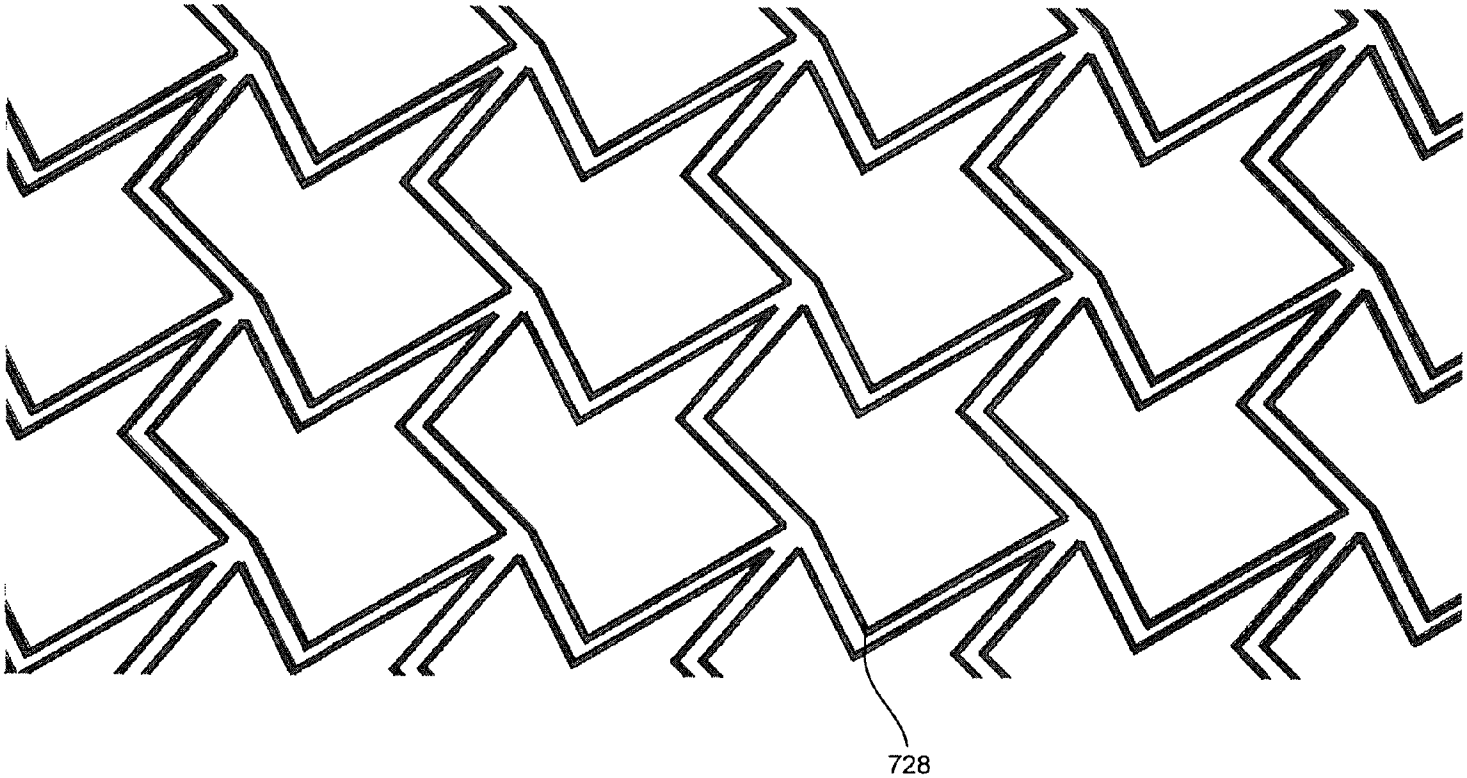
FIG. 7C is a detailed plan view of the metallic inclusions of the resonator body of FIG. 7A.

Resonator body 732 has embedded metal inclusions 728 that may be arranged in a grid. Each of the embedded metal inclusions 628 has a "complicated box" cross-sectional profile, as shown in greater detail in FIGS. 7B and 7C. Each "complicated box" is a modified rectangular box with a shape that has similar area to that of a 600 μm rectangular box, but with roughly 1.5 times the perimeter.

In the illustrated example, a total of 72 tall metal inclusions 728 are arranged in an 8×9 array with approximately 50 μm spacing between each inclusion. The metal wall thickness of each inclusion is less than 50 μm.

As a result of the thinner walls and tighter spacing of inclusions, there is a stronger coupling of the metal inclusions as compared to meta-PRA 500 or 600, resulting in a higher effective permittivity and lower resonance frequency.

Figure 7D:
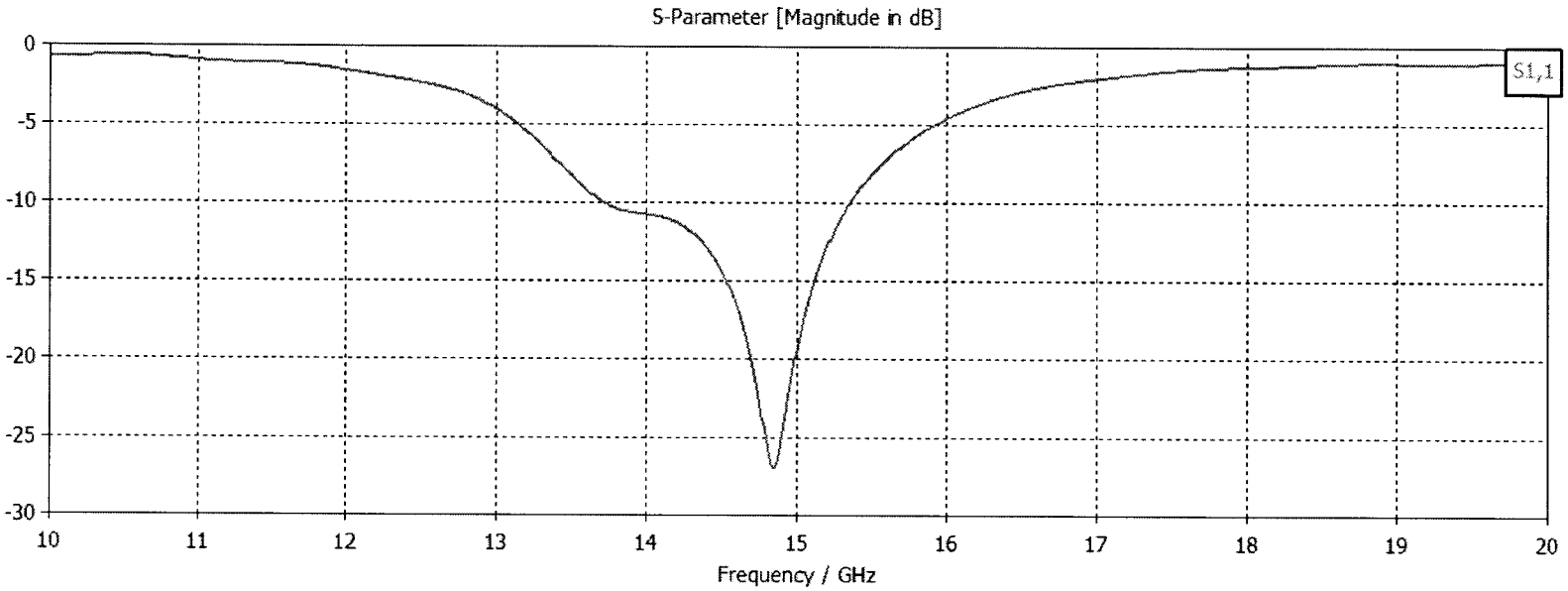
FIG. 7D is a plot of the reflection coefficient of the DRA of FIG. 7A.

FIG. 7D illustrates the reflection coefficient of meta-PRA 700. It can be observed that the resonance frequency of the antenna is approximately 1 GHz lower than that of meta-PRA 600, with roughly twice the −10 dB bandwidth (13%). This is roughly equivalent to a high permittivity DRA with the same size (5×5×2 mm), but with a conventional resonator body having permittivity of around 17. Thus, the effective permittivity multiplication factor of the complicated box meta-material is 6.8.

Figure 7E:
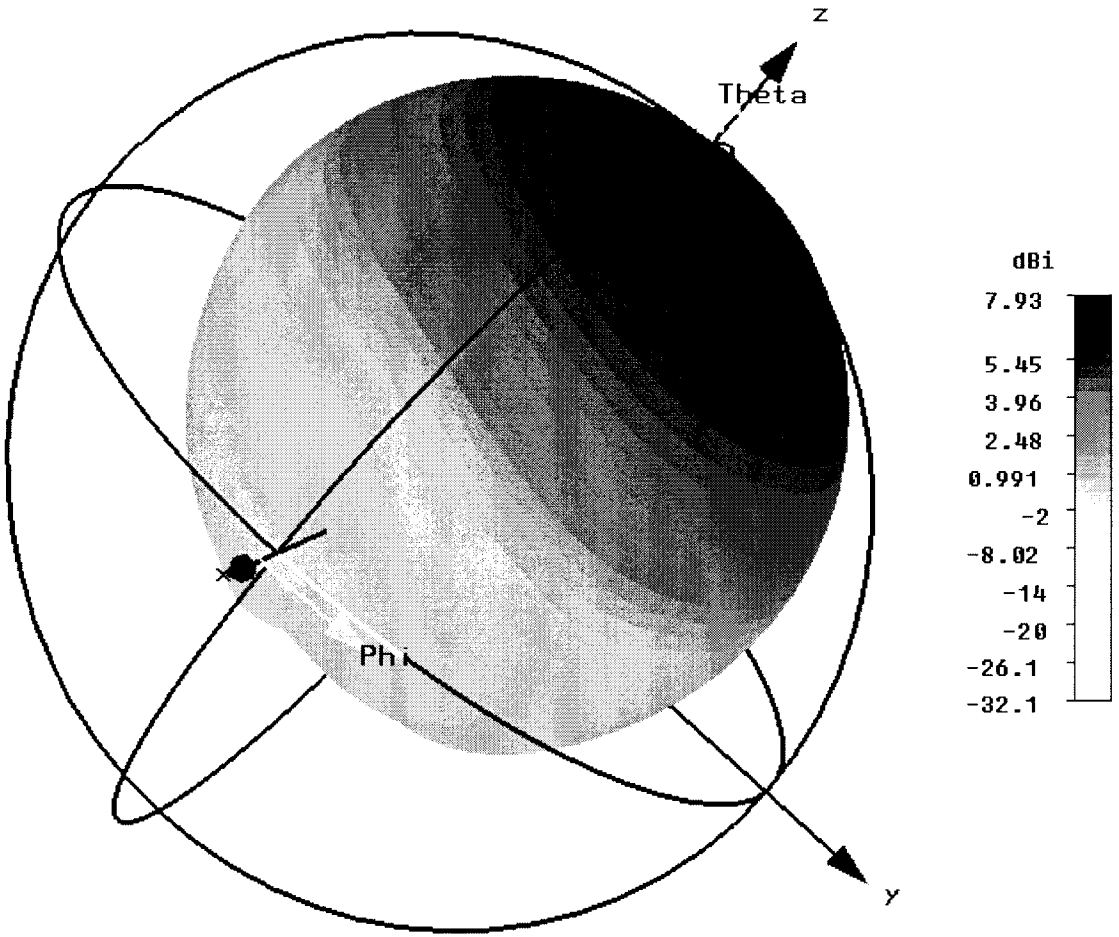
FIG. 7E illustrates the radiation pattern of the DRA of FIG. 7A at 14 GHz.
Figure 7F:
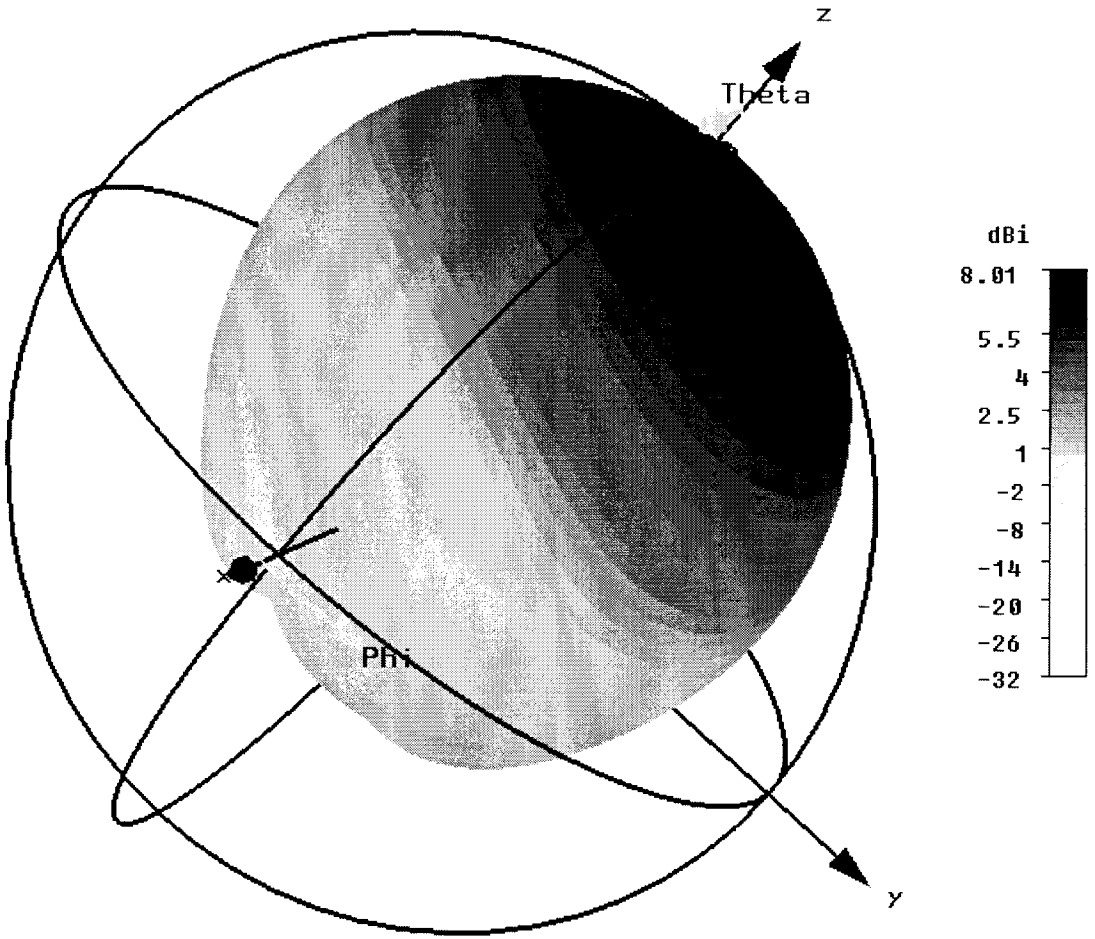
FIG. 7F illustrates the radiation pattern of the DRA of FIG. 7A at 15 GHz.

FIGS. 7E and 7F illustrate the radiation pattern of meta-PRA 700 at 14 and 15 GHz, respectively. It can be observed that the gain is between 7.6 and 7.8 dB, providing a stable broadside pattern over the entire operating frequency range.

Meta-PRAs 500, 600 and 700 demonstrate that the performance of conventional DRA antennas can be replicated using meta-materials of low-permittivity polymer resonator bodies enhanced with arrays of metal inclusions. Both return loss and radiation patterns of meta-material PRA antennas closely match the return loss and radiation patterns of conventional high permittivity DRAs fed with the same feed structure, and with an effective permittivity of 5 to 7 times that of the low permittivity bulk polymer body.

As described herein, the effective permittivity of the meta-material is generally considered to be uniform for the entire resonator body. Generally, a meta-material resonator body may be treated as an effectively uniform permittivity medium if an "effective medium condition" is met.

Generally, the lattice size Λ (i.e., the size of each grid element) should be at least 5-6 times smaller than the operating wavelength λ to achieve effective uniformity. In many cases, the effective permittivity should also remain uniform for transverse waves, and thus uniformity in the transverse direction should be verified for oblique waves. That is, the in-plane projection of the wavevector $$k_x = \frac{2\pi}{\lambda}\sin\theta$$

should be at least five times smaller than the in-plane reciprocal lattice constant $K=2\pi/\Lambda$ of the meta-material, where θ is the angle of the wave.

This condition can be simplified as:

$$\sin\theta < \frac{\lambda}{5\Lambda}$$

This condition is satisfied for all wavevectors, regardless of their angle, where:

$$\frac{\lambda}{5\Lambda} \geq 1$$

Recall that frequency $f$ is inversely proportional to wavelength λ such that $f=c/\lambda$, where c is the speed of light in a vacuum.

Accordingly:

$$\frac{\lambda}{5\Lambda} \geq 1 \rightleftharpoons \lambda \geq 5\Lambda \rightleftharpoons f \leq \frac{c}{5\Lambda} \rightleftharpoons \Lambda \leq \frac{c}{5f}$$

Therefore, effectively uniform permittivity for the meta-material resonator body can be achieved where:

$$f[\text{GHz}] \leq \frac{0.3}{5\Lambda[\text{m}]} = \frac{6}{\Lambda[\text{cm}]}$$

or $$\Lambda[\text{cm}] \leq \frac{6}{f[\text{GHz}]}$$

As an example, for an operating frequency $f$=10 GHz, the calculated lattice size would be Λ=6/10 cm, or 600 μm. This inflection point in the lattice sizing, at which certain wavelengths interact with the resonator body in a "macroscopic" way with the effective permittivity, may be referred to as the frequency dependent meta-aperture size ($\Delta=6/f[\text{GHz}]$). Details that exceed the meta-aperture size do interact with waves in a more microscopic sense. Accordingly, the Δ parameter is significant when designing a meta-material resonator body and should be selected to encompass the entire range of expected operating frequencies.

For example, if Δ is improperly selected, there may be some oblique angles for which the resonator body does not behave as a uniform medium. Accordingly, the resulting field may be non-homogeneous.

However, experimentation has revealed that small irregularities may be acceptable in some circumstances. A looser condition for meta-aperture sizing may be specified as:

$$\Delta_n = \frac{n}{f[\text{GHz}]};$$

$$6 \leq n \leq 10$$

where a smaller value of n can be chosen to provide better uniformity. Values of n less than 6 may also be used, although this may lead to smaller feature sizing than is strictly necessary to achieve effectively uniform permittivity.

The meta-material approach described herein is not limited to the use of pure photoresist polymers. For example, in embodiments where a composite polymer or other dielectric is used, the bulk permittivity of the base material may be controlled or tuned. For instance a tunable permittivity material such as liquid crystal polymer (LCP) may be used for the surrounding bulk polymer body. LCP has been shown to possess a significant voltage-controlled tunability of dielectric constant in the microwave band (see, e.g., C. Weil, S. Muller, P. Scheele, P. Best, G. Lussem, R. Jakoby, "Highly-anisotropic liquid-crystal mixtures for tunable microwave devices," Electronics Letters, v. 39, no. 24, pp. 1732-1734, November 2003), and is currently used for various microwave tuning applications such as reconfigurable phase shifters, antennas, and filters. One of the mixtures described by Weil et al. shows approximately 50% tunability in permittivity, from 2.62 to 3.94 in the microwave range up to 30 GHz, using a relatively low tuning voltage of 35 V.

Figure 8:
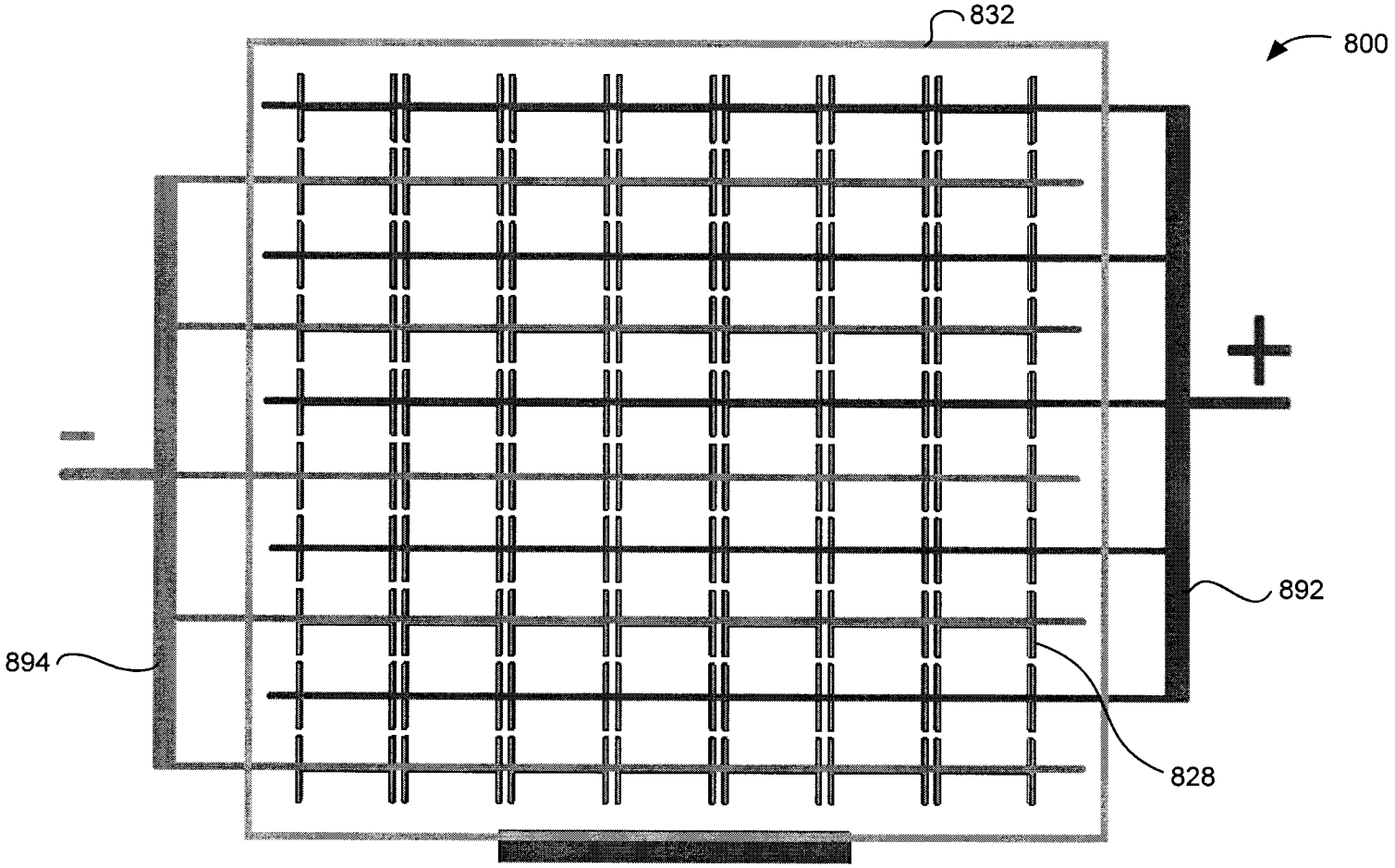
FIG. 8 is a plan view of an example resonator body and tuning circuit for a tunable meta-PRA.

Referring now to FIG. 8, there is illustrated an example meta-material PRA with biasing circuit. Meta-PRA 800 has a meta-material resonator body 832 with metal inclusions 828 that have an H-shaped cross-sectional profile. Resonator body 832 is formed of a liquid crystal polymer. A pair of interdigitated DC bias feeds 892 and 894 apply alternately positive and negative voltage to adjacent rows of metal inclusions. Assuming the mentioned change in the permittivity of the LCP body from 2.62 to 3.94 as an example, the meta-material with H-shaped inclusions can be expected to provide a multiplied effective permittivity in the range of 13 to 20. This in turn effectively changes the resonance frequency of the tunable meta-DRA by about 25% (e.g., from 16 to 20 GHz), thus providing a frequency agile antenna.

Accordingly, using the described meta-material approach with LCP or other variable permittivity resonator body, the resulting effectively high-permittivity meta-material can be controlled or tuned in a similar manner. Moreover, the effective tuning range can be expanded by the meta-material multiplication factor, since the metal inclusions serve as a permittivity multiplier.

Figure 9A:
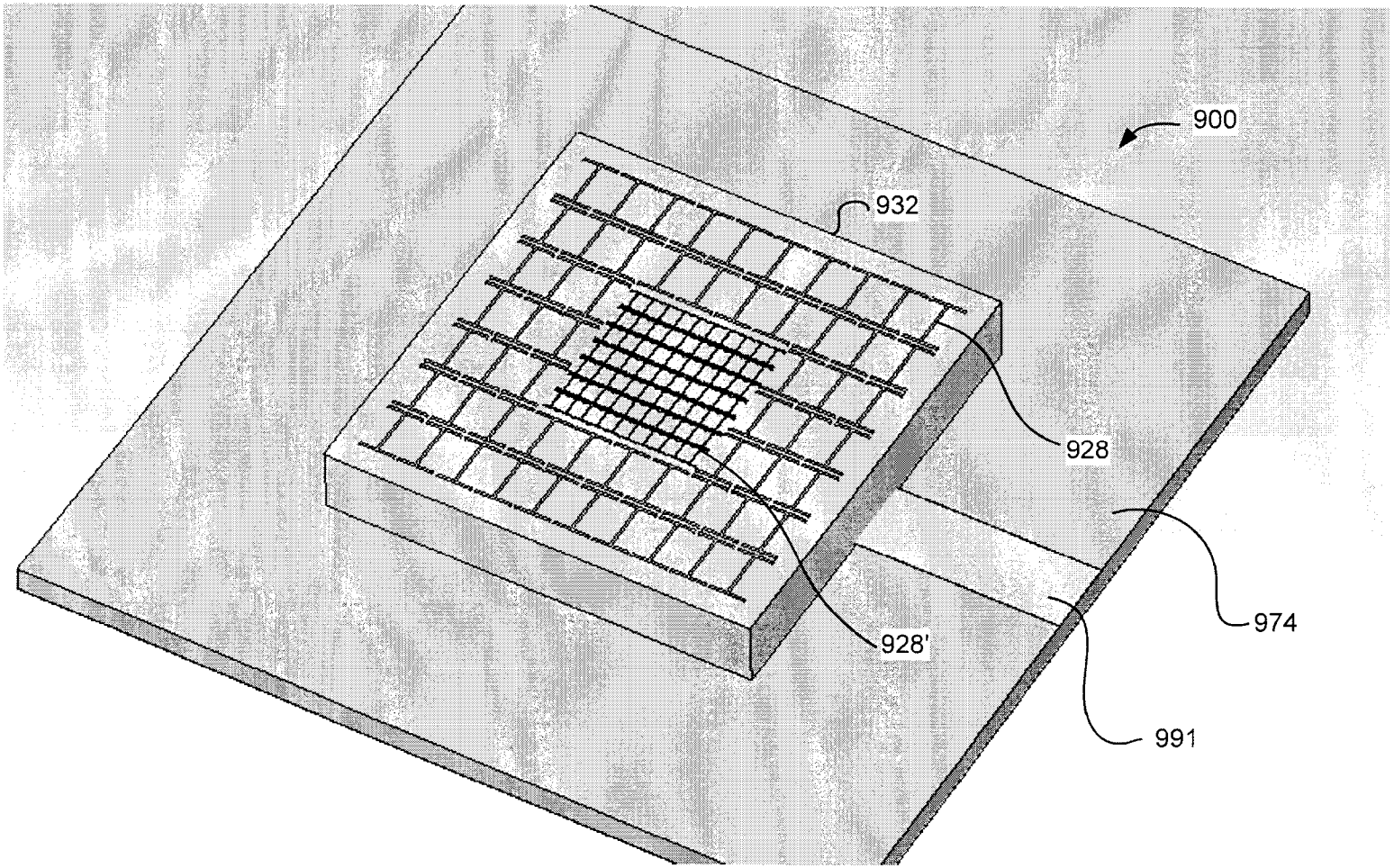
FIG. 9A is a perspective view of another example meta-PRA with non-uniform distribution of embedded inclusions.
Figure 9B:
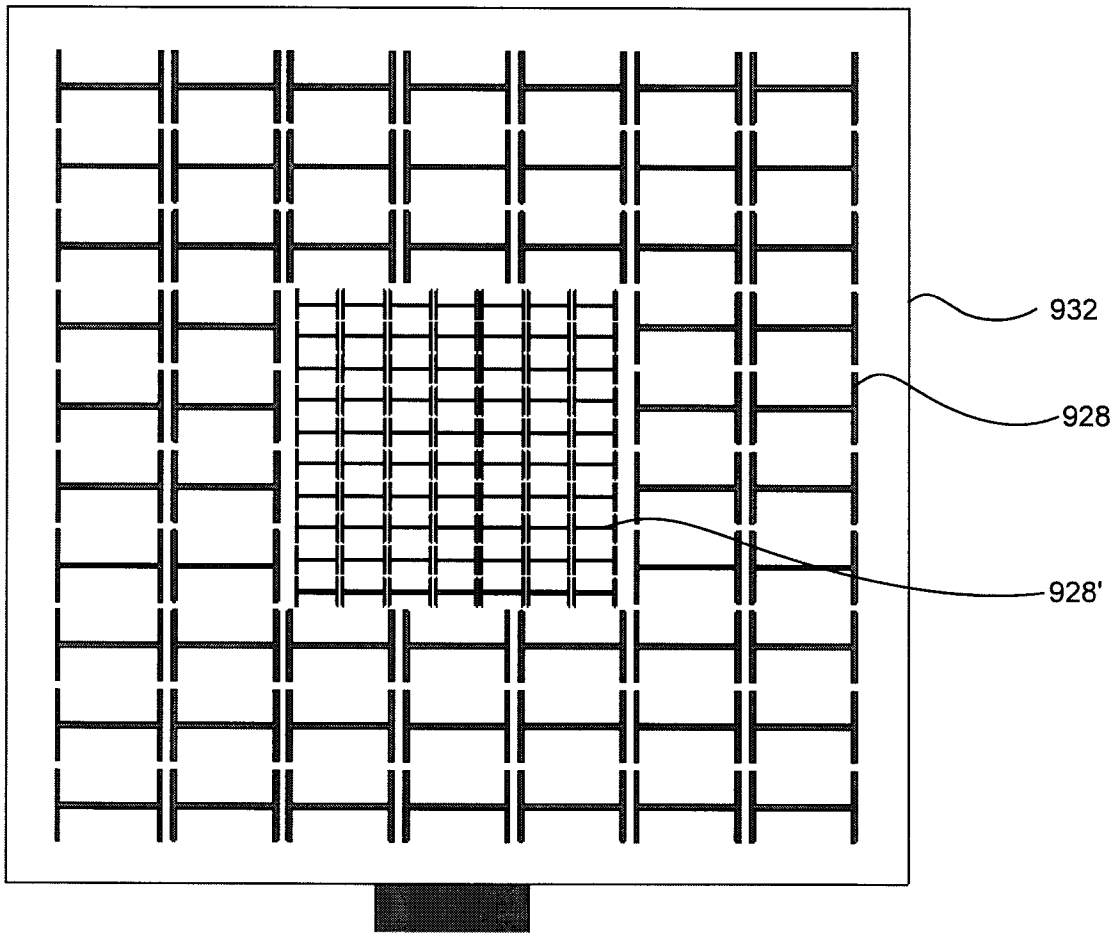
FIG. 9B is a plan view of the resonator body for the meta-PRA of FIG. 9A.

Referring now to FIGS. 9A and 9B, there are illustrated an example meta-material PRA with non-uniform inclusions. FIG. 9A is a perspective view of meta-PRA 900. Meta-PRA 900 has a resonator body 932, a substrate 974 and feedline 991. Resonator body 932 is shown in FIG. 9B in plan view.

Resonator body has a first plurality of H-shaped metal inclusions 928. However, a central portion of resonator body has a second plurality of H-shaped metal inclusions 928' that are generally smaller than inclusions 928.

By analyzing the effects of the shape of the inclusions and the various gaps in determining the effective permittivity, the distribution of local effective permittivity can be tailored for individual meta-material PRAs. The realizable permittivity for any selected portion of the resonator body is generally in the range between that of the bulk polymer material (e.g., with no inclusions or with inclusions spaced widely apart) to that of the highest attainable effective permittivity (e.g., with strongly coupled, complicated box inclusions, which have 7-8 times the permittivity of the pure bulk material).

Accordingly, small blocks of the resonator body can be assigned selected effective permittivities. For example, one portion of the resonator body may have an effective permittivity of $\varepsilon_r$=2.5, whereas another portion of the same resonator body may have permittivity of $\varepsilon_r$=25. These portions may be provided in any desired arrangement, for example using a grid of $$\frac{\lambda_0}{10}.$$

Accordingly, the illustrated example of FIGS. 9A and 9B is equivalent to a multi-segment rectangular DRA with a high permittivity core and a lower permittivity exterior, which is commonly used to enhance the bandwidth of an antenna. However, in contrast with conventional antennas, the described meta-PRA can be fabricated using only photoresist polymers and metals in a lithographic fabrication process. Moreover, various other arrangements of the lower and higher permittivity portions can be provided, allowing for specialized antenna properties.

Figure 10A:
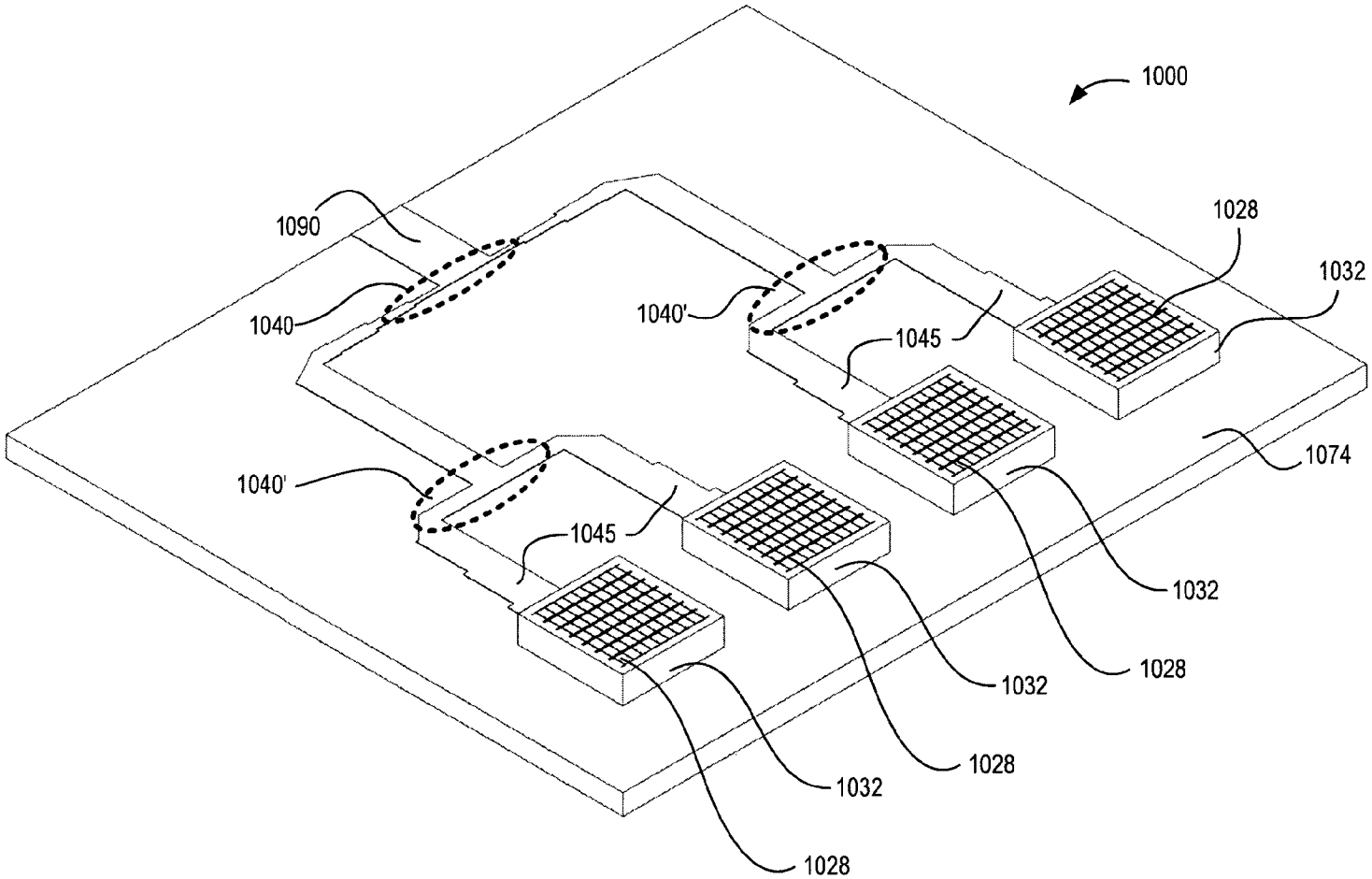
FIG. 10A is a perspective view of an example 4-element meta-material PRA array.

Several meta-material PRA elements can be assembled together to form antenna arrays. Antenna arrays typically provide higher gain, and narrower beam patterns than respective single elements. Referring now to FIG. 10A, there is illustrated a perspective view of an example 4-element meta-material PRA array. Meta-material PRA array 1000 has 4 similar meta-PRA elements 1032, each having H-shaped embedded metal inclusions 1028 distributed in a regular grid. The meta-PRA elements 1032 are only used to demonstrate the application of meta-PRA element to arrays, and any of the meta-PRA elements described in the embodiments presented could generally be assembled into arrays.

The example array elements are fed by a 4-port microstrip distribution and feed network 1090. Other distribution networks and feed structures for DRA arrays known in the art, or for example tall metal transmission line distribution and vertical feed structures, periodically loaded structures, and others discussed with reference to PRA arrays (see, e.g., U.S. Provisional Patent Application No. 61/919,254) can be used.

As noted above, meta-material PRA array 1000 has resonator bodies 1032, a substrate 1074, a metal ground plane beneath the substrate (not shown), microstrip distribution structures based on T-junctions 1040 and 1040', and feedlines 1045 which extend a short distance underneath the resonator bodies 1032, but in general could terminate a short distance before or at the edge of the resonator bodies. In general, each resonator body may have similar or different shaped and distributed metal inclusions, depending on the desired radiation characteristics. Also, each resonator body may be formed separately, as shown in FIG. 10A, or formed as a single monolithic piece comprising bulk-material connecting structures between the resonator bodies, and whereby the distributed metal inclusions are grouped together to form effective meta-PRA antenna elements within the single monolithic meta-array piece.

In one example, each of resonator bodies 1032 may have dimensions of 5.1 mm×4.9 mm, and be 1.5 mm thick, similar in structure to meta-PRA 1100' but with different dimensions and inclusion arrangement. These four resonator bodies 1032 are assembled on substrate 1074 with 3 mm separation between each body, and are fed by four microstrip feedlines 1045. Each resonator body 1032 contains 70 H-shaped embedded metal inclusions 1028 (in a 7×10 uniform grid), each with lateral dimensions of 0.6 mm×0.4 mm, and a height of 1.0 mm (similar to the samples shown in FIGS. 1A and 1B). The lateral thickness of and spacing between metal inclusions 1028 is 0.03 mm. In the illustrated example, substrate 1074 is a 40×30 mm Taconic TLY5 substrate ($\varepsilon_r$=2.2) with a thickness of 0.79 mm. Feedlines 1045 are multi-section microstrip stepped impedance transformers to provide required broadband impedance matching.

Figure 10B:
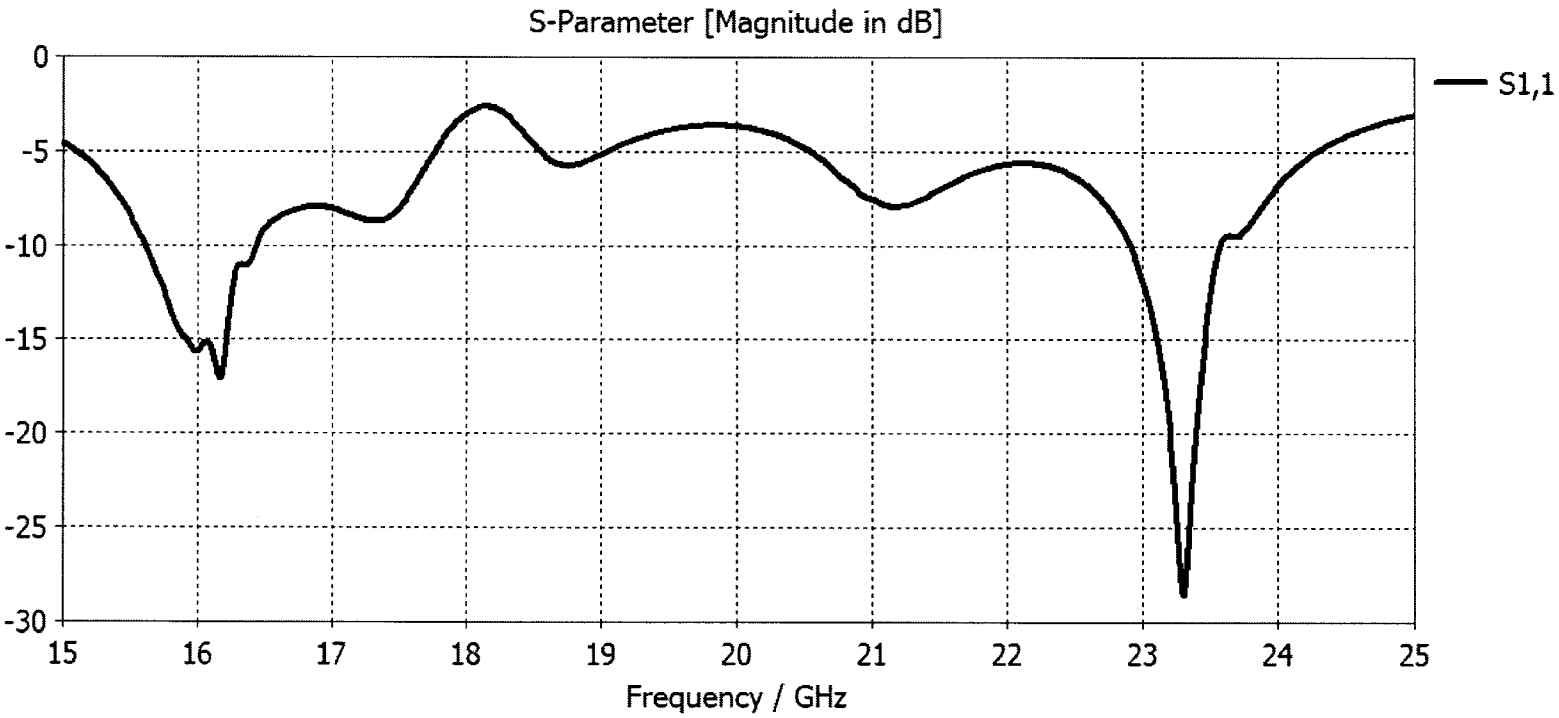
FIG. 10B illustrates the reflection coefficient of the meta-material PRA array of FIG. 10A.
Figure 10C:
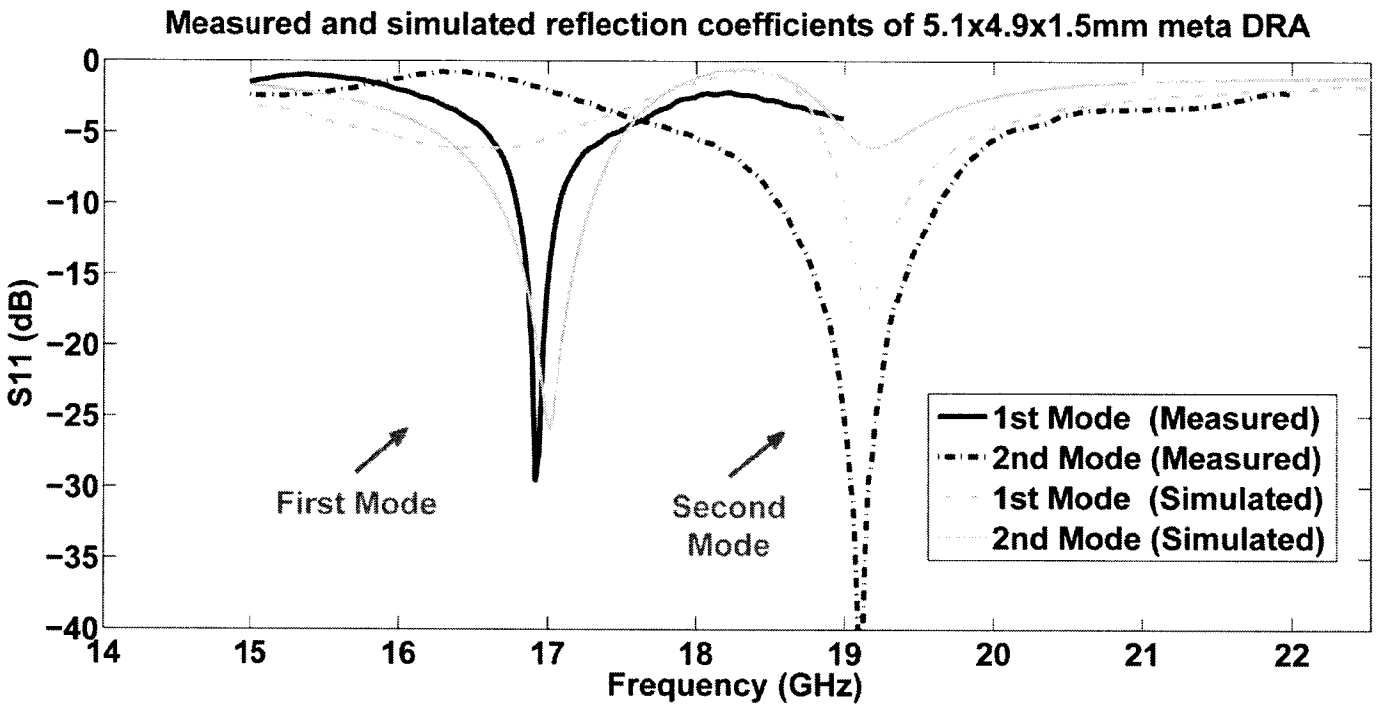
FIG. 10C illustrates the reflection coefficient of a single element from the array of FIG. 10A.

FIG. 10B illustrates the reflection coefficient of the meta-material PRA array 1000 of FIG. 10A. FIG. 10C illustrates the reflection coefficient of a single element from the array 1000.

It can be observed from FIG. 10B that the $1^{st}$ mode resonance frequency of the meta-array is around 16.2 GHz, which is slightly lower than that of the single meta-PRA shown in FIG. 10C, of around 16.9 GHz, due to additional loading of the larger feed and distribution structure. Both the single element and array structure perform similarly to traditional well-fed DRAs or DRA-arrays with homogeneous material bulk permittivity of around 12. Given that the bulk polymer body of the meta structures has a relative permittivity of 2.5, the introduction of the metal inclusions results in an effective permittivity multiplication factor on the order of 5.

Figure 10D:
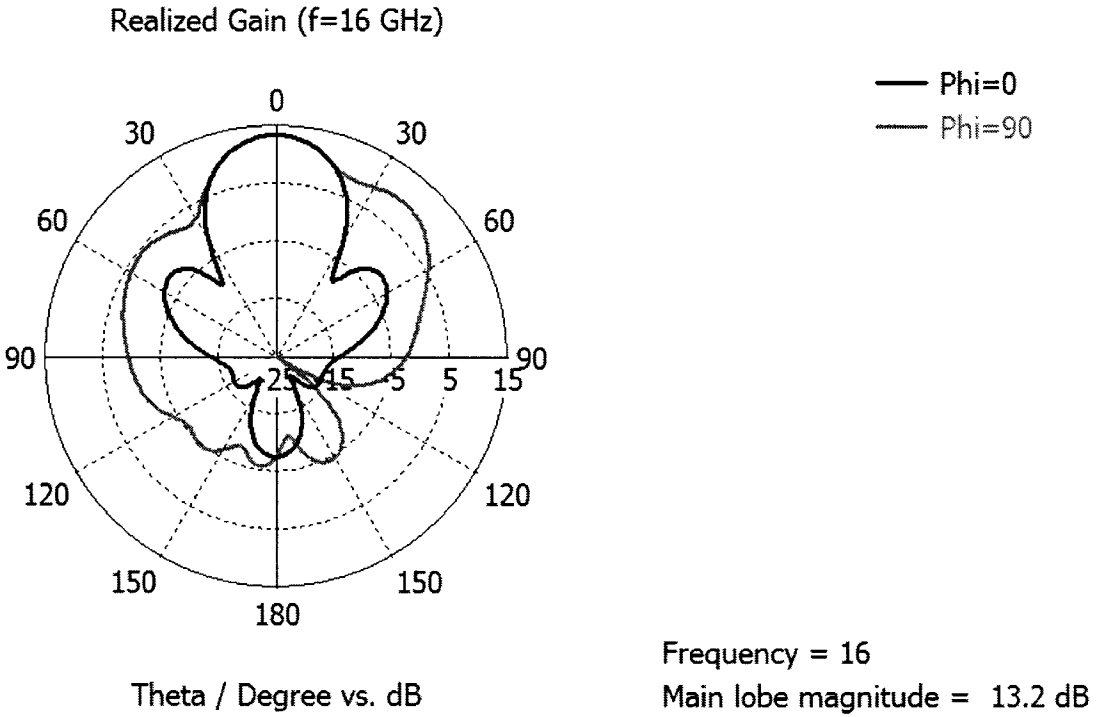
FIGS. 10D and 10E illustrate perpendicular planes of the radiation pattern of meta-material PRA array of FIG. 10A near the $1^{st}$ mode resonant frequency.
Figure 10E:
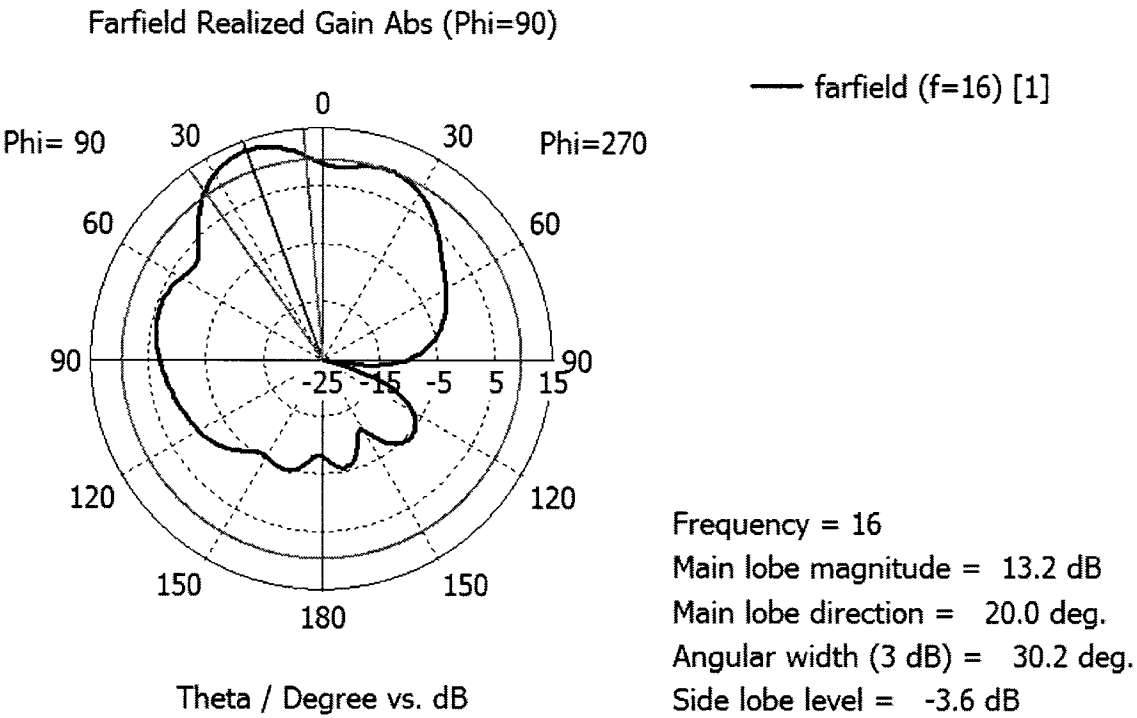

FIGS. 10D and 10E illustrate perpendicular planes of the radiation pattern of meta-material PRA array 1000 near the $1^{st}$ mode resonant frequency.

Figure 10F:
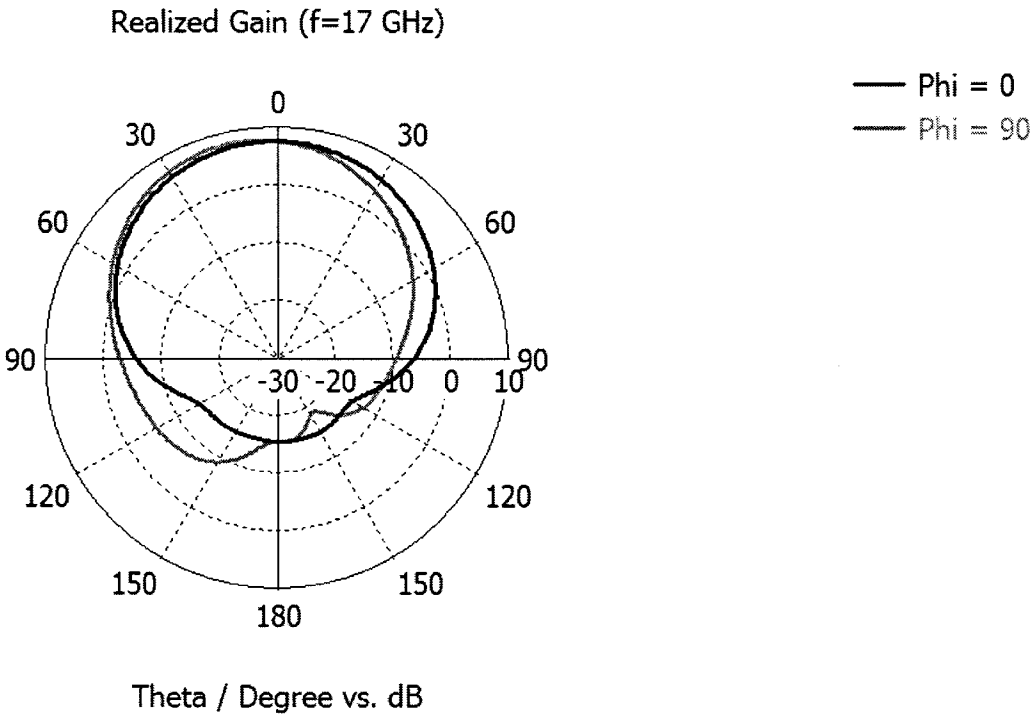
FIGS. 10F and 10G illustrate perpendicular planes of the radiation pattern of a single element from meta-material PRA array of FIG. 10A near the $1^{st}$ mode resonant frequency.
Figure 10G:
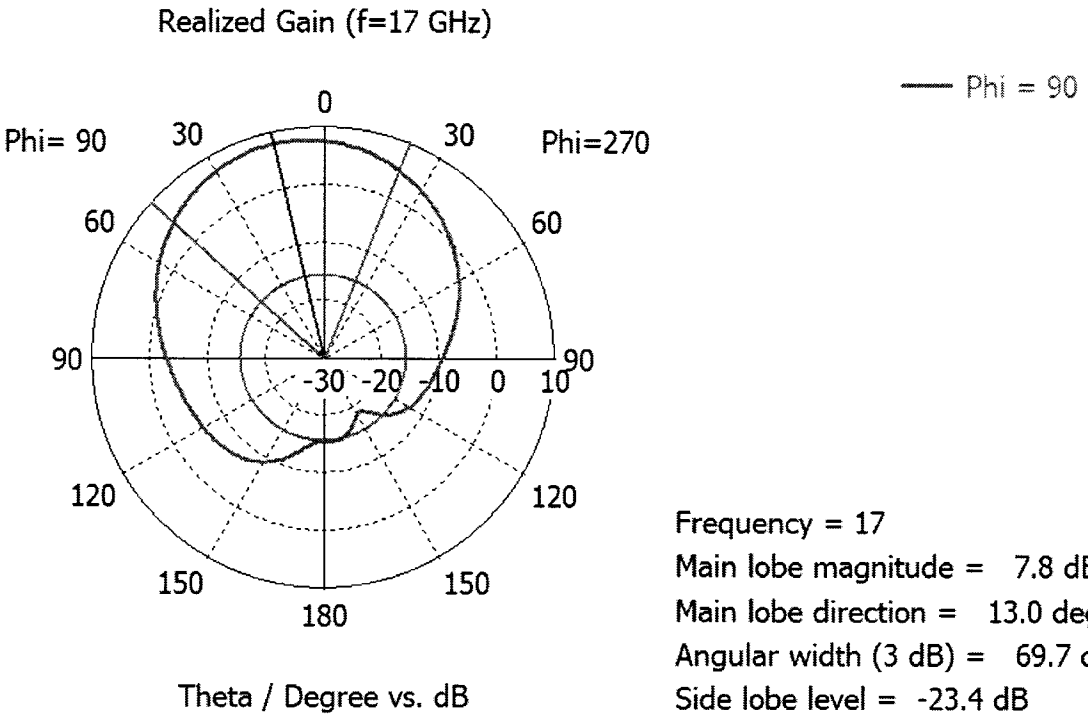

FIGS. 10F and 10G illustrate perpendicular planes of the radiation pattern of a single element from meta-material PRA array 1000 near the $1^{st}$ mode resonant frequency.

Both planes are perpendicular to the substrate surface, and FIG. 10D represents the plane perpendicular to the feedline direction. A directive, broadside radiation pattern with 13.2 dBi gain can be observed, which as expected for a 4 element array is roughly 6 dB higher (5.4 dB) than the similar single meta-PRA 1032, with gain of 7.8 dBi and radiation patterns shown in FIGS. 10F and 10G. Due to microstrip side feeding, and the sporadic radiation from the feeding network, there is a slight skew in the main lobe direction of the meta-material PRA array 1000 of about 20 degrees, compared to about 13 degrees for the single element.

Figure 11A:
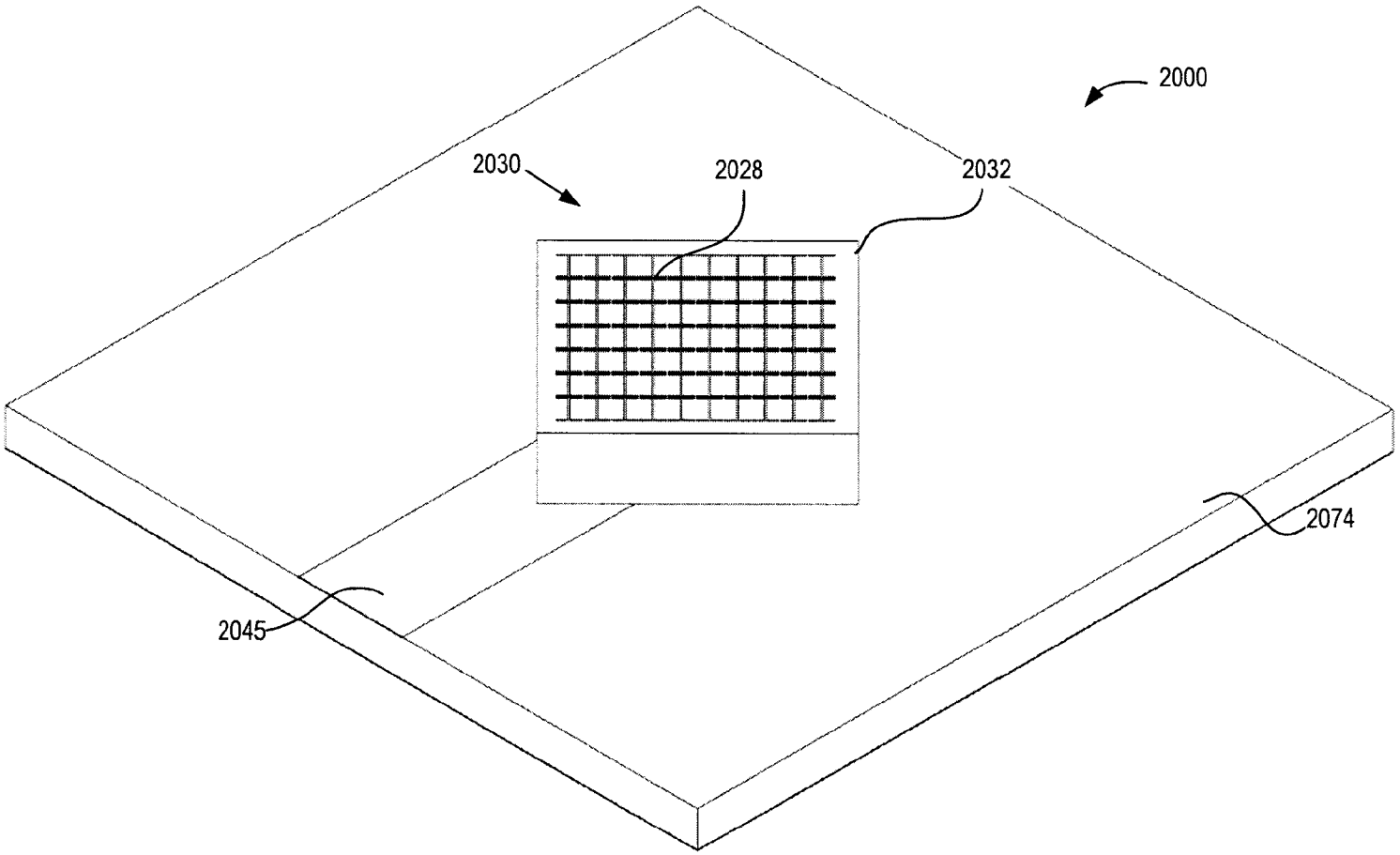
FIG. 11A is a perspective view of an example single element meta-PRA with corner-fed structure.
Figure 11B:
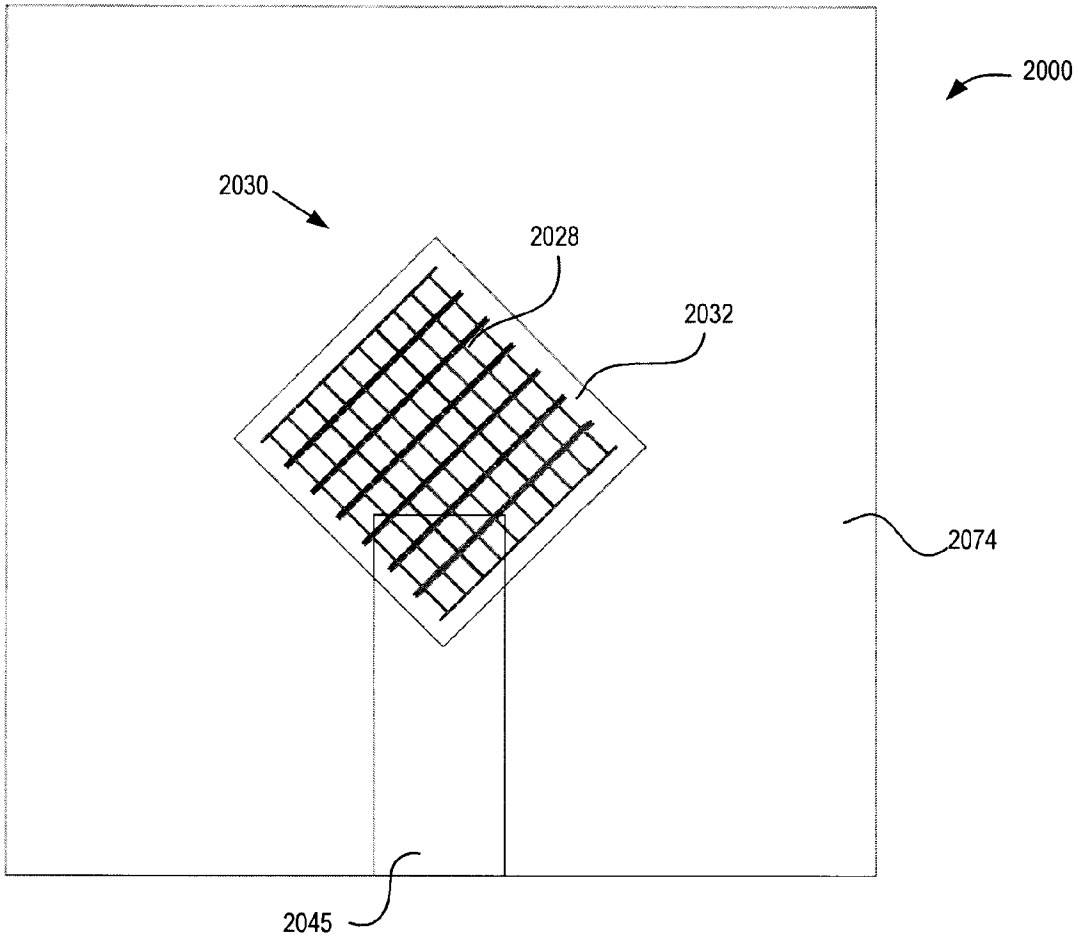
FIG. 11B is a plan view of the meta-PRA of FIG. 11A.

Meta-PRA elements can be excited with microstrip lines in different orientations to realize antenna elements with characteristics not normally found in traditional DRAs with isotropic bulk dielectric materials. This is a result of the ability to control and enhance fields through anisotropic inclusion geometries and distribution patterns. Referring now to FIGS. 11A and 11B, there are illustrated a perspective view and a top view, respectively, of an example single element meta-PRA with corner-fed structure.

Single element meta-PRA 2000 has an antenna element 2030 comprised of a resonator body 2032 with H-shaped metal inclusions 2028. The antenna element 2030 demonstrated here is generally similar to the single antenna element 1032 used in meta-material PRA array 1000, comprising a resonator body with metallic inclusions. However, in meta-PRA 2000, the single meta-DRA element 2030 is excited from its corner with a microstrip line oriented at 45 degrees relative to the sidewall of element 2030. The microstrip line 2045 extends under the corner portion of the element and metal inclusions 2028. This type of feed orientation excites multiple modes and complex field patterns as a result of the anisotropic artificial dielectric material, resulting in an ultra wideband (UWB) DRA.

Figure 11C:
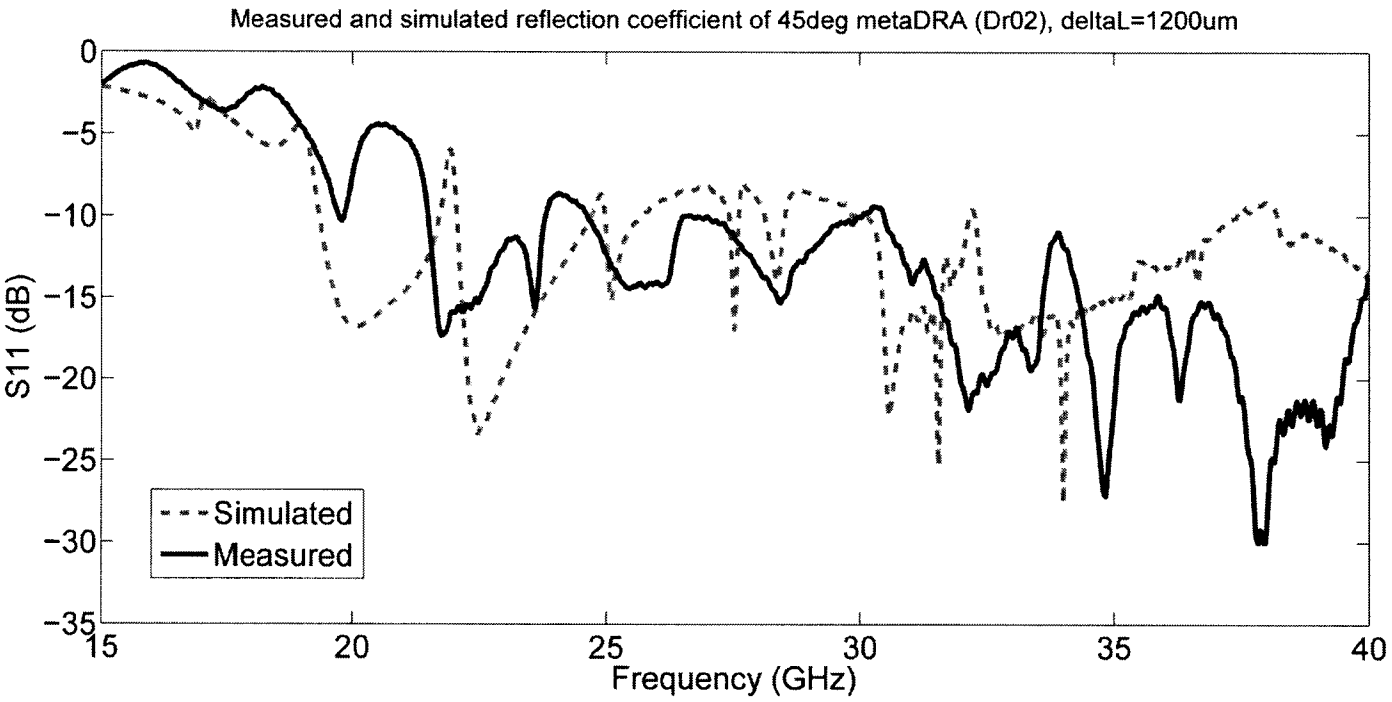
FIG. 11C illustrates the reflection coefficient (S11) of the corner-fed meta-PRA of FIGS. 11A and 11B.

Referring now to FIG. 11C, there is illustrated the reflection coefficient (S11) of the corner-fed meta-PRA 2000. FIG. 11C demonstrates the ultra-wide bandwidth of meta-PRA 2000, which has a −10 dB impedance bandwidth on the order of 20 GHz, from around 20-40 GHz. This is compared to the reflection coefficient results of side excitation of the same meta-PRA element, but with orthogonal side feeding, as illustrated and described with respect to FIG. 10C, which shows a comparably narrowband $1^{st}$ mode resonance of less than 1 GHz at around 16.9 GHz.

Figure 11D:
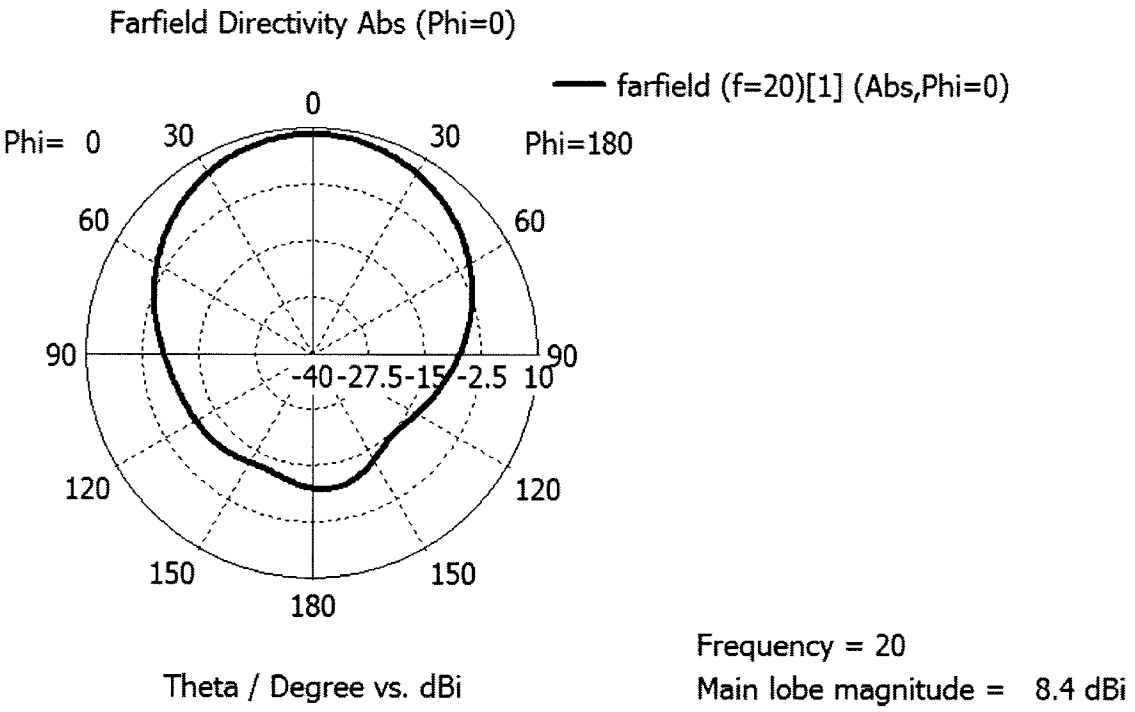
FIGS. 11D and 11E illustrate perpendicular planes of the radiation pattern of the corner-fed meta-PRA of FIGS. 11A and 11B at 20 GHz.
Figure 11E:
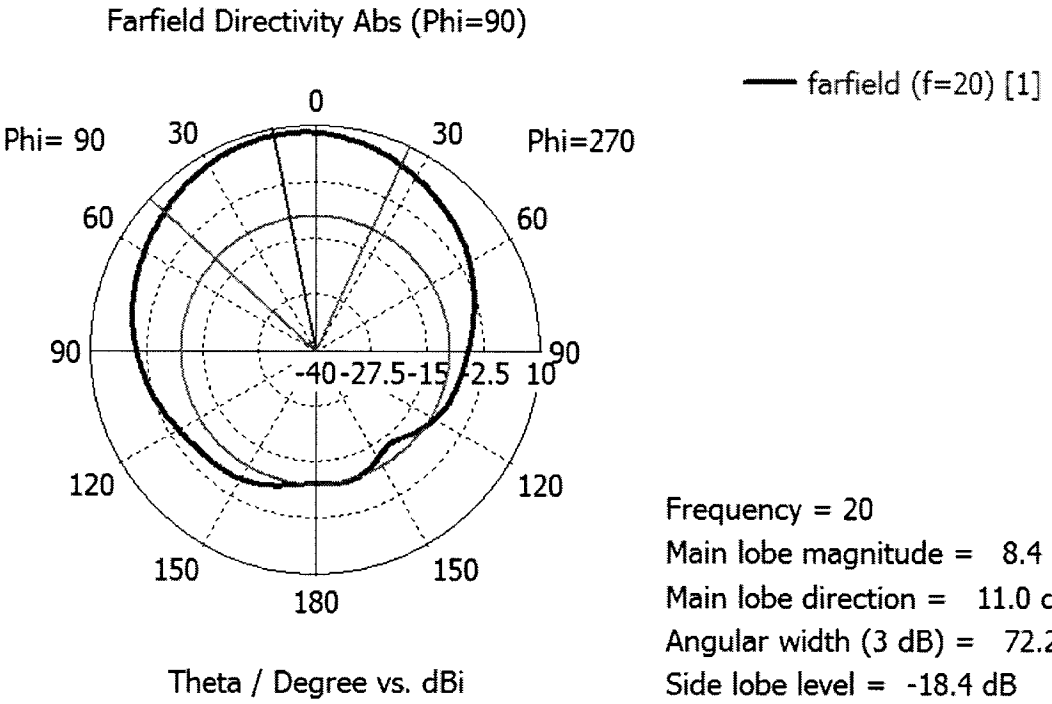

FIGS. 11D and 11E illustrate perpendicular planes of the radiation pattern of the corner-fed UWB meta-PRA 2000 at 20 GHz. Both planes are perpendicular to the substrate surface, and FIG. 11D represents the plane perpendicular to the feedline direction and FIG. 11E represents the plane parallel to the feedline direction. A broadside radiation pattern with 8.4 dBi gain at 20 GHz can be observed, with a slight skew in the main lobe direction of about 11 degrees due to microstrip side feeding.

Figure 11F:
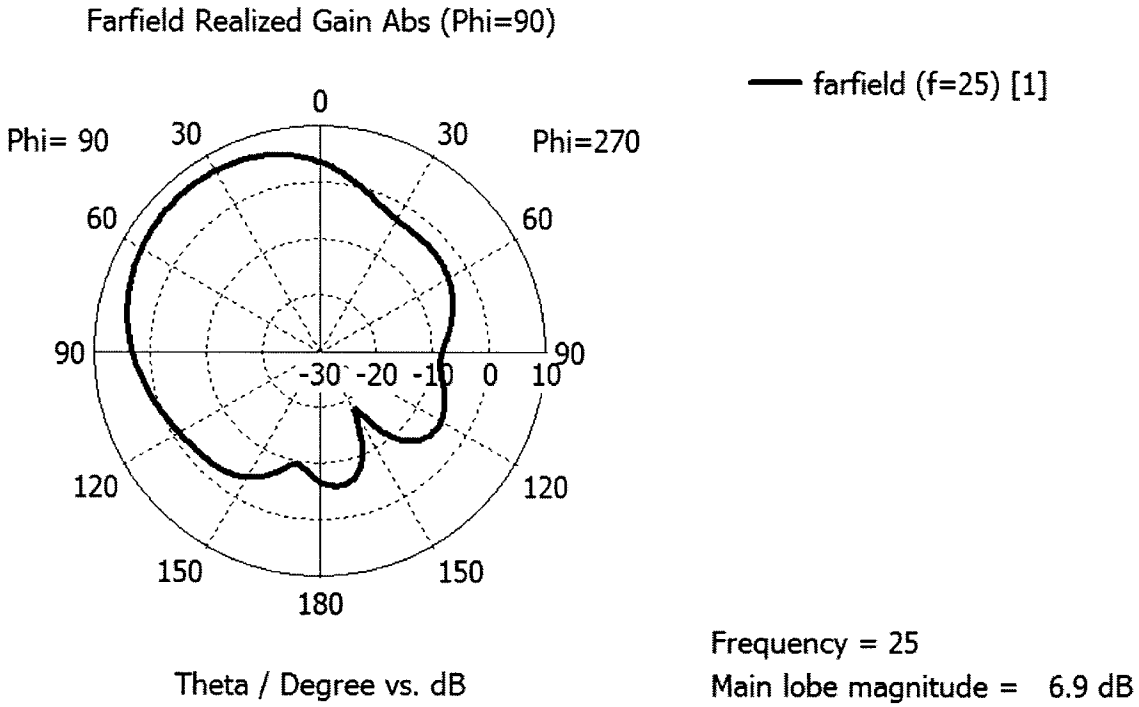
FIGS. 11F and 11G illustrate one plane of the radiation patterns for the corner-fed meta-PRA of FIGS. 11A and 11B at frequencies of 25 GHz and 40 GHz, respectively.
Figure 11G:
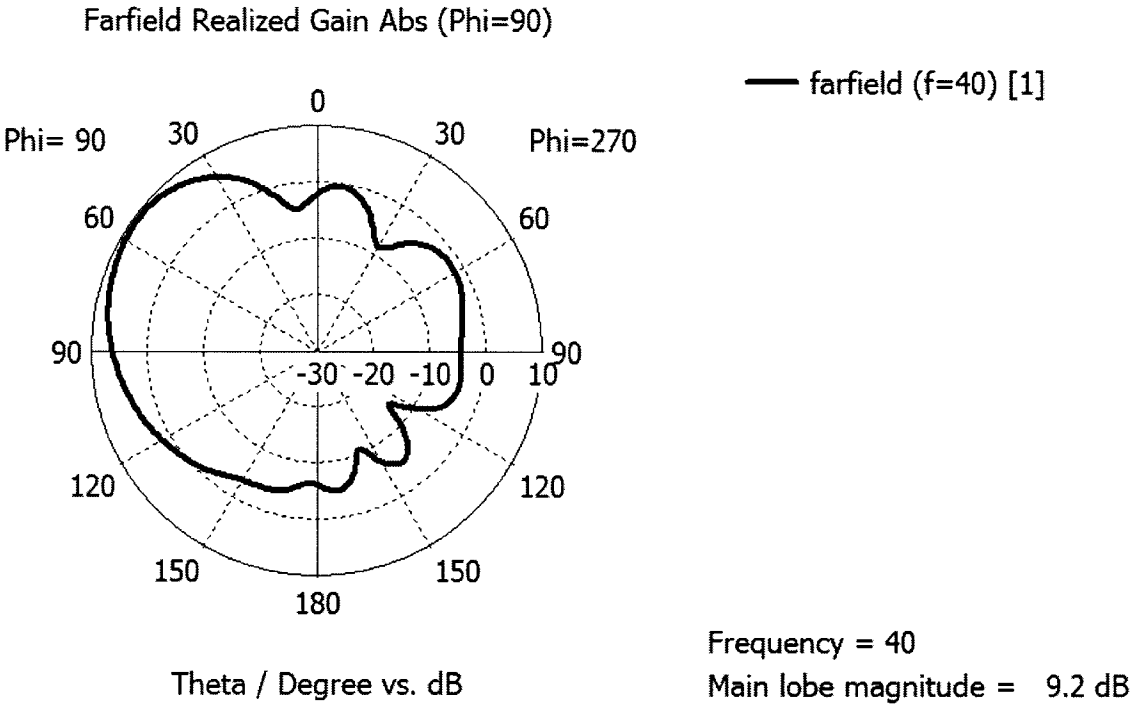

FIGS. 11F and 11G illustrate the radiation patterns for the meta-PRA 2000 in the plane parallel to the feedline direction, and at frequencies across the band (25 GHz and 40 GHz, respectively), indicating that the general radiation pattern and gain is maintained across the 20-40 GHz bandwidth, with increasing skew in the mainlobe with increasing frequency (about 60 degrees at 40 GHz).

Other meta-PRA element excitation orientations demonstrate further novel characteristics not normally found in traditional DRAs with isotropic bulk dielectric materials. For instance, antenna elements can be excited orthogonally at the sides by two ports, either separately or simultaneously.

Figure 12A:
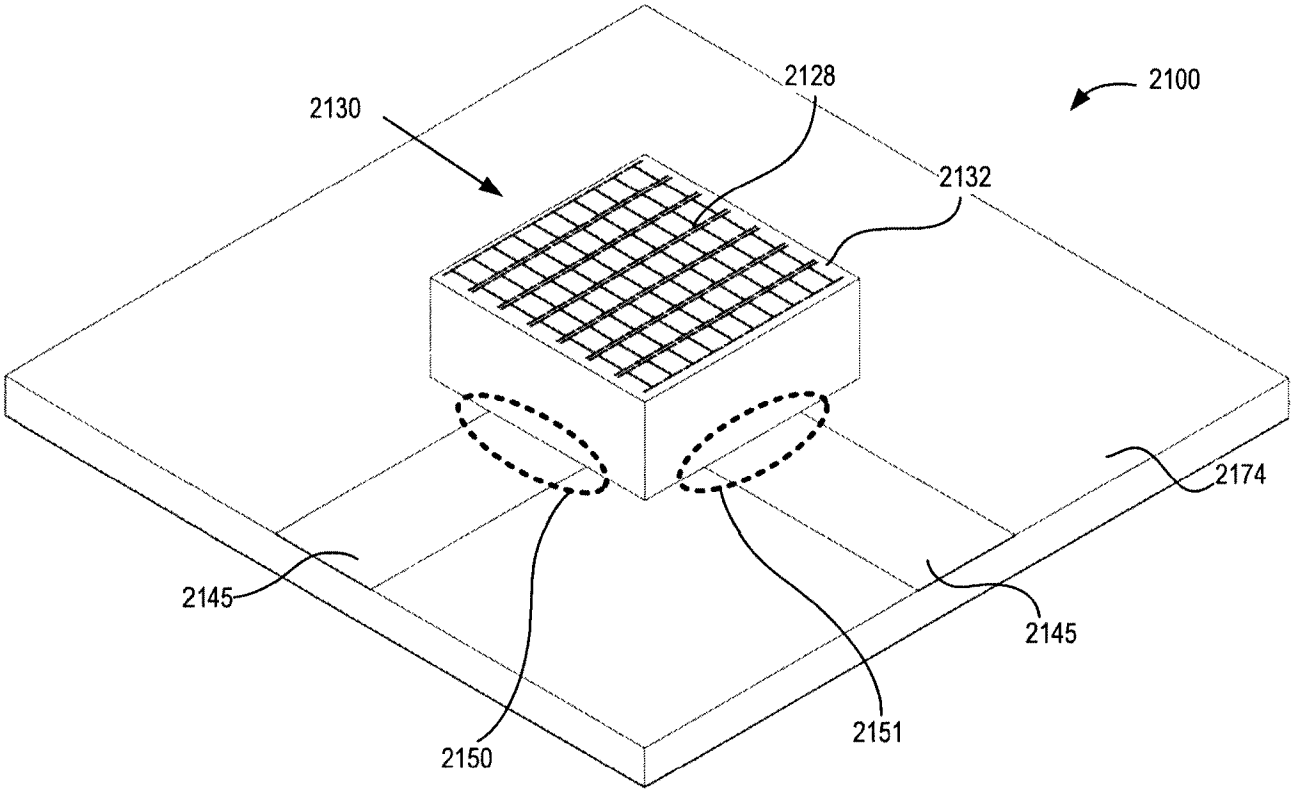
FIG. 12A is a perspective view of an example single element meta-material DRA (meta-DRA) with 2-port dual feed.

Referring now to FIG. 12A, there is illustrated a perspective view of a single element meta-DRA 2100, which has an antenna element 2130. Antenna element 2130 is generally similar to element 2030 of FIG. 11A, including a resonator body 2132 and metal inclusions 2128, but is excited orthogonally at the sides by two ports 2150 and 2151, with microstrip lines 2145 oriented at 90 deg. As a result of the anisotropic artificial dielectric material, this type of feed orientation excites two modes simultaneously. Fields from these excited modes are radiated with orthogonal polarizations. The anisotropic material exhibits anisotropic effective permittivity when excited in orthogonal orientations, and as a result, resonates at different frequencies for the different excitation ports. This enables the use of such a meta-PRA element as a multichannel transmit and/or receive device, and/or provides diplexer and/or orthogonal mode (ortho-mode) transducer functionality.

Figure 12B:
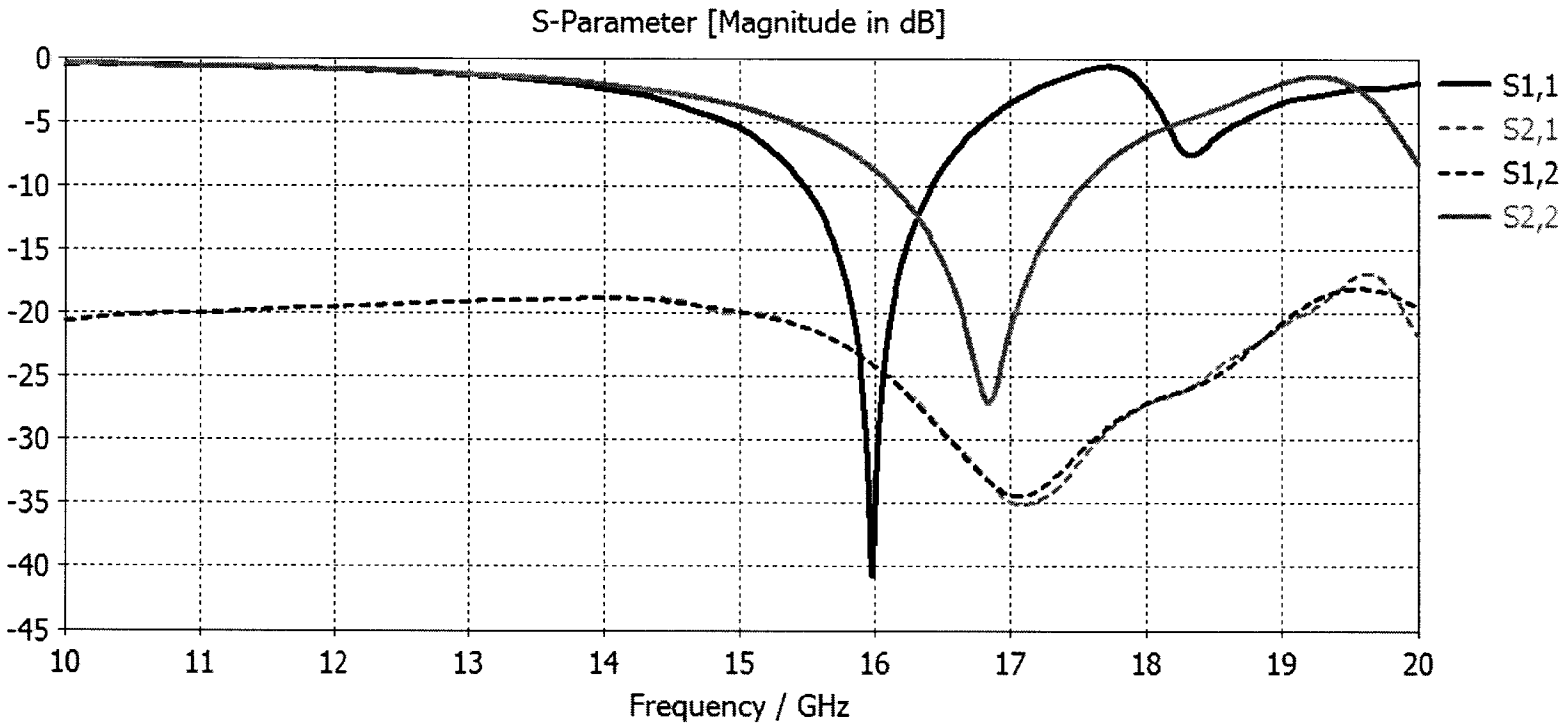
FIG. 12B illustrates the reflection coefficients at the ports (S11 and S22), and the isolation between the ports (S21 and S12), of the meta-DRA of FIG. 12A.

FIG. 12B illustrates the reflection coefficients (S11 and S22) at the ports, and the isolation (S21 and S12) between the ports, of the 2-port dual fed multi-channel meta-PRA 2100. Port 1 is the left port 2150 and Port 2 is the right port 2151, with reference to FIG. 12A.

FIG. 12B demonstrates the orthogonal anisotropic permittivity effect, showing the $1^{st}$ resonance (S11) due to Port 1 excitation at around 16.0 GHz, and the $2^{nd}$ resonance (S22) due to Port 2 excitation at around 16.9 GHz. FIG. 12B also demonstrates excellent isolation between the 2 ports, a maximum of 35 dB and typically better then 20 dB across the operating bandwidth which is important for diplexer functionality.

Figure 12C:
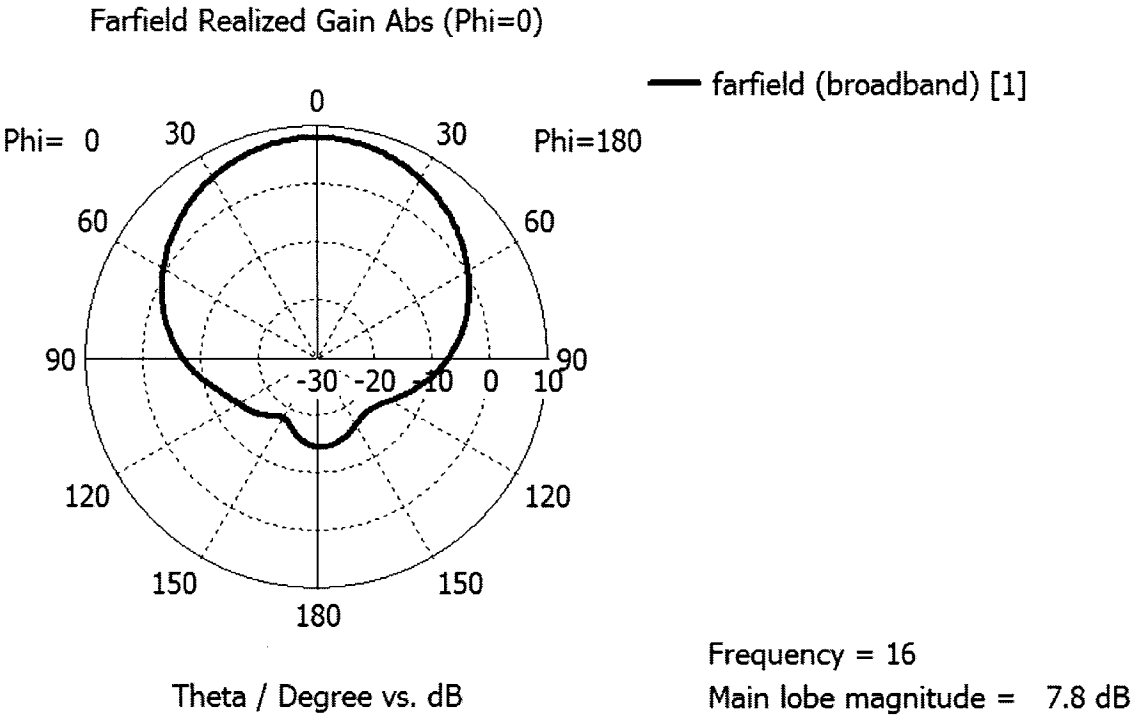
FIGS. 12C and 12D illustrate perpendicular planes of the radiation pattern for the meta-DRA of FIG. 12A for Port 1 excitation at 16.0 GHz.
Figure 12D:
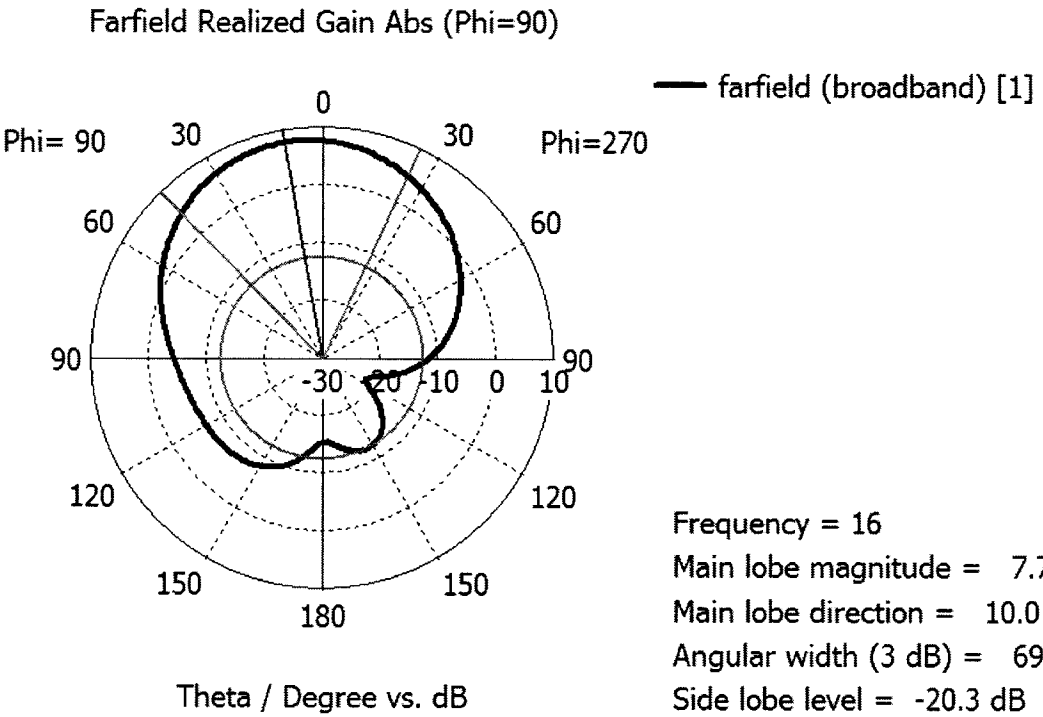

FIGS. 12C and 12D illustrate perpendicular planes of the radiation pattern of the 2-port dual fed multi-channel meta-PRA 2100, for Port 1 excitation at 16.0 GHz. Both planes are perpendicular to the substrate surface, and FIG. 12C represents the plane perpendicular to the Port 1 feedline direction. A broadside radiation pattern with 7.7 dBi gain at 16 GHz can be observed.

Figure 12E:
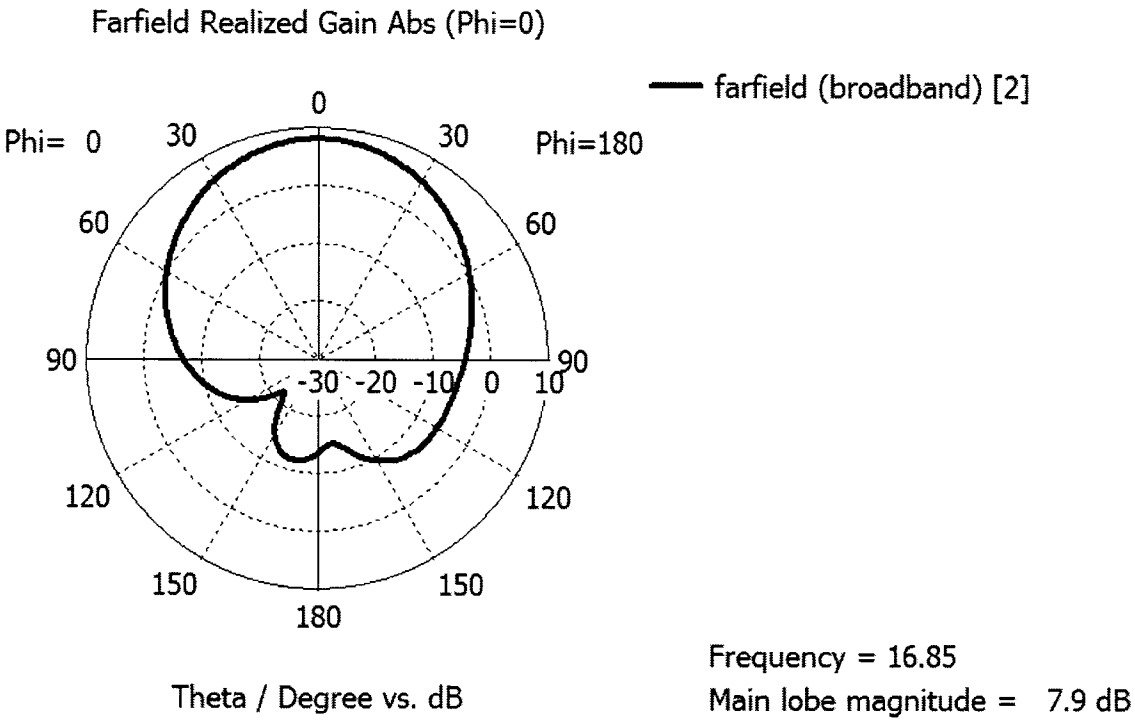
FIGS. 12E and 12F illustrate perpendicular planes of the radiation pattern for the meta-DRA of FIG. 12A for Port 2 excitation at 16.85 GHz.
Figure 12F:
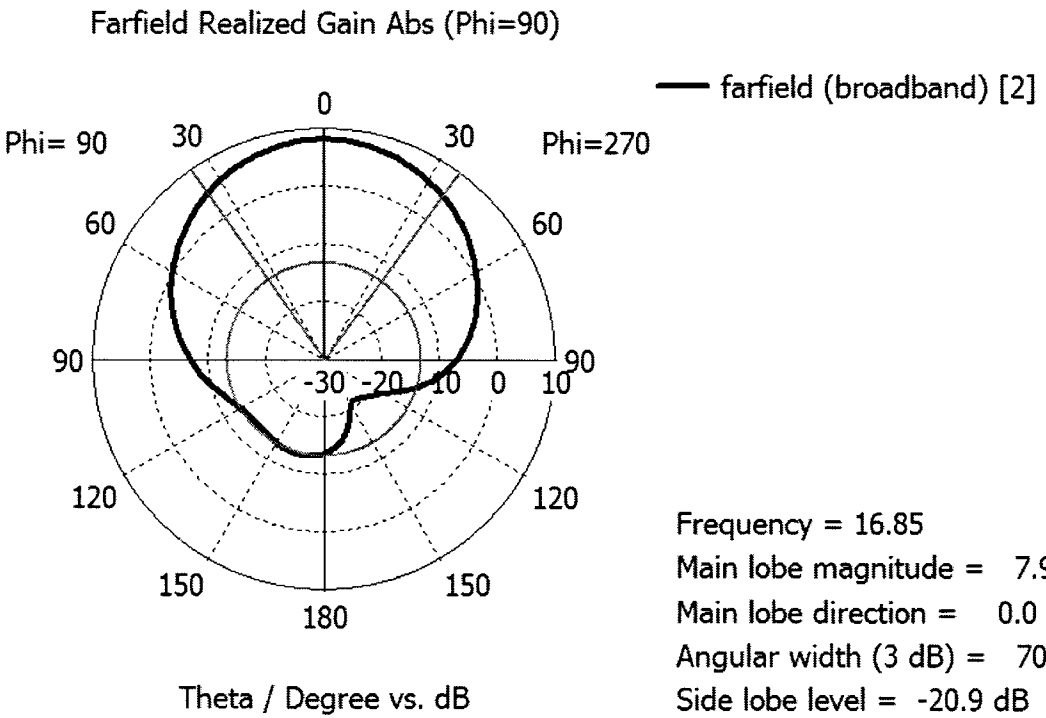

FIGS. 12E and 12F illustrate perpendicular planes of the radiation pattern for meta-PRA 2100 for Port 2 excitation at 16.85 GHz. Both planes are perpendicular to the substrate surface, and FIG. 12E represents the plane perpendicular to the Port 1 feedline direction (parallel to the Port 2 feedline direction). A similar broadside radiation pattern with 7.9 dBi gain at 16.85 GHz can be observed, with plane patterns essentially reversed from the Port 1 excitation case due to excitation of the orthogonal polarity.

Figure 12G:
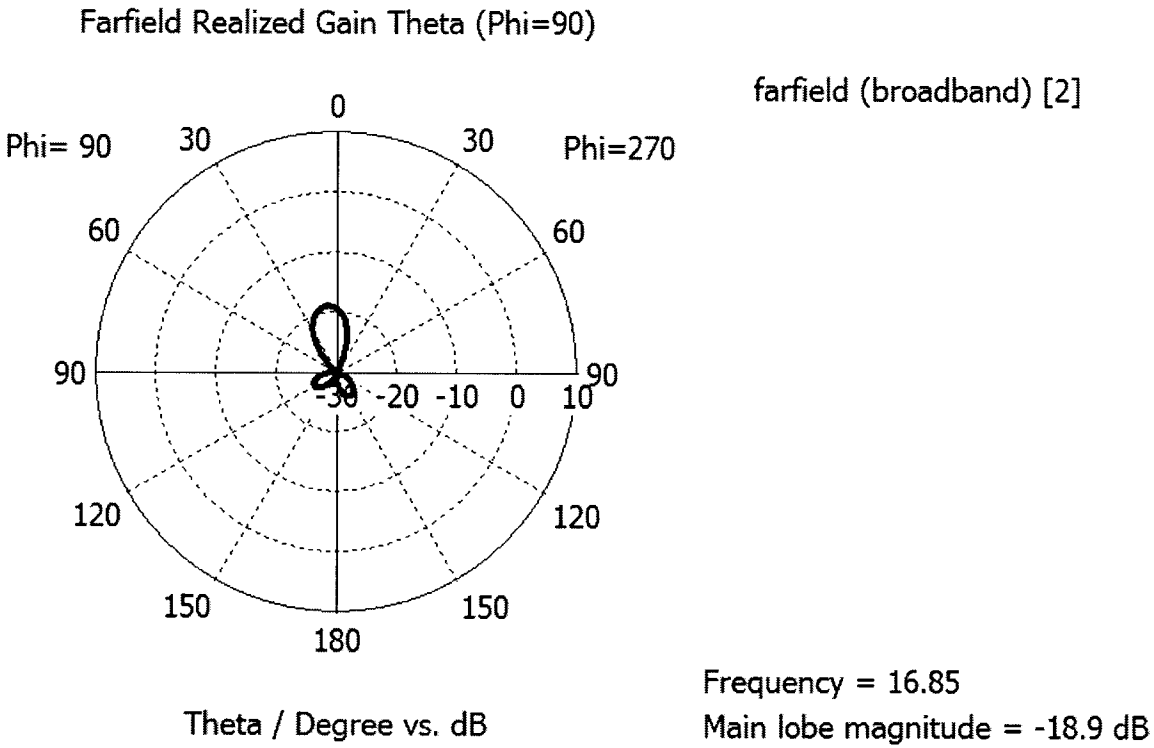
FIGS. 12G and 12H illustrate perpendicular planes of the cross-polarization radiation pattern for the meta-DRA of FIG. 12A.
Figure 12H:
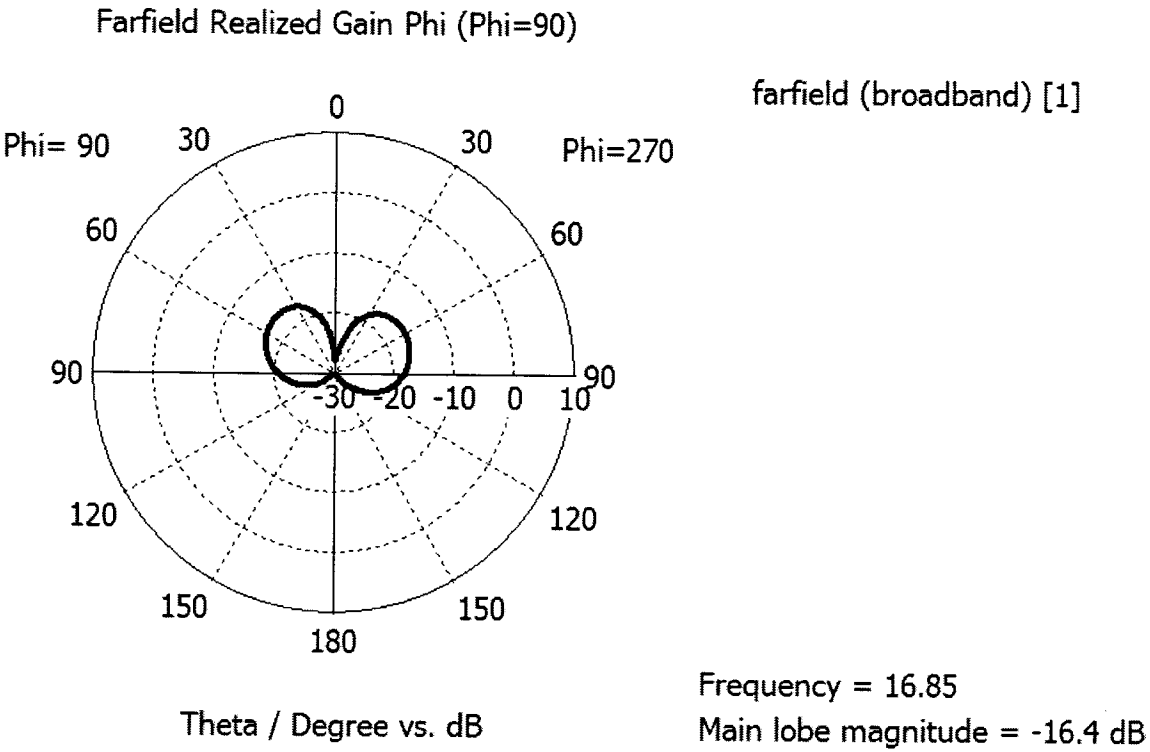

FIGS. 12G and 12H illustrate perpendicular planes of the cross-polarization radiation pattern for meta-PRA 2100. Low cross-polarization in the planes at 16.85 GHz is demonstrated in FIGS. 12G and 12H, which is important for ortho-mode transducer functionality.

Figure 12I:
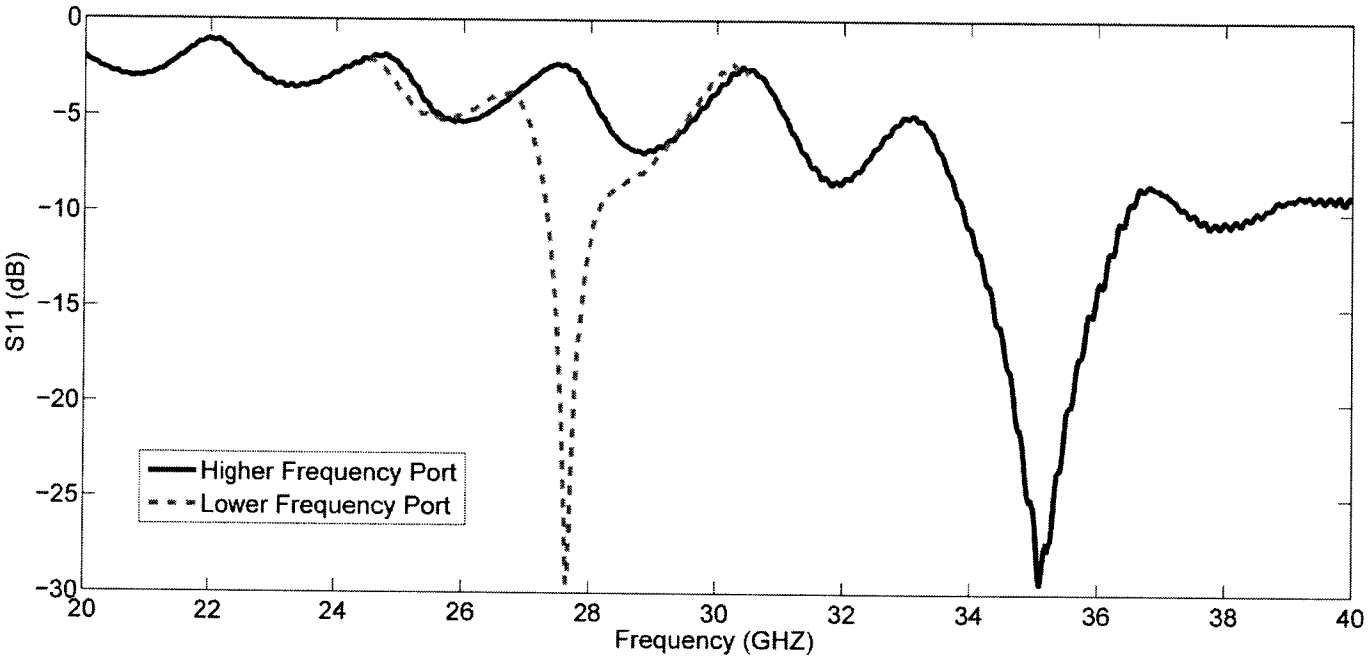
FIG. 12I illustrates reflection coefficients of another example 2-port dual fed multi-channel meta-PRA.

This dual-port behavior can be extended to physically smaller meta-PRAs operating at higher frequencies. FIG. 12I illustrates experimental results showing the reflection coefficients of a 2-port dual fed multi-channel meta-PRA, similar in size and configuration to meta-PRA 1100', with a resonator body similar to the fabricated example shown in FIG. 1C (bottom left), however in this case fed from adjacent sides with 2 orthogonally oriented microstrip feedlines as in meta-PRA 2100. FIG. 12I demonstrates the orthogonal anisotropic permittivity effect, showing the $1^{st}$ resonance (S11, lower frequency port) due to Port 1 excitation at around 27.8 GHz, and the $2^{nd}$ resonance (S11, higher frequency port) due to Port 2 excitation at around 35.1 GHz.

Numerous specific details are set forth herein in order to provide a thorough understanding of the exemplary embodiments described herein. However, it will be understood by those of ordinary skill in the art that these embodiments may be practiced without these specific details. Likewise, various modifications and variations may be made to these exemplary embodiments. In some instances, well-known methods, procedures and components have not been described in detail so as not to obscure the description of the embodiments. The scope of the claims should not be limited by the preferred embodiments and examples, but should be given the broadest interpretation consistent with the description as a whole.

The invention claimed is:

1. A dielectric metamaterial resonator antenna comprising: a substrate with at least a planar surface; a resonator body provided on the planar surface, the resonator body formed of a dielectric material, the resonator body having at least a first planar surface and a second planar surface opposed to the first planar surface; a plurality of coupled metal inclusions provided within the resonator body, each of the metal inclusions extending substantially perpendicularly from the first planar surface and at least partially through the resonator body toward the second planar surface, each of the metal inclusions having a generally constant cross-section along its height; and an excitation structure for exciting the resonator body, the excitation structure disposed on the substrate.

2. The dielectric metamaterial resonator antenna of claim 1, wherein the plurality of coupled metal inclusions are provided in a pattern that modifies the electromagnetic fields internal to the resonator body.

3. The dielectric metamaterial resonator antenna of claim 1, wherein the plurality of coupled metal inclusions are provided in a pattern that increases an effective electrical permittivity of the resonator body.

4. The dielectric metamaterial resonator antenna of claim 1, wherein the plurality of coupled metal inclusions are provided in a pattern that causes different electromagnetic fields in the resonator body when excited from different orientations.

5. The dielectric metamaterial resonator antenna of claim 1, wherein the plurality of coupled metal inclusions are provided in a pattern that creates a different effective electrical permittivity in different orientations through the resonator body.

6. The dielectric metamaterial resonator antenna of claim 1, wherein the plurality of coupled metal inclusions are provided in a pattern that causes a plurality of resonance modes in the resonator body.

7. The dielectric metamaterial resonator antenna of claim 1, wherein the excitation structure comprises at least two feedlines to excite the resonator body.

8. The dielectric metamaterial resonator antenna of claim 7, wherein at least two of the feedlines are mutually orthogonal.

9. The dielectric metamaterial resonator antenna of claim 1, wherein the resonator body radiates different electromagnetic field polarizations from the resonator body based on excitation orientation.

10. The dielectric metamaterial resonator antenna of claim 1, wherein the dielectric material is air.

11. The dielectric metamaterial resonator antenna of claim 1, wherein the dielectric material is selected from the group consisting of a polymer, a ceramic and a polymer-ceramic composite.

12. The dielectric metamaterial resonator antenna of claim 11, wherein the polymer is a resist polymer.

13. The dielectric metamaterial resonator antenna of claim 12, wherein the resist polymer is sensitive to at least one of visible light, ultra-violet radiation, extreme ultra-violet radiation, X-ray radiation, electrons, and ions.

14. The dielectric metamaterial resonator antenna of claim 1, wherein each of the plurality of coupled metal inclusions has a generally H-shaped cross-section.

15. The dielectric metamaterial resonator antenna of claim 1, wherein each of the plurality of coupled metal inclusions has a generally window-shaped cross-section.

16. The dielectric metamaterial resonator antenna of claim 1, wherein each of the plurality of coupled metal inclusions has a generally hexagonal cross-section.

17. The dielectric metamaterial resonator antenna of claim 16, wherein the plurality of coupled metal inclusions are arranged in a honeycomb pattern.

18. The dielectric metamaterial resonator antenna of claim 1, wherein each of the plurality of coupled metal inclusions has a generally rectangular-shaped cross-section.

19. The dielectric metamaterial resonator antenna of claim 1, wherein each of the plurality of coupled metal inclusions has a generally triangular-shaped cross-section.

20. The dielectric metamaterial resonator antenna of claim 1, wherein each of the plurality of coupled metal inclusions has a cross-section of arbitrary geometry.

21. The dielectric metamaterial resonator antenna of claim 1, wherein the thickness of the resonator body is between 5 and 5000 microns.

22. The dielectric metamaterial resonator antenna of claim 1, wherein the resonator body is formed of a single material layer.

23. The dielectric metamaterial resonator antenna of claim 1, wherein the resonator body is formed of multiple material layers.

24. The dielectric metamaterial resonator antenna of claim 1, wherein each of the plurality of coupled metal inclusions has a height that is between 2 and 100% of a thickness of the resonator body.

25. The dielectric metamaterial resonator antenna of claim 1, wherein the plurality of coupled metal inclusions are printed on the first planar surface.

26. The dielectric metamaterial resonator antenna of claim 1, wherein each of the plurality of coupled metal inclusions has a cross section size smaller than one-fifth of an operating signal wavelength in the resonator body.

27. The dielectric metamaterial resonator antenna of claim 1, wherein each of the plurality of coupled metal inclusions has a pattern spacing smaller than one-fifth of the operating signal wavelength in the resonator body.

28. The dielectric metamaterial resonator antenna of claim 1, wherein the plurality of coupled metal inclusions comprises a first inclusions and at least a second plurality of metal inclusions, wherein a first size of each of the first plurality of metal inclusions is different than a second size of each of the second plurality of metal inclusions.

29. The dielectric metamaterial resonator antenna of claim 28, wherein a first pattern spacing of the first plurality of metal inclusions is different than a second pattern spacing of the second plurality of metal inclusions.

30. The dielectric metamaterial resonator antenna of claim 1, wherein the dielectric material is a variable electrical permittivity material.

31. The dielectric metamaterial resonator antenna of claim 1, wherein a variable electrical permittivity material layer is placed underneath the resonator body.

32. The dielectric metamaterial resonator antenna of claim 30, wherein the variable electrical permittivity material is a liquid crystal polymer.

33. The dielectric metamaterial resonator antenna of claim 30, further comprising a biasing circuit for tuning the variable electrical permittivity material.

34. The dielectric metamaterial resonator antenna of claim 30, wherein the effective permittivity tuning range is increased by the plurality of coupled metal inclusions.

35. The dielectric metamaterial resonator antenna of claim 1, wherein the resonator body has a rectangular cross-section.

36. The dielectric metamaterial resonator antenna of claim 1, wherein the resonator body has an elliptical cross-section.

37. The dielectric metamaterial resonator antenna of claim 1, wherein the resonator body has a fractal cross-section.

38. The dielectric metamaterial resonator antenna of claim 1, comprising at least one additional resonator body, wherein the at least one additional resonator body is generally analogous to the resonator body, and wherein the at least one additional resonator body is provided in an array configuration.

39. The dielectric metamaterial resonator antenna of claim 38, wherein the at least one additional resonator body is integrally formed with the resonator body as a monolithic structure.

40. The dielectric metamaterial resonator antenna of claim 31, wherein the variable electrical permittivity material is a liquid crystal polymer.

41. The dielectric metamaterial resonator antenna of claim 31, further comprising a biasing circuit for tuning the variable electrical permittivity material.

42. The dielectric metamaterial resonator antenna of claim 31, wherein the effective permittivity tuning range is increased by the plurality of coupled metal inclusions.

43. A method of fabricating a dielectric metamaterial resonator antenna, the method comprising: forming a substrate with at least a planar surface; depositing and patterning an excitation structure on the substrate; forming a resonator body from a dielectric material on the planar surface of the substrate, the resonator body having at least a first planar surface abutting the substrate and a second planar surface opposed to the first planar surface; forming a plurality of cavities in the resonator body, each of the plurality of cavities extending substantially perpendicularly from the first planar surface and at least partially through the resonator body toward the second planar surface, each of the cavities having a generally constant cross-section along its height; and depositing a plurality of metal inclusions in the respective plurality of cavities.

44. The method of fabricating a dielectric metamaterial resonator antenna of claim 43, wherein forming the plurality of cavities comprises; exposing the resonator body to a lithographic source via a pattern mask, wherein the pattern mask defines the plurality of cavities to be formed in the resonator body; and developing at least one exposed portion of the resonator body and removing the at least one exposed portion to reveal the plurality of cavities.

45. The method of fabricating a dielectric metamaterial resonator antenna of claim 43, wherein forming the plurality of cavities comprises: exposing the resonator body to a beam patterning source to define the plurality of cavities to be formed in the resonator body; and developing at least one exposed portion of the resonator body and removing the at least one exposed portion to reveal the plurality of cavities.

46. The method of fabricating a dielectric metamaterial resonator antenna of claim 43, wherein the resonator body is removed following deposition of the plurality of metal inclusions.

* * * * *